US012331506B2

(12) United States Patent
Dicaire et al.

(10) Patent No.: US 12,331,506 B2
(45) **Date of Patent: *Jun. 17, 2025**

(54) EXPANDABLE HANGER FOR BEAM

(71) Applicant: OMG Building Products LLC, Agawam, MA (US)

(72) Inventors: Mark A. Dicaire, Boylston, MA (US); Logan Carlson, Wilbraham, MA (US); Kenneth D. Canup, Matthews, NC (US); Timothy F. Gillis, Florence, MA (US); Jonathan W. Dezielle, Agawam, MA (US); Frederick A. Enko, Westfield, MA (US); Mark J. Guthrie, West Springfield, MA (US); Mitchell T. Kraucunas, Enfield, CT (US); Walter Joseph Fallows, III, Traverse City, MI (US)

(73) Assignee: OMG Building Products LLC, Agawam, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/458,180

(22) Filed: Aug. 30, 2023

(65) Prior Publication Data

US 2023/0407621 A1 Dec. 21, 2023

Related U.S. Application Data

(63) Continuation of application No. 17/364,950, filed on Jul. 1, 2021, now Pat. No. 11,773,582.

(Continued)

(51) Int. Cl.
*E04B 1/26* (2006.01)

(52) U.S. Cl.
CPC ..... *E04B 1/2612* (2013.01)

(58) Field of Classification Search
CPC ..... E04B 1/2612

(Continued)

(56) References Cited

U.S. PATENT DOCUMENTS 625,427 A 5/1899 Stewart
804,451 A 11/1905 Carlson (Continued)

FOREIGN PATENT DOCUMENTS

AU 2017201164 A1 3/2017
BE 1017165 A6 3/2008

(Continued)

OTHER PUBLICATIONS

Agnew Building Supplies "Mitek Split Joist Hangers—Left & Right," retrieved on Mar. 23, 2020 from https://www.agnewbuildingsupplies.com.au/product/46033/mitek-split-joist-hangers-left-right.html.

(Continued)

*Primary Examiner* — James J Buckle, Jr.
(74) *Attorney, Agent, or Firm* — Alix, Yale & Ristas, LLP

(57) ABSTRACT

An adjustable hangar for attaching an elongate beam to a structural building member includes a lower module and an upper module that are engaged with one another in a vertically reciprocal manner. The lower module includes a bottom web for supporting an edge of a beam. The upper module includes a top panel opposite and spaced apart from the support web. When a beam is installed between top panel and bottom web, the upper module and lower module may be contracted to adjust the relative position of the top panel and bottom web. In an embodiment, the position can be contracted to trap the top edge and bottom edge of the beam between the top panel and bottom web.

20 Claims, 57 Drawing Sheets

Related U.S. Application Data

(60) Provisional application No. 63/170,144, filed on Apr. 2, 2021, provisional application No. 63/135,169, filed on Jan. 8, 2021, provisional application No. 63/046,897, filed on Jul. 1, 2020.

(58) Field of Classification Search
USPC ..... 52/704
See application file for complete search history.

(56) References Cited

U.S. PATENT DOCUMENTS

| | | | |
|---|---|---|---|
| 3,623,755 | A | 11/1971 | Ratliff, Jr. |
| 3,878,655 | A | 4/1975 | Toth et al. |
| 4,124,962 | A | 11/1978 | Lancelot, III et al. |
| 4,192,623 | A | 3/1980 | Borg |
| 4,411,548 | A | 10/1983 | Tschan |
| 4,802,786 | A | 2/1989 | Yauger et al. |
| 4,965,980 | A | 10/1990 | Leavens |
| 5,111,632 | A | 5/1992 | Turner |
| 5,555,694 | A | 9/1996 | Commins |
| 5,564,248 | A | 10/1996 | Callies |
| 5,603,580 | A | 2/1997 | Leek et al. |
| 5,611,189 | A | 3/1997 | Fleck |
| 5,836,131 | A | 11/1998 | Viola et al. |
| 5,910,085 | A | 6/1999 | Pruett |
| 6,301,855 | B1 | 10/2001 | Aerni |
| 6,463,711 | B1 | 10/2002 | Callies |
| 6,631,587 | B2 | 10/2003 | Lynch |
| 6,651,937 | B1 | 11/2003 | Wilson |
| 7,124,546 | B2 | 10/2006 | Scharff et al. |
| 7,343,712 | B2 | 3/2008 | Shelton |
| 7,805,910 | B2 | 10/2010 | Whale et al. |
| 8,250,827 | B2 | 8/2012 | Lin et al. |
| 8,978,339 | B2 | 3/2015 | Doupe et al. |
| 9,115,506 | B2 | 8/2015 | Hill |
| 9,206,594 | B1 | 12/2015 | Grevious et al. |
| 9,228,338 | B2 | 1/2016 | Lin |
| 9,234,344 | B2 | 1/2016 | Hatzinikolas |
| 9,394,680 | B2 | 7/2016 | Bundy et al. |
| 9,637,911 | B2 | 5/2017 | Doupe et al. |
| 9,809,974 | B1 | 11/2017 | Brekke |
| 9,874,008 | B2 | 1/2018 | Doupe et al. |
| 9,999,302 | B2 | 6/2018 | Knepper |
| 10,024,049 | B2 | 7/2018 | Brekke et al. |
| 10,179,992 | B2 | 1/2019 | Brekke |
| 10,214,897 | B2 | 2/2019 | Tan |
| 10,227,772 | B1 | 3/2019 | Hill |
| 10,358,812 | B2 | 7/2019 | Jensen et al. |
| 10,392,797 | B2 | 8/2019 | Cullen |
| 11,098,478 | B2 | 8/2021 | Downs et al. |
| 2002/0078656 | A1 | 6/2002 | Leek et al. |
| 2003/0009980 | A1 | 1/2003 | Shahnazarian |
| 2004/0096269 | A1 | 5/2004 | Shahnazarian |
| 2004/0129845 | A1 | 7/2004 | Whale et al. |
| 2004/0134159 | A1 | 7/2004 | Shahnazarian |
| 2005/0017142 | A1 | 1/2005 | Ogden |
| 2005/0120669 | A1 | 6/2005 | Harrison |
| 2006/0156682 | A1 | 7/2006 | McAndrew et al. |
| 2007/0193194 | A1 | 8/2007 | Smith |
| 2008/0172976 | A1 | 7/2008 | Carney et al. |
| 2008/0202060 | A1 | 8/2008 | Pilpel et al. |
| 2008/0237421 | A1 | 10/2008 | Szpotowski |
| 2008/0283702 | A1 | 11/2008 | Ikerd |
| 2009/0113839 | A1 | 5/2009 | Carr |
| 2009/0173035 | A1 | 7/2009 | Collins |
| 2013/0067850 | A1 | 3/2013 | Sasanecki |
| 2014/0182236 | A1 | 7/2014 | Doupe et al. |
| 2015/0218832 | A1 | 8/2015 | Peters et al. |
| 2017/0130755 | A1 | 5/2017 | Muhn et al. |
| 2017/0191253 | A1 | 7/2017 | Vilasineekul et al. |
| 2018/0127970 | A1 | 5/2018 | Evans |
| 2018/0355602 | A1 | 12/2018 | Evans et al. |
| 2019/0376275 | A1 | 12/2019 | Evans et al. |
| 2020/0325671 | A1 | 10/2020 | Holland et al. |
| 2021/0230858 | A1 | 7/2021 | Daudet |

FOREIGN PATENT DOCUMENTS

| | | | |
|---|---|---|---|
| CA | 2531882 | A1 | 7/2006 |
| DE | 9400091 | U1 | 2/1994 |
| FR | 2711745 | A1 | 5/1995 |
| GB | 2156398 | A | 10/1985 |
| GB | 2176222 | B | 6/1988 |
| GB | 2316103 | B | 12/2000 |
| GB | 2397829 | A | 8/2004 |
| GB | 2401378 | A | 11/2004 |
| GB | 2421964 | A | 7/2006 |
| GB | 2451853 | A | 2/2009 |
| GB | 2488794 | A | 9/2012 |
| GB | 2509054 | A | 6/2014 |
| WO | 02057557 | A1 | 7/2002 |
| WO | 02097205 | A1 | 12/2002 |

OTHER PUBLICATIONS

Buildersmetalwork.com, "How to Choose the Right Joist Hanger," retrieved on Mar. 23, 2020 from https://www.buildersmetalwork.com/how_to_choose_the_right_joisthangers.html.

Mitek Industries, Inc., "EWP Hangers. Face Mount I-Joist Hangers," retrieved on Oct. 7, 2019 from https://www.mitek-us.com/products/ewp-hangers/face-mount-hangers/IHFL / IHF/.

Mitek Industries, Inc., "EWP Hangers. Power Nail Hangers," retrieved on Oct. 7, 2019 from https://www.mitek-us.com/products/ewp-hangers/face-mount-hangers/JN / JNE / MTHF/.

Mitek Industries, Inc., "EWP Hangers. Face Mount I-Joist Hangers," retrieved on Oct. 7, 2019 from https://www.mitek-us.com/products/ewp-hangers/face-mount-hangers/THF/.

Mitek Industries, Inc., "EWP Hangers. Face Mount I-Joist Hangers," retrieved on Oct. 7, 2019 from https://www.mitek-us.com/products/ewp-hangers/face-mount-hangers/THFI/.

Fasteners Plus, "Simpson PF24B 2x4 Post Frame Hanger—G90 Galvanized," retrieved on Mar. 23, 2020 from https://www.fastenersplus.com/products/Simpson-PF24B-2x4-Post-Frame-Hanger-G90-Galvanized?gcl.

Mitek Industries, Inc., "USP Product Catalog. JL/JLIF/SUH Face Mount Joist Hangers," 2019.

Ocm, Inc., "Adjustable Joist Hanger. Product Tech Data," retrieved on Oct. 9, 2020 from www.ocm-inc.com/view.asp?id=71&productid=138.

Mitek Industries, Inc., "Solid Sawn Hangers. Face Mount Joist Hangers," retrieved on Oct. 7, 2019 from https://www.mitek-us.com/products/solid-sawn-hangers/face-mount-hangers/JL / JLIF / SUH/.

Mitek Industries, Inc., "Solid Sawn Hangers. Multi-Purpose Joist Hanger," retrieved on Oct. 7, 2019 from https://www.mitek-us.com/products/solid-sawn-hangers/face-mount-hangers/JH/.

SureBuilt Concrete Forms & Accessories, "Adjustable Joist Hanger. Temporary support bracket for lumber joists and bridge deck material," Sep. 2019.

Simpson Strong-Tie, "LUC Concealed Flange Light Face-Mount Joist Hanger," retrieved from https://www.strongtie.com/facemounthangersssl_solidsawnlumberconnector/luc_hanger/p/luc, published prior to Jul. 1, 2020.

International Search Report and Written Opinion mailed Nov. 3, 2021 for International Patent Application No. PCT/US2021/040033.

EXPANDABLE HANGER FOR BEAM

CROSS-REFERENCE TO RELATED APPLICATIONS

This application is a continuation of U.S. patent application Ser. No. 17/364,950, filed Jul. 1, 2021, for Expandable Hanger for Beam, which claims priority to U.S. Provisional Patent Application No. 63/135,169, filed Jan. 8, 2021, for Expandable Joist Hanger, and to U.S. Provisional Patent Application No. 63/046,897, filed Jul. 1, 2021, for Joist Hanger With Lateral and Vertical Expandability, the entire contents of which are incorporated herein.

BACKGROUND

This disclosure relates generally to the field of building construction connectors, more particularly to a hanger for supporting and attaching an elongate beam, such as a joist for example, relative to a building support member, such as a ledger. More particularly, the disclosure relates to a modular hanger that is expandable to accommodate different dimensions of beams and building members.

In construction and building fields, hangers are common for assisting in the connection of one building member to another, such as an elongate beam or joist to a rear support member. Hangers are often formed of metal, such as steel, and include numerous sides and surfaces used for attaching to a support member and beam, and holding and supporting the beam.

One common type of beam is a deck or floor joist used as a substructure to support an overlying deck or floor structure. Deck joists can attach to an end support member, such as a ledger, usually on a side of a building, and extend substantially perpendicular therefrom at a height substantially parallel to the other joists. A beam or joist hanger is used as an intermediate member to attach the joists to the support member. Such hangers are usually formed of a single piece of steel with opposite sides and a bottom web for holding and supporting a beam from underneath, and rear and/or top flange elements for attaching to a support member.

Common problems associated with known beam hangers include that they are cumbersome and time consuming to install, require many meticulous measurements and it can be difficult to level the beam. Furthermore, known hangers are usually fixed in dimension and can only be used for beams having a single dimension. Thus, it would be useful to provide a hanger with capabilities to improve upon these common issues. It would also be useful to have a hanger that encourages runoff of rainwater away from a building structure (i.e., house).

SUMMARY

In one embodiment, an adjustable hanger for use in attaching an elongate beam to a building support structure includes an upper module and a lower module engaged with one another. The upper module has a top support structure engagement unit and opposite upper side units. The lower module has a lower web for supporting an edge of the support beam and two opposite lower side units extending upwardly from the web. Each of the upper side units is slidably engaged with one of the lower side units to vertically move the upper and lower modules relative to each other and adjust a positioning of the lower web relative to the top support structure engagement unit.

In another embodiment, the disclosed adjustable hanger includes an upper module and a lower module. The upper module has a top panel extending in a forward direction, a rear flange extending in a rearward direction, and at least one upper engagement leg extending downward. The lower module has a bottom web extending in a forward direction and at least one lower engagement unit. The top panel is movable relative to the bottom web from a fully collapsed position to a fully expanded position via sliding engagement between the at least one upper engagement leg and at least one lower engagement unit to trap an elongate beam between the top panel and bottom web. The rear flange is configured to rest on a top edge of a building support structure. The bottom web is substantially parallel to the rear flange such that a beam trapped between the top panel and bottom web is maintained substantially parallel with the top edge of the building support structure when the rear flange is resting on the top edge.

In yet another embodiment, the adjustable hanger has an upper module and a lower module. The upper module includes a top panel with a substantially flat bottom surface, and the lower module has a bottom web with a substantially flat top surface. The upper module and lower module are attached to one another with the bottom surface of the top panel opposing the top surface of the bottom web substantially parallel to one another with spacing therebetween. When attached, the upper module and lower module are slidable relative to each other to expand and contract the spacing. An elongate beam is receivable in the spacing with the upper module and lower module in a relatively expanded position. The upper module and lower module can be contracted from the relatively expanded position to trap the top edge and bottom edge of the beam with the beam extending forward.

In some embodiments, the hanger is configured for the upper side units, lower side units, top panel and lower web to circumscribe a beam on its opposite sides, upper edge and lower edge.

In some embodiments of the hanger, the upper module and lower module are optionally vertically lockable relative to one another.

In some embodiments of the disclosed hanger, the top panel defines a viewing window from a top surface to a bottom surface.

In some embodiments of the disclosed hanger, each lower side unit comprises at least one toenail guide and each toenail guide defines an obliquely extending hole through the respective side unit.

In some embodiments of the disclosed hanger, the top panel defines an upper surface and opposite lower surface, and the upper surface is angled downward relative to the lower surface from a rear to a front.

In some embodiments of the disclosed hanger, the upper module and lower module are engaged in a vertically slidable relationship.

In some embodiments of the disclosed hanger, the upper module is engaged with the lower module via a ratchet connection.

In some embodiments, each of the lower side units defines a vertical track and each of the upper side units defines a guide that is receivable and vertically movable within a vertical track. In other embodiments, the relative location of the guides and vertical tracks is reversed such that the upper side units include a track and the lower side units include a guide, such as a projection receivable within a guide.

In some embodiments of the disclosed hanger, the upper module includes a pair of laterally spaced apart side legs with each side leg engaged with one of the lower side units to secure the upper module to the lower module.

In some embodiments of the disclosed hanger, the upper module and lower module are engaged with one another at their respective rear ends, and the beam extends forward from the hanger from proximate the rear ends.

In some embodiments of the disclosed hanger, the top module includes a support flange extending rearwardly from the top module at a height proximate a height of the top panel. The flange is configured to rest atop the support member and thereby ensure that the web and beam extend from the support member at a substantially perpendicular angle.

In some embodiments of the disclosed hanger, each lower side unit comprises at least one toenail guide, and each toenail guide defines an obliquely extending hole through the respective side unit.

In some embodiments of the disclosed hanger, each guide comprises a boss cover configured to at least partially break away from the respective side unit when a fastener is driven through the hole.

In some embodiments of the disclosed hanger, the hanger is formed from a polymer or composite material.

In some embodiments of the disclosed hanger, the upper module comprises an upper right sub-assembly and an upper left sub-assembly. The lower module may also comprise a lower right sub-assembly and a lower left sub-assembly. The upper and lower right sub-assemblies may be laterally movable relative to the upper and lower left sub-assemblies to accommodate one or more joists having varying thickness dimensions.

Some embodiments of the disclosed hanger additionally include an elastic band circumscribing the outside of the upper module and lower module that provides an inward bias holding the modules toward one another.

Some embodiments include one or more elongate ribs along an outer surface for improving structural integrity. In some embodiments, multiple ribs are spaced apart and extend around the bottom of the support web.

DETAILED DESCRIPTION

Figure 1:
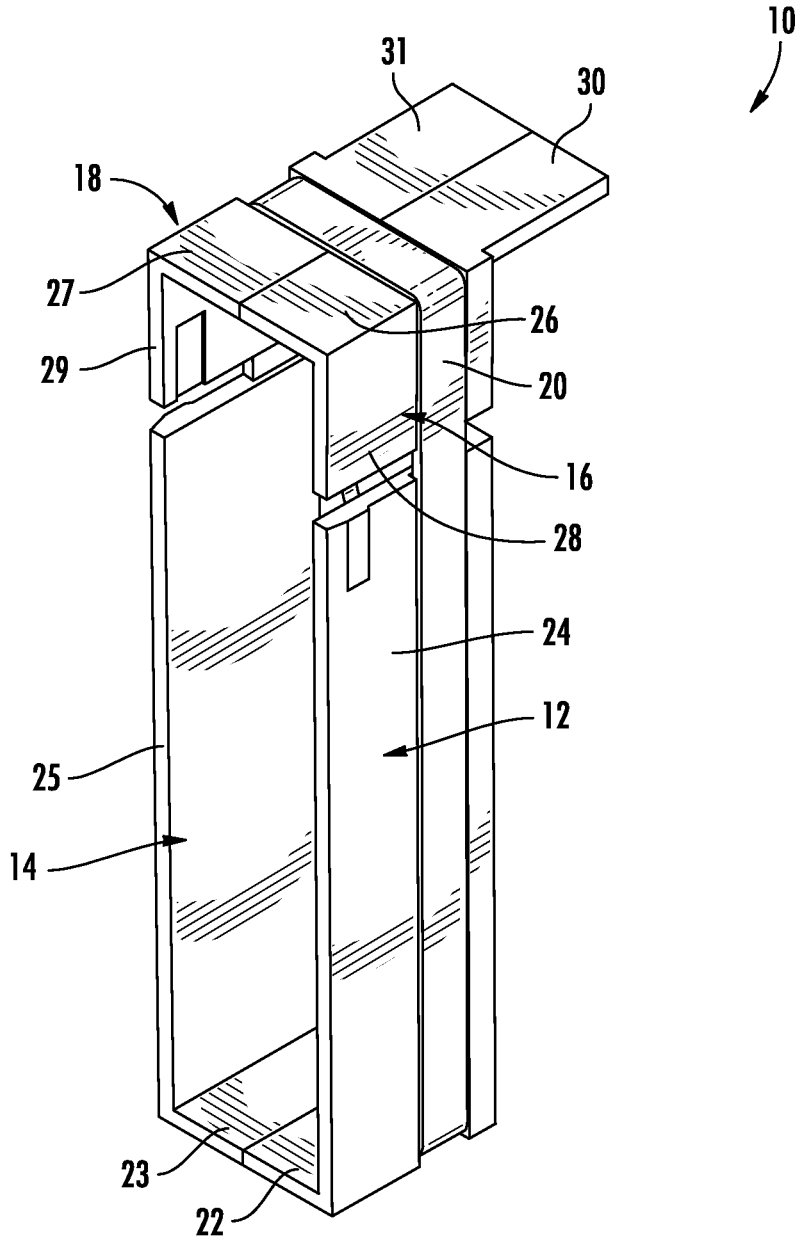
FIG. 1 shows an embodiment of the disclosed adjustable hanger in an initial contracted condition.

Among the benefits and improvements disclosed herein, other objects and advantages of the disclosed embodiments will become apparent from the following wherein like numerals represent like parts throughout the several figures. Detailed embodiments of an expandable hanger for use in securing beams to building support members are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described unless the context clearly dictates otherwise. In addition, throughout the specification, the meaning of "a," "an," and "the" include plural references. The meaning of "in" includes "in" and "on".

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Additionally, the embodiments described herein are done so with primary reference to a preferred embodiment that is a hanger for attaching a joist beam to a rear ledger. However, it is understood that the embodiments are not limited as such, and the inventive concepts present in the disclosed embodiments apply to a wide variety of hangers or brackets for use in attaching elongate building support members or beams to another support member. Herein, the term "joist" is synonymous with and shall encompass a beam or elongate building member of any kind. Likewise, the term "ledger" is synonymous with and shall encompass any building support member or structure to which a beam may be attached. Further, the term "joist hanger" should be understood as a hanger for use with any type of beam, including a joist.

With reference to the drawings wherein like numerals represent like parts throughout the figures, an embodiment of a laterally and vertically adjustable hanger 10 is shown and described. The depicted embodiment of the hanger 10 generally includes four modules (12, 14, 16, 18) and a band 20 circumscribing and holding the modules together in the configuration depicted. A right base module 12 includes a flat right base support 22 and a substantially perpendicular upright right side panel 24. A left base module 14 similarly has a flat left base support 23 and upright left side panel 25. The opposing base support members 22 and 23 lie substantially coplanar and combine to provide a joist support section. The right and left side panels are substantially parallel to one another and spaced from each other in order to accommodate one or more joist boards supported by the joist support section.

The hanger 10 also includes left and right upper modules, 16 and 18. The right upper module 16 has a top panel 26 and a side panel 28, and the left upper module 18 similarly has a top panel 27 and side panel 29. The upper side panels 28 and 29 are preferably coplanar with the lower side panels, 24 and 25, respectively, and the top panels, 26 and 27, are substantially parallel to the base support members, 22 and 23. In this manner, the side panels, top panels and base support members combine to form a rectangular prismic assembly with an open front.

As shown, each of the upper modules, 16 and 18, has a support flange, 30 and 31, extending rearward from the rear edge. In an installation, the support flanges are configured to rest on a top edge of a building ledger L. The modules may also include a portion of an outer notch 32 that extends about the peripheral face of the hanger. As shown, the notch portions in each module outer surfaces combine to form a peripheral notch 32 that is sized and shaped to accommodate the strap 20 that wraps around the hanger. As shown in FIGS. 2-6, the base modules, 12 and 14, also have rear panels, 34 and 35. In the depicted embodiment, the rear panels are inwardly extended such that they will be hidden behind a joist when installed, however, embodiments exist with outwardly extending rear panels.

The separate modules, 12, 14, 16, 18, allow for expandability in the horizontal and vertical dimensions. FIGS. 1, 3, 4 and 7 depict the joist hanger 10 in a contracted configuration with the inner edges of the right modules, 12 and 16, interfaced with the inner edges of the left modules, 14 and 18. These Figures show a slight gap between the lower modules, 12 and 14, and the upper modules, 16 and 18, however, the respective upper and lower edges may interface with one another.

Figure 2:
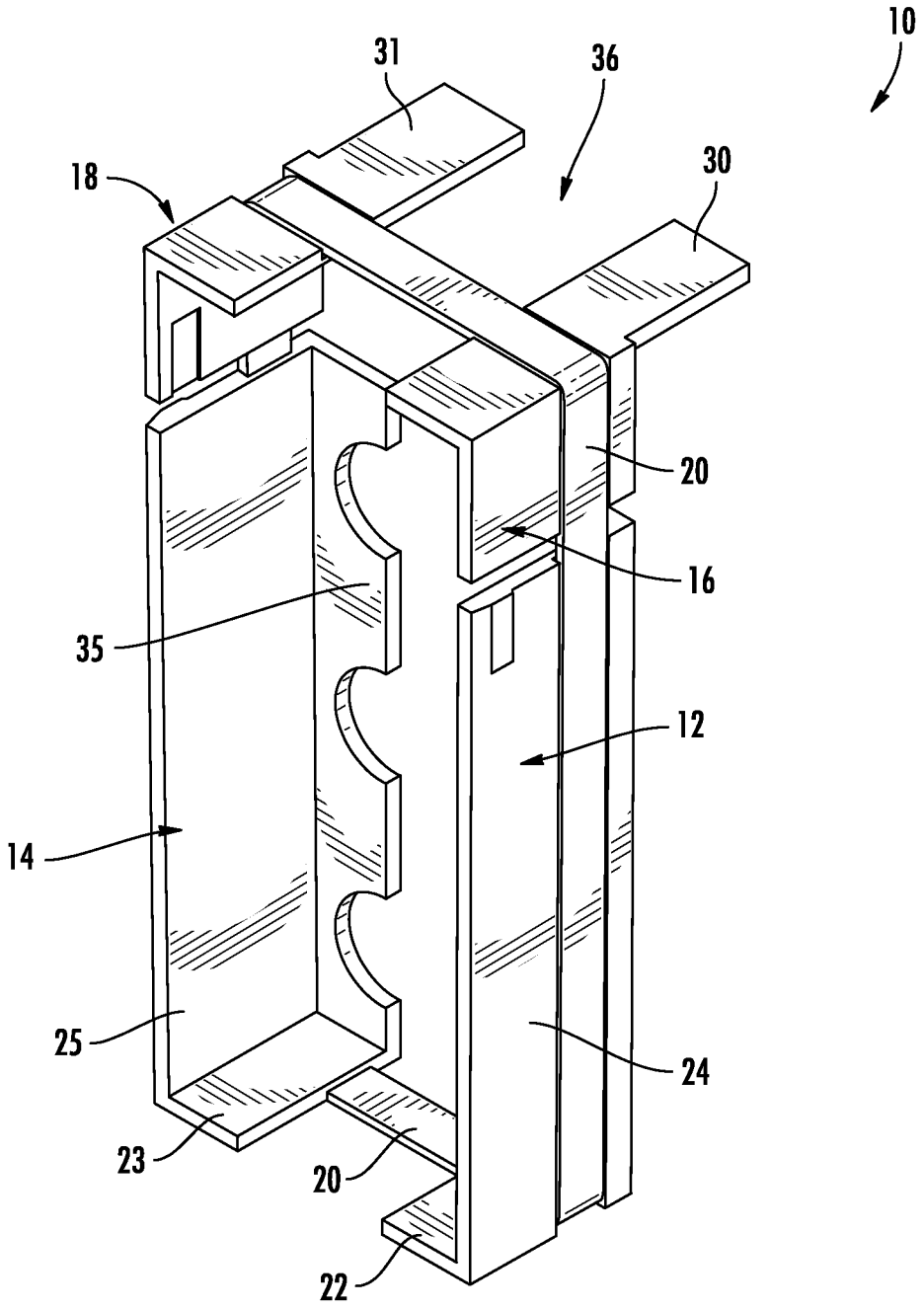
FIG. 2 shows the hanger of FIG. 1 in an expanded condition.
Figure 3:
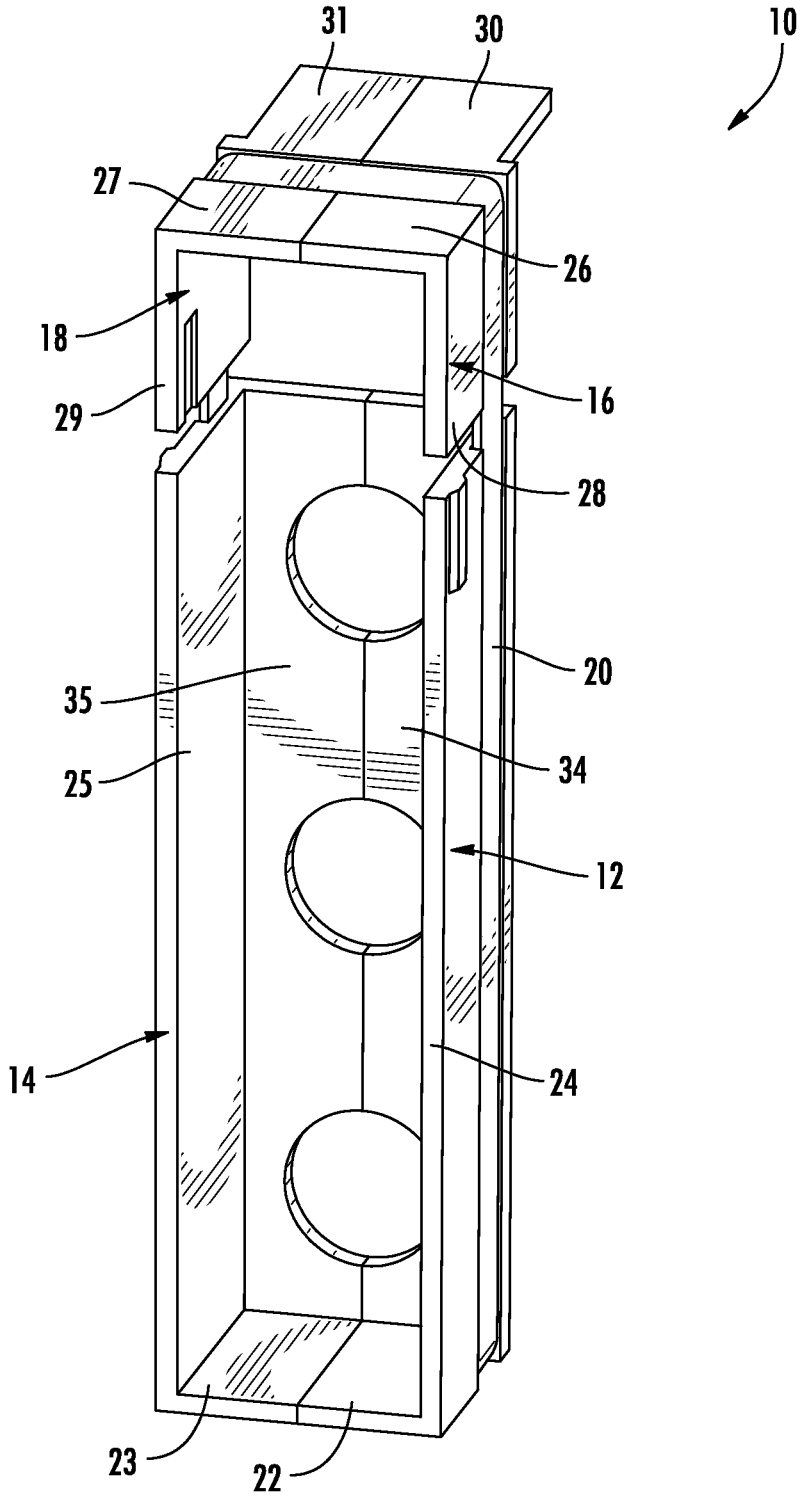
FIG. 3 shows the hanger of FIG. 1 from an alternate view.
Figure 4:
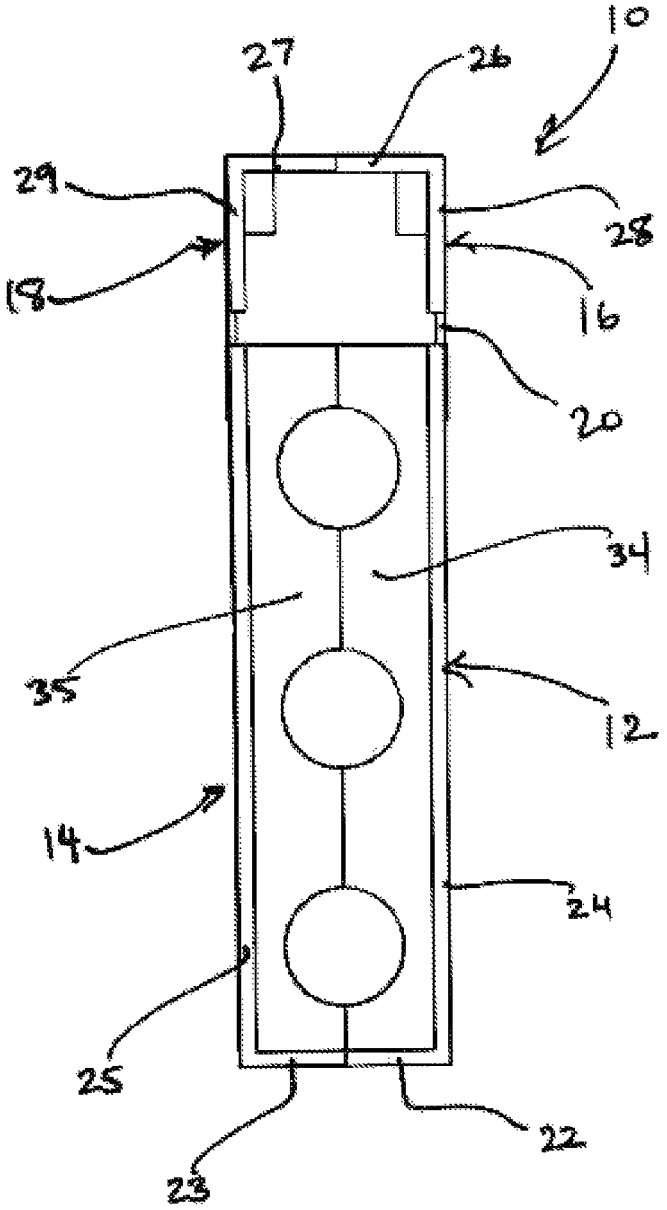
FIG. 4 is a front elevation view of the hanger of FIG. 1.
Figure 5:
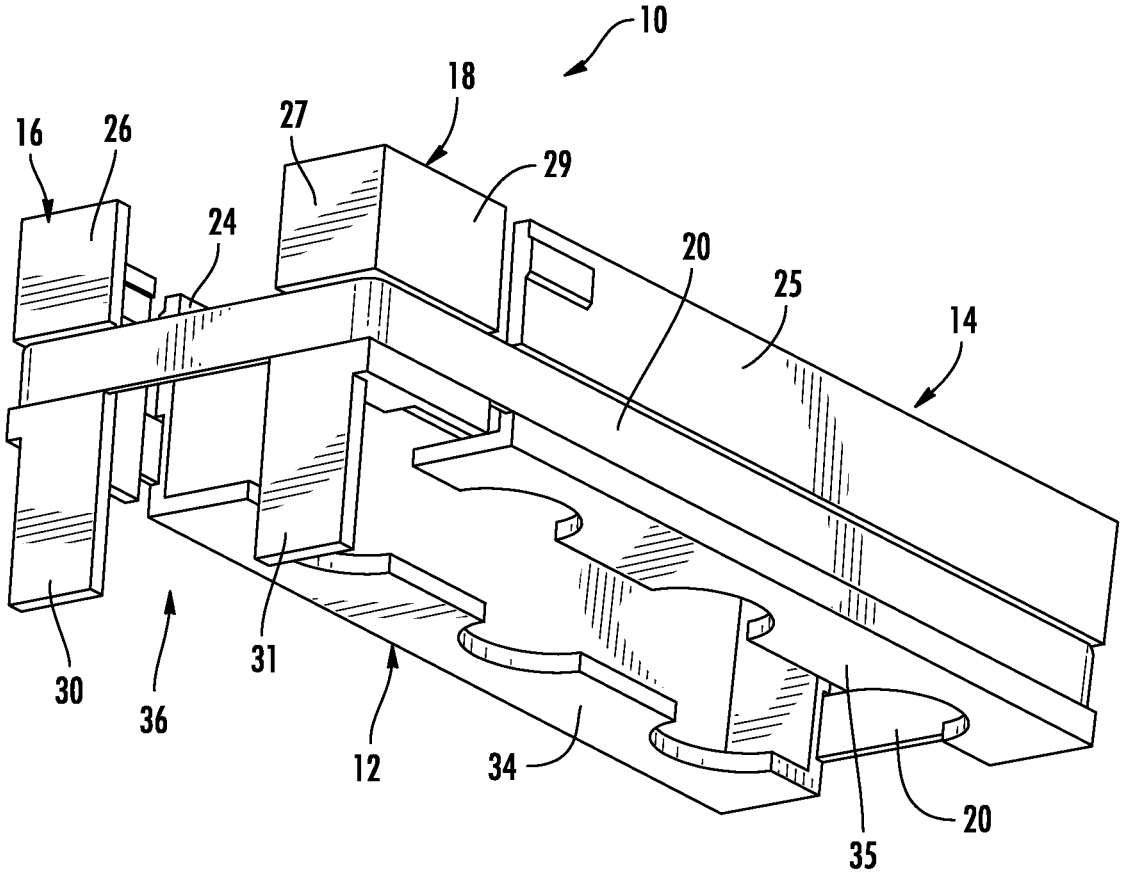
FIG. 5 shows a perspective view of the disclosed hanger in the expanded condition from the top rear.
Figure 6:
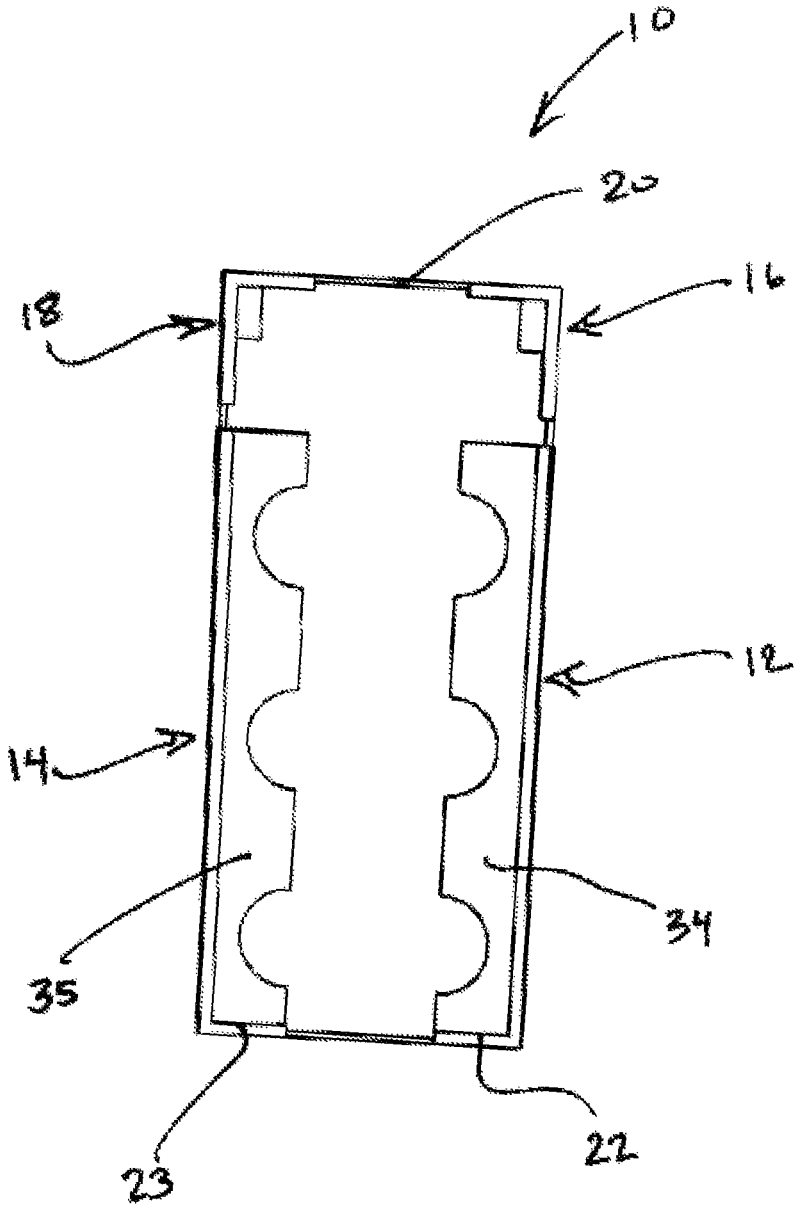
FIG. 6 is a front elevation view of the hanger in the expanded condition.
Figure 7:
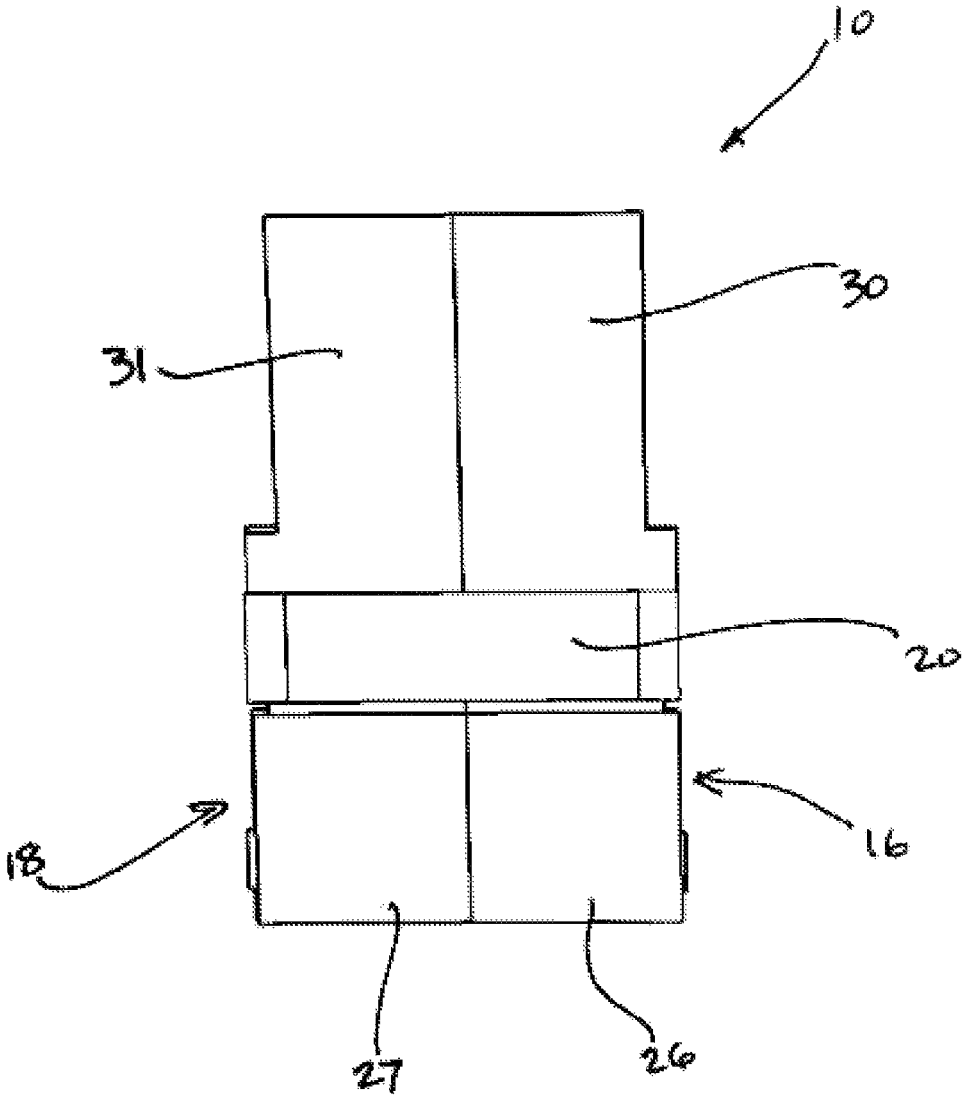
FIG. 7 is a top elevation view of the hanger of FIG. 1.
Figure 8:
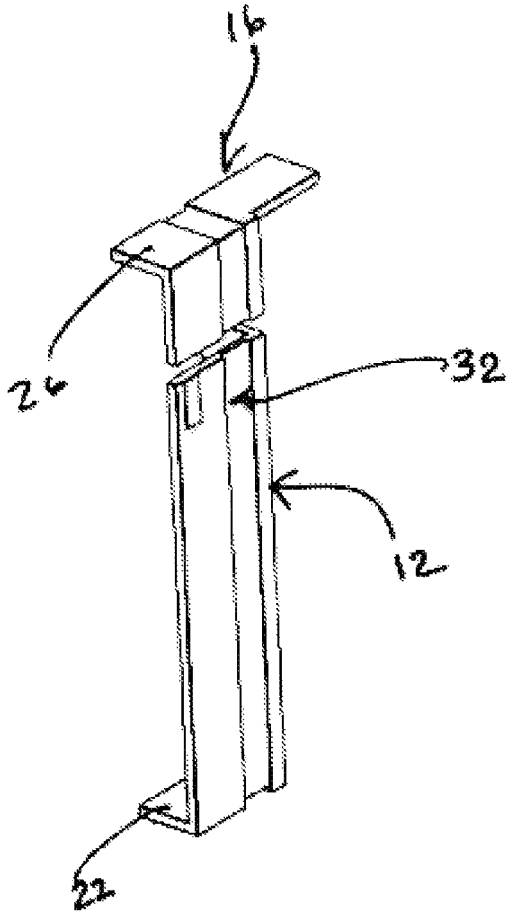
FIG. 8 shows two modules of the disclosed hanger with strap removed.

FIGS. 2, 5 and 6 show the same joist hanger 10 in a laterally expanded configuration with the right modules, 12 and 16, spaced further from the left modules, 14 and 18. As can be seen, a distinct spacing gap 36 exists between the right modules and left modules over which with the strap 20 extends, holding the hanger 10 together.

In a preferred embodiment, the strap 20 is a high strength elastic band capable of withstanding significant stretching. The strap 20 being wrapped around the outer side surfaces of the modules biases the modules inward toward the contracted position.

Figure 9:
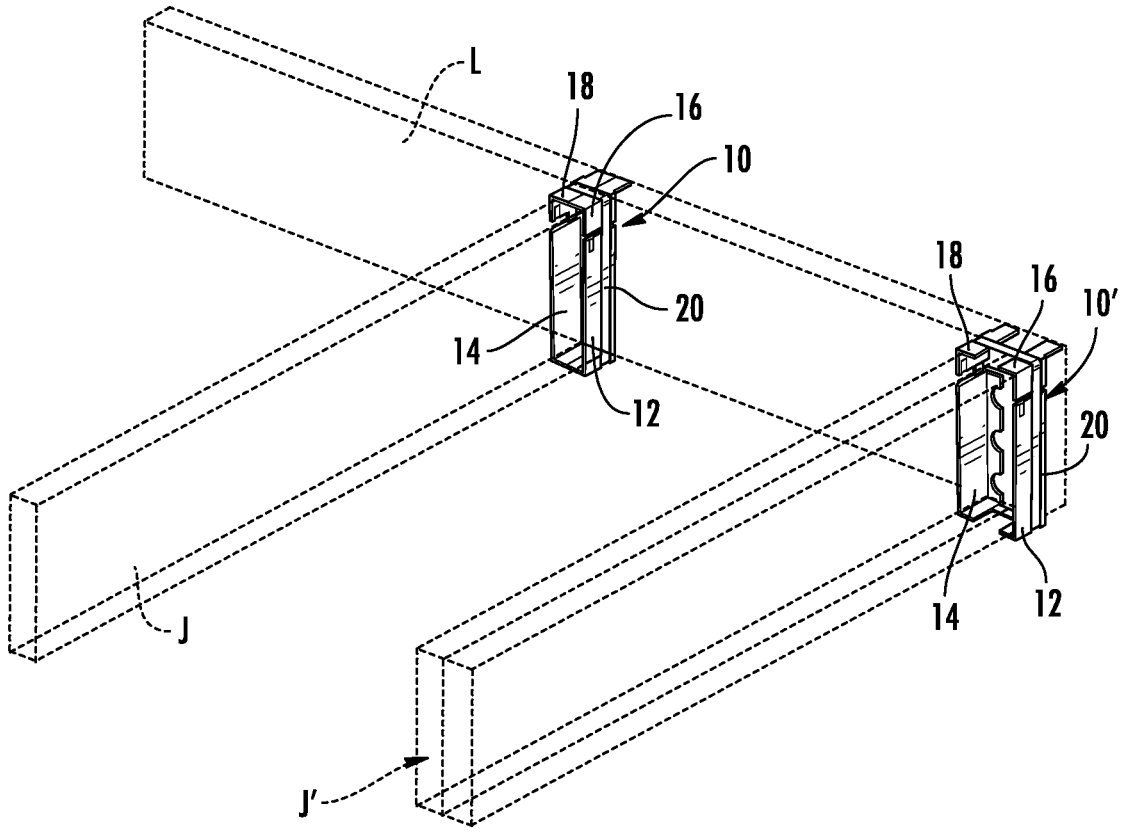
FIG. 9 shows a building support connection employing the hanger in a contracted condition and a hanger in the expanded condition.
Figure 10:
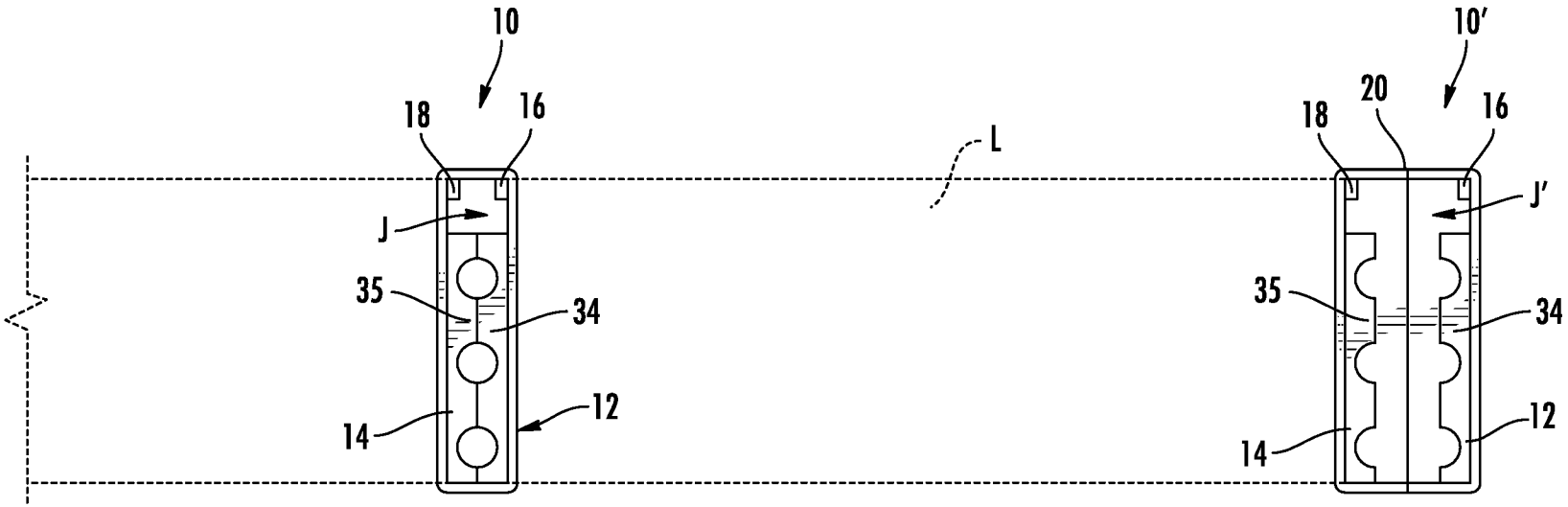
FIG. 10 is front end elevation view of the building support connection of FIG. 9.
Figure 11:
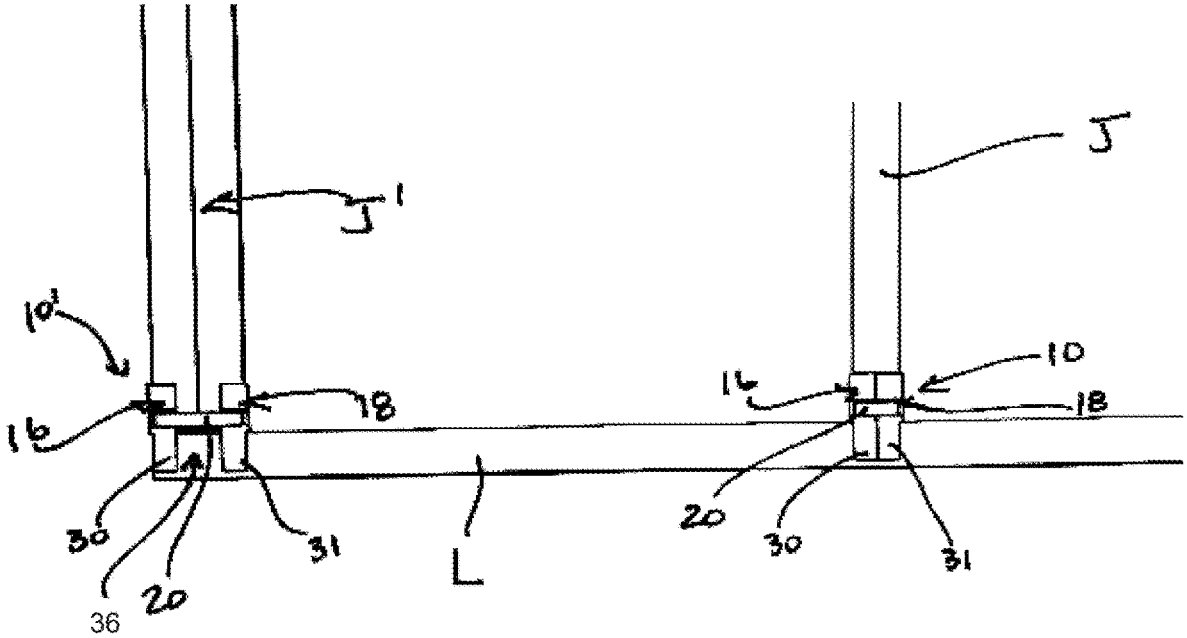
FIG. 11 is a top elevation view of the building support connection of FIG. 9.

FIGS. 9-11 are illustrative of the adjustability of the hanger 10. FIGS. 9-11 depict a representative deck substructure with a single joist J attached via a hanger 10 in a contracted configuration (i.e., FIG. 1 configuration) and double joist J' attached via an identical type of hanger 10 in an expanded configuration (i.e., FIG. 2 configuration). In a typical installation, the joist hanger 10 is positioned with the rear support flanges 30 and 31 on the top edge of the ledger L with the base modules 12 and 14 in front of the ledger hanging downward. The rear panels 34 and 35 abut the front surface of the ledger L. The support flanges 30 and 31, and the rear panels 34 and 35 often include holes for receipt of fasteners and/or teeth for penetrating the surface of the ledger L to enhance robustness of attachment.

FIGS. 12-19 show another embodiment of the disclosed hanger 100. This embodiment is substantially similar in many ways to the embodiment disclosed above as reference numeral 10. The most significant departure is that instead of a single large band 20 that circumscribes the entire hanger (all four modules 12, 14, 16, 18), this hanger 100 includes separate band segments 120, 121, 140, 141. Each of the band segments is embedded within and extends between adjacent modules, 112, 114, 116, 118. In a preferred embodiment, each of the modules is formed of a molded polymeric material with an end of one lateral band segment, 140 or 141, and an end of one vertical band segment, 120 or 121, embedded in the molded material. Additional attachment techniques may be employed, such as looping a portion of the band or other mechanical techniques like fasteners or anchors. In another embodiment, ends of the bands may be welded to the modules.

Figure 12:
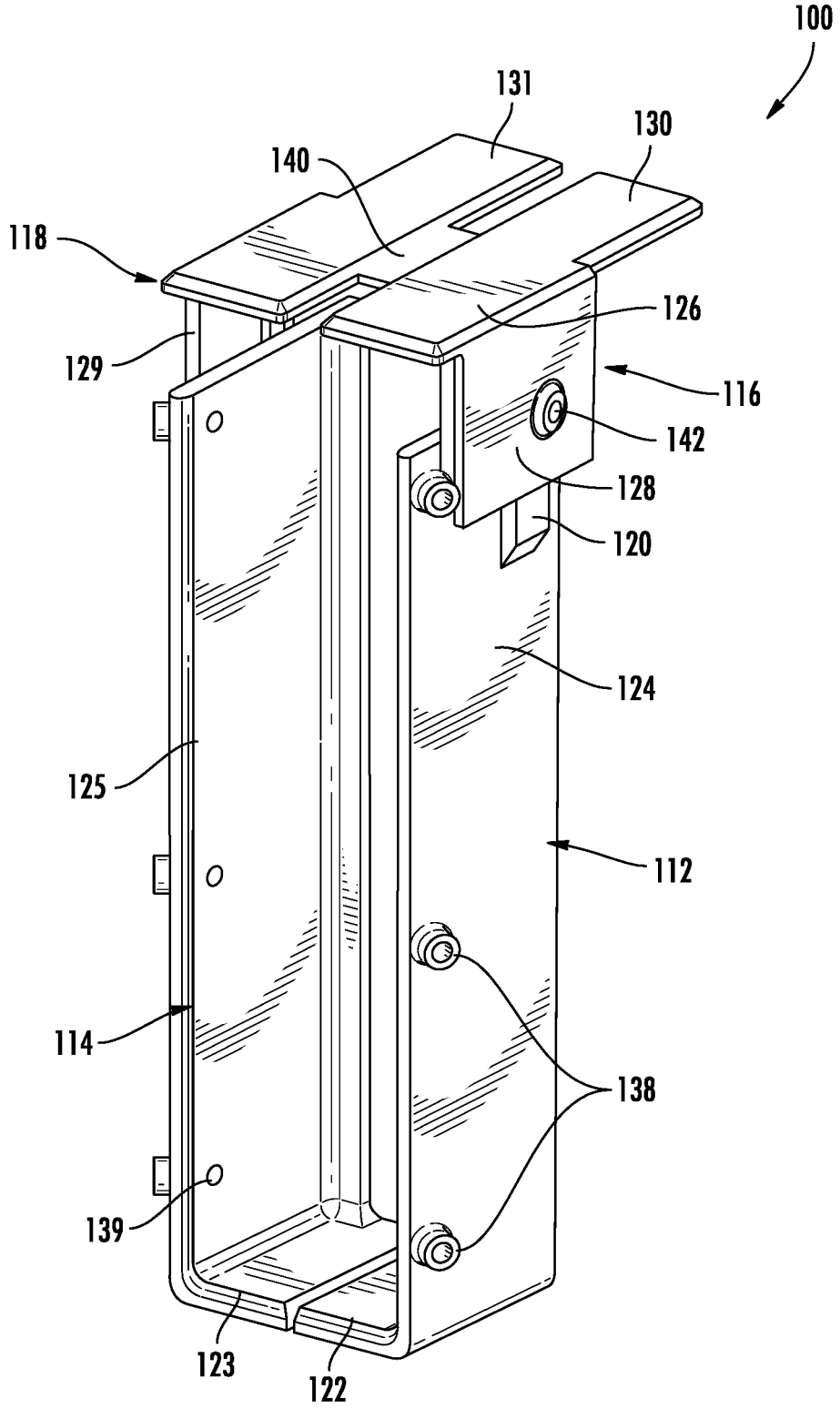
FIG. 12 shows another embodiment of the disclosed expandable hanger in an initial contracted condition.
Figure 13:
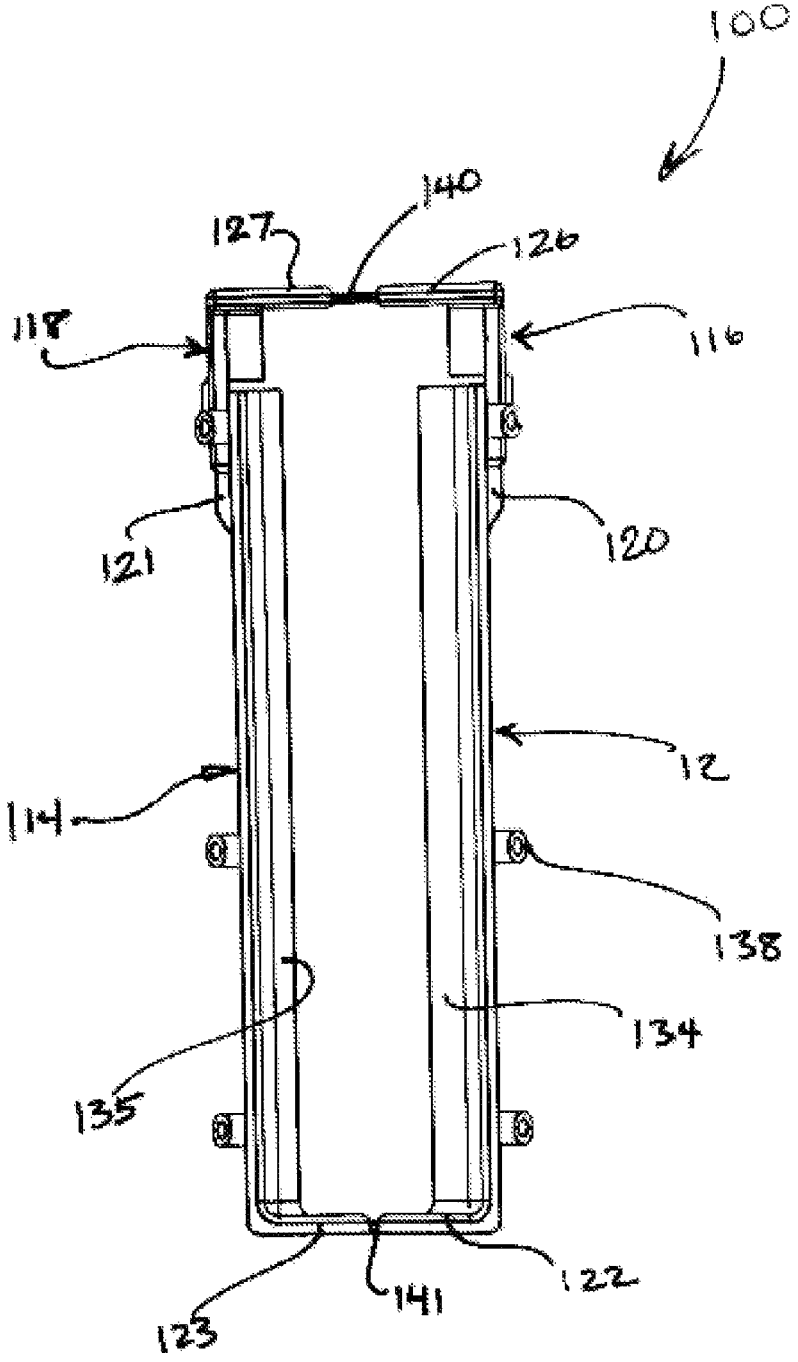
FIG. 13 is a front elevation view of the hanger of FIG. 12.

Like the earlier embodiment, the joist hanger 100 is independently expandable in both a lateral (horizontal) direction and longitudinal (vertical) direction. FIGS. 12 and 13 show the hanger 100 in its collapsed position for accommodating a single joist beam having a moderate height.

Figure 14:
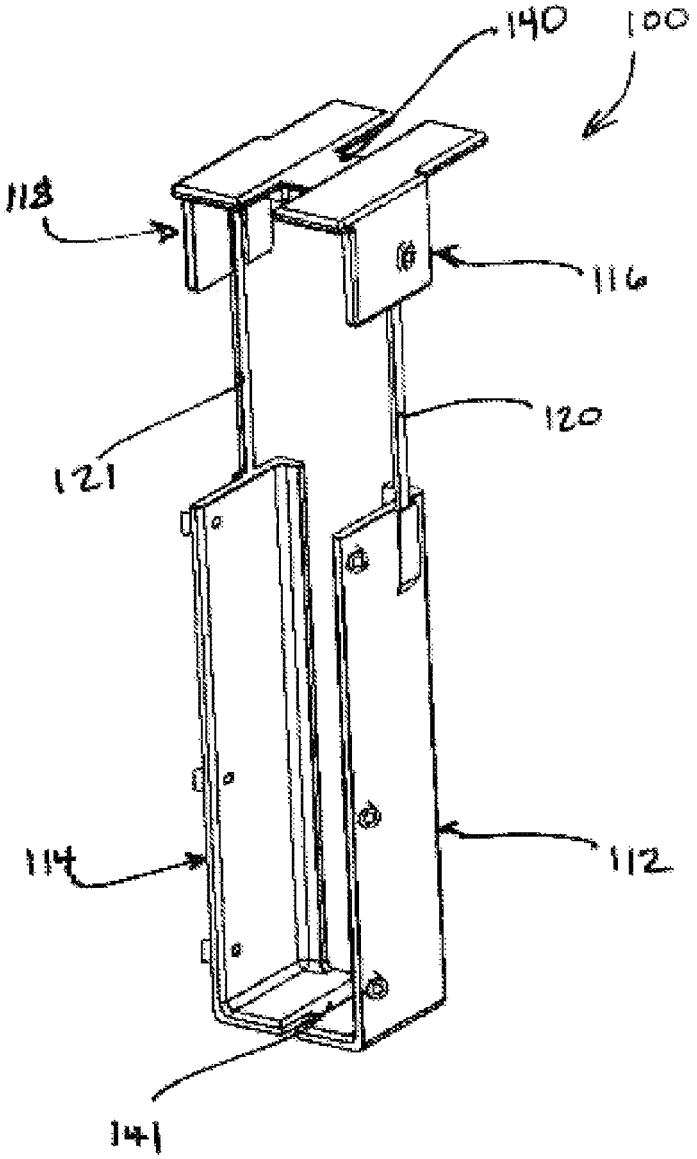
FIG. 14 shows the hanger of FIGS. 12 and 13 in a vertically expanded condition.
Figure 15:
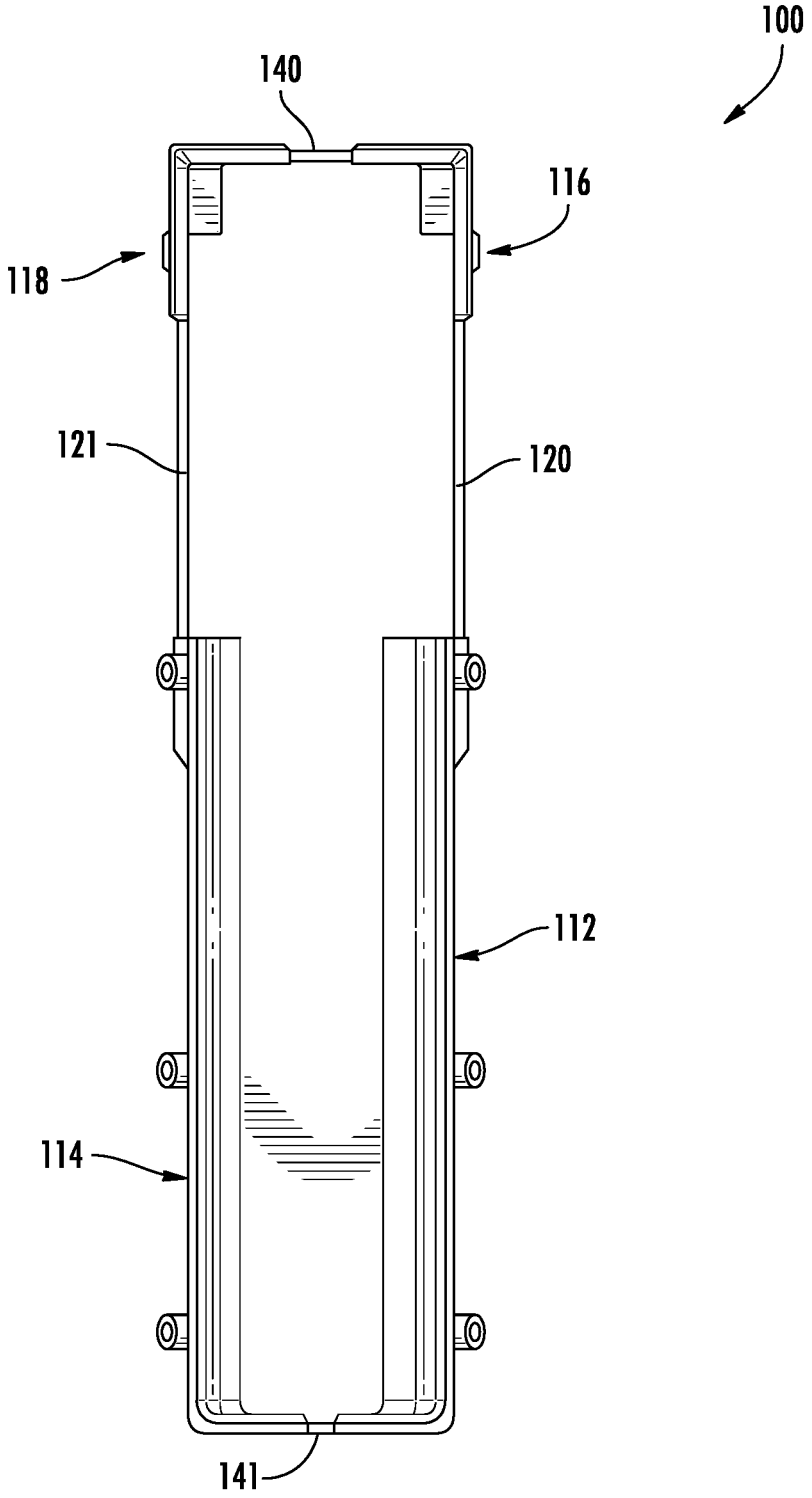
FIG. 15 is a front elevation view of the vertically extended hanger of FIG. 14.
Figure 16:
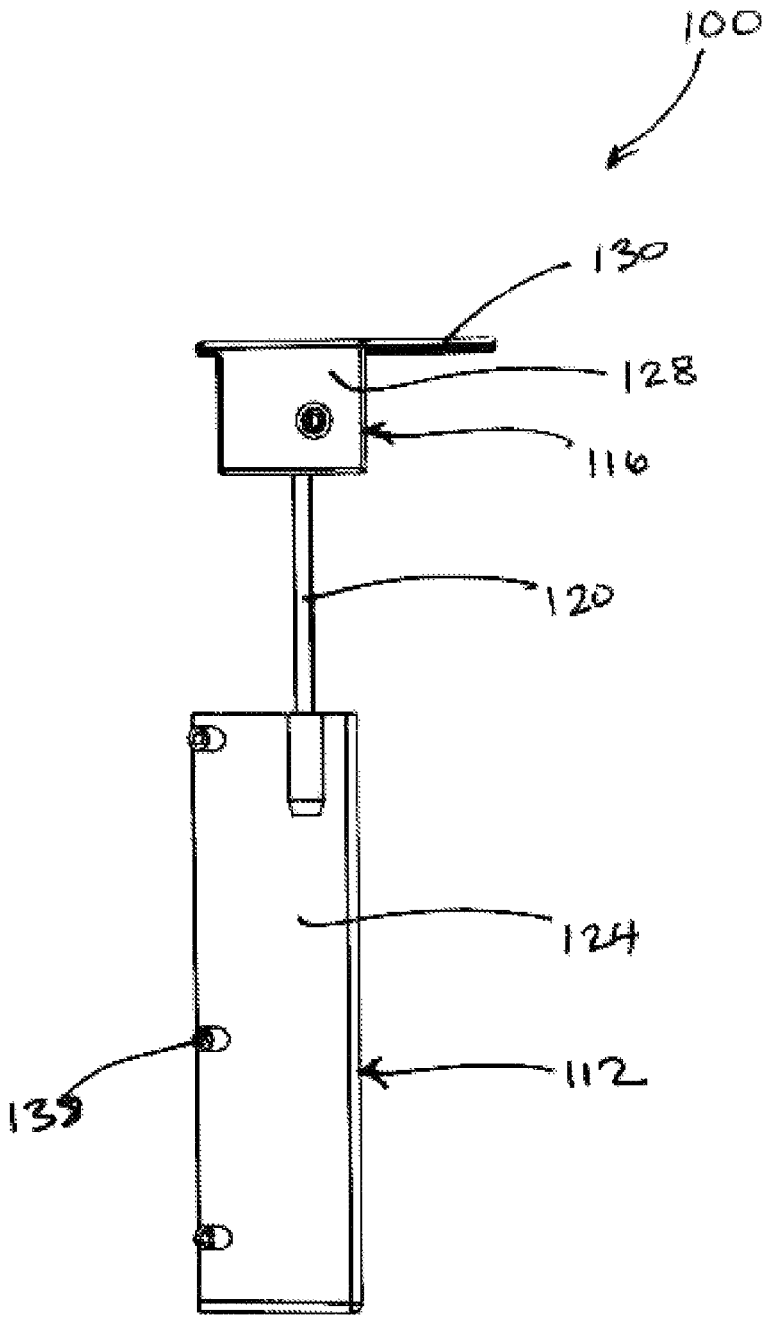
FIG. 16 is a side elevation view of the vertically extended hanger of FIG. 14.

FIGS. 14-16 show the hanger 100 expanded vertically for accommodating a single joist beam having a greater height dimension. As can be seen, the opposite side band segments, 120 and 121, are stretched, with the upper hanger modules, 116 and 118, separated and spaced from the lower modules, 112 and 114. In FIGS. 14-16, the lateral band segments, 140 and 141, are substantially unchanged relative to the condition of FIGS. 12 and 13.

Figure 17:
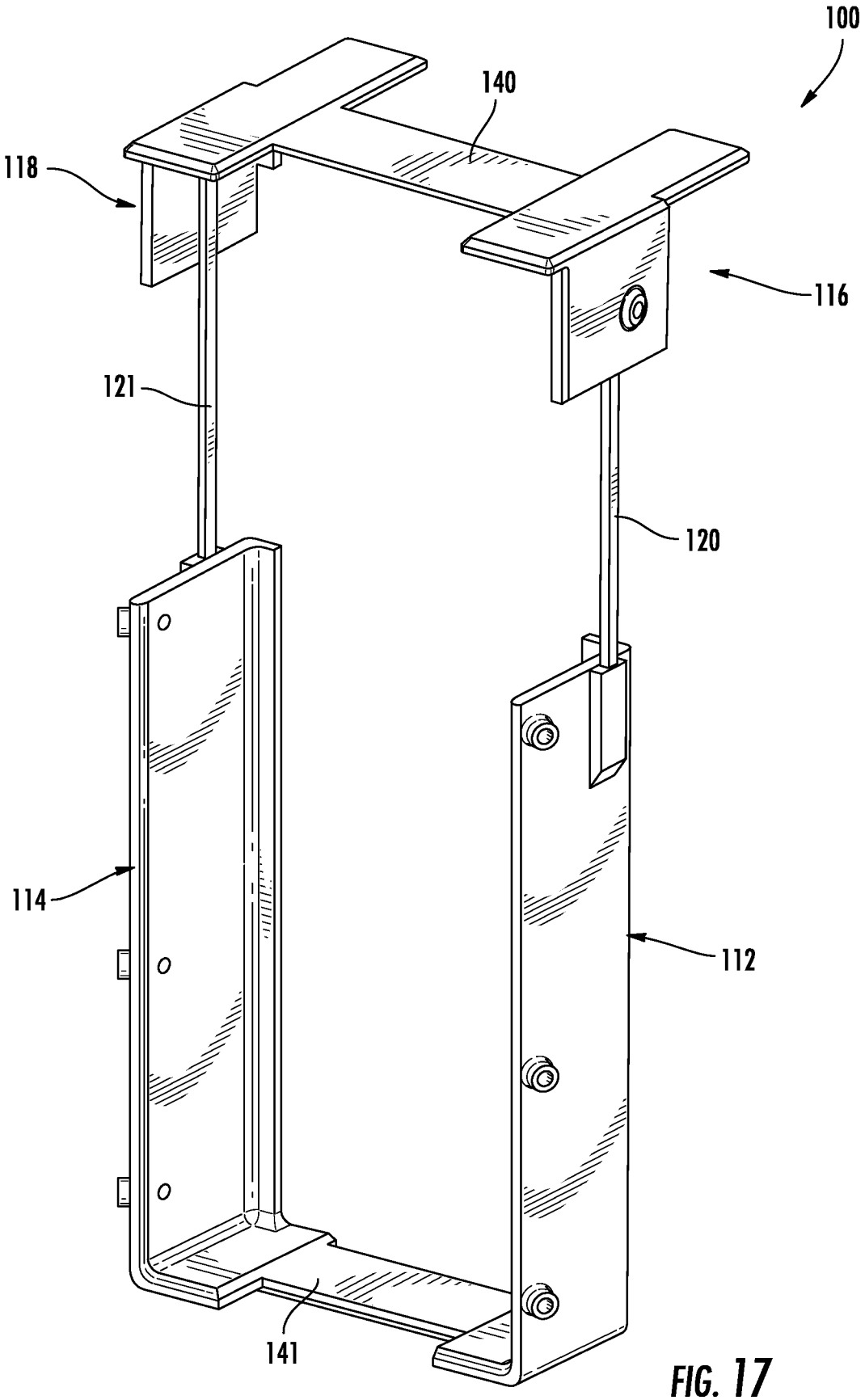
FIG. 17 shows the hanger of FIGS. 12-16 in a vertically and laterally expanded condition.
Figure 18:
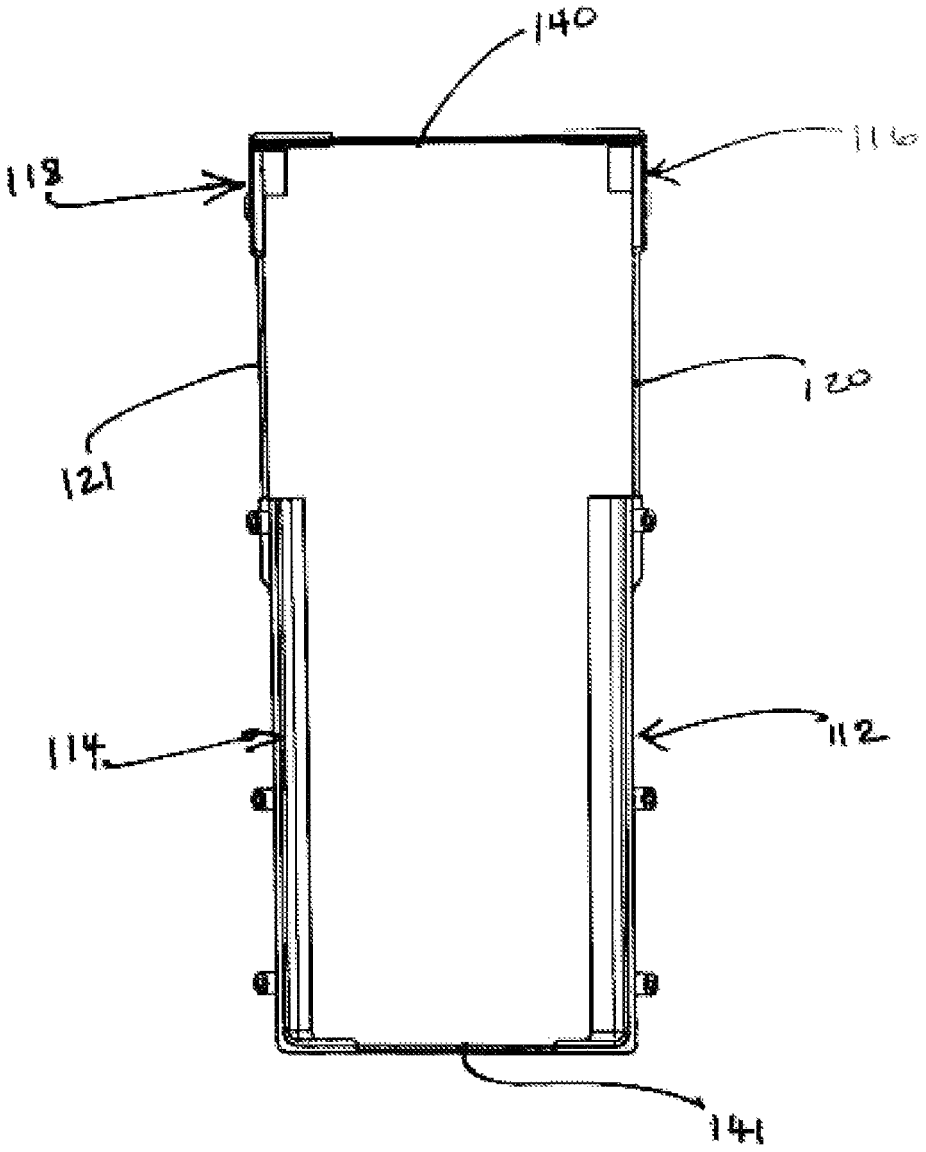
FIG. 18 is a front elevation view of the hanger of FIG. 17.
Figure 19:
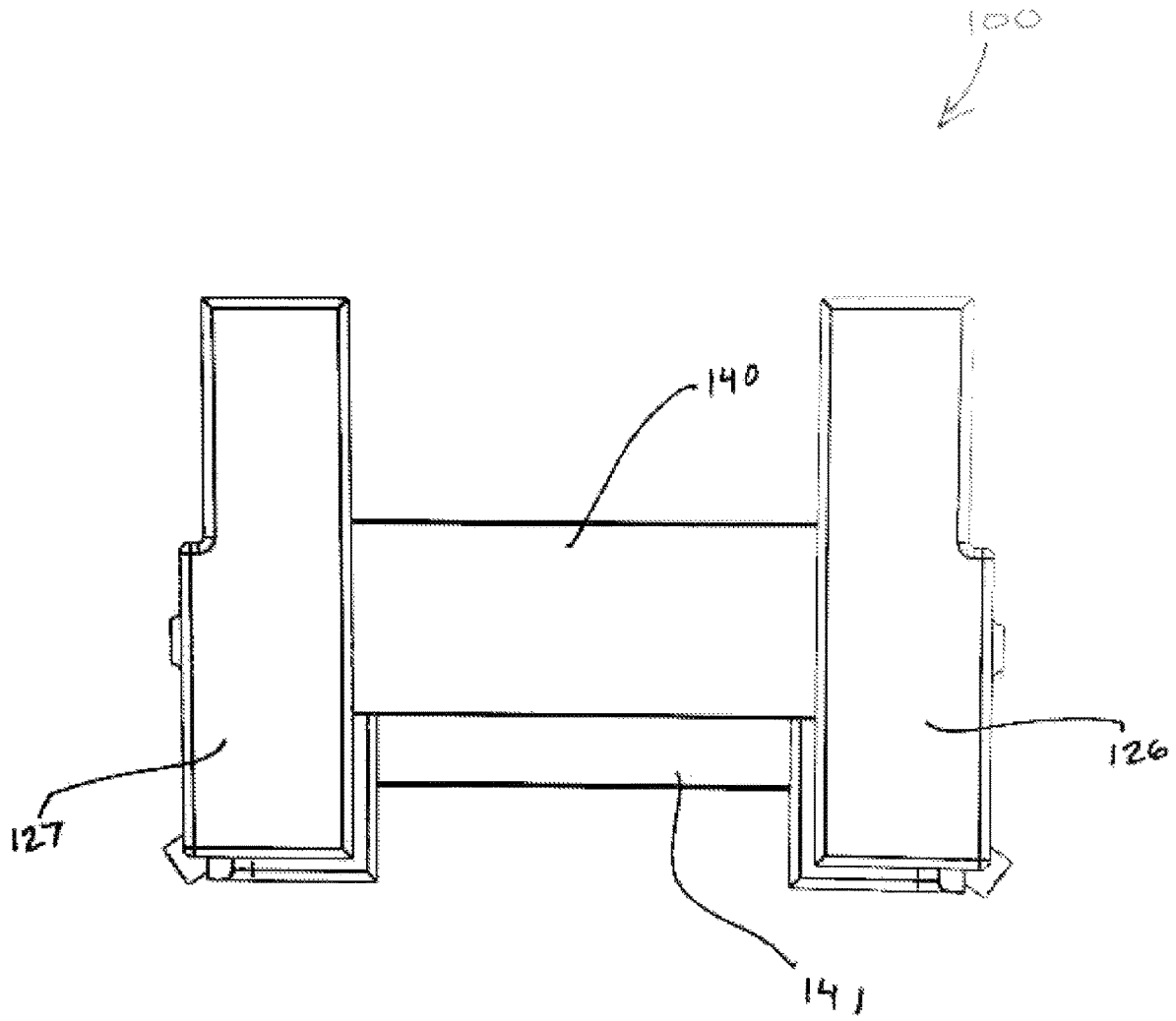
FIG. 19 is a top elevation view of the hanger of FIG. 17.

FIGS. 17-19 show the hanger 100 expanded both laterally and vertically for accommodating a thicker (double) joist beam having a greater height dimension. As shown, both the vertical band segments, 120 and 121, and the lateral band segments, 140 and 141, are stretched. This allows the right modules, 112 and 116, to separate from the left modules, 114 and 118, as well as the upper modules, 116 and 118, to separate from the lower modules, 112 and 114.

The joist hanger 100 is installed substantially identically to the hanger 10 with the rear support flanges, 130 and 131, supported on the top edge of the ledger board to ensure that the hanger 100 and the joist are level. Once the joist is in the preferred attachment position, fasteners are driven into the toenail holes, 138 and 139, in opposite sides of the hanger 100. The toenail holes are angled and positioned to guide the fasteners in a desired path through the joist and into the ledger to form a robust toenail connection and comply with code requirements.

Also shown in FIG. 12 is a side hole 142 in the upper modules 116 and 118. An offset raised surface may circumscribe the side holes 142, as depicted, and/or any other holes in the hanger that receive fasteners. The offset raised surface is configured to assist alignment of a driving tool by providing an abutment surface for the nose of the tool. Additionally, the offset raised surfaces act to retain integrity of the side panels, 128 and 129, after driving of a fastener, in that the raised portion helps protect against deformation under pressure from a driven fastener so that the hanger maintains structural integrity. Fasteners may be driven into the side holes to improve the attachment integrity between the hanger and joist.

The remaining elements of the hanger 100 identified with numerals in FIGS. 12-19 are substantially the same as elements within the hanger 10. Similar elements are identified with like reference numerals with a leading "1" in this embodiment.

FIGS. 20-32B depict another embodiment of the expandable joist hanger 200. This embodiment of the joist hanger shares many general elements and relationships with the embodiments disclosed above. The hanger 200 generally includes a lower module 212 and an upper module 214 with a biasing strap 216 circumscribing the respective outer faces. Here, the lower and upper modules, 212 and 214, are engaged with one another in a slidable relationship. The hanger 200 departs from the hanger embodiments depicted as reference numerals 10 and 100 in that this embodiment is only configured to expand and contract longitudinally (vertically)—not laterally.

As shown, the lower module 212 comprises a right panel 218 and a substantially parallel left panel 219 spaced laterally from the right panel with the respective panels connected via a lower web 220 with a top surface that is flat and substantially perpendicular to the side panels. The upper module 214 similarly includes a right panel 222 laterally spaced from a left panel 223 with a top panel 224 extending therebetween. The top panel 224 also includes a rear support flange 226 configured to rest on the top edge of a ledger L to assist in installing a joist J at a level angle.

In this embodiment, each of the right and left panels 218/219 of the lower module 212 defines at least one vertical track defined by a slot 230 with a relatively wider upper portion 232 and a relatively narrower portion 234 extending downward therefrom. Each slot 230 defines a track for receiving inwardly extending guides or projections 234 from the side panels 222/223 of the upper module 214. As can be seen most clearly in FIGS. 24A and 24B, engagement between the upper and lower modules, 212 and 214, is accomplished via inserting the guides 234 through the enlarged upper portions 232 of the slots 230 and then sliding the upper module 214 downward such that the guides 234 are trapped inwardly via the narrower slot portions 234. Preferably, the inner lateral clearance of the upper module 214 is slightly narrower than the lateral distance between the outer surfaces in the lower module 212 in the lateral direction such that the upper side panels 222 and 223 are flexed slightly outward to attach the modules, resulting in an inward return flexion of the upper (and outer) side panels 222/223 against the lower (inner) side panels 218/219. This configuration adds stability and a level of rigidity to the hanger 200 when assembled.

Other embodiments exist wherein the relative location of the slots 230 and guides 234 are reversed, i.e., slots in the upper module 214 that receive guides in lower module 212. Additionally, various specific shapes and characteristics of the elements that interact to form a sliding engagement between the upper and lower modules are possible without departing from the inventive spirit of the disclosed embodiments of the adjustable hanger.

Figure 20:
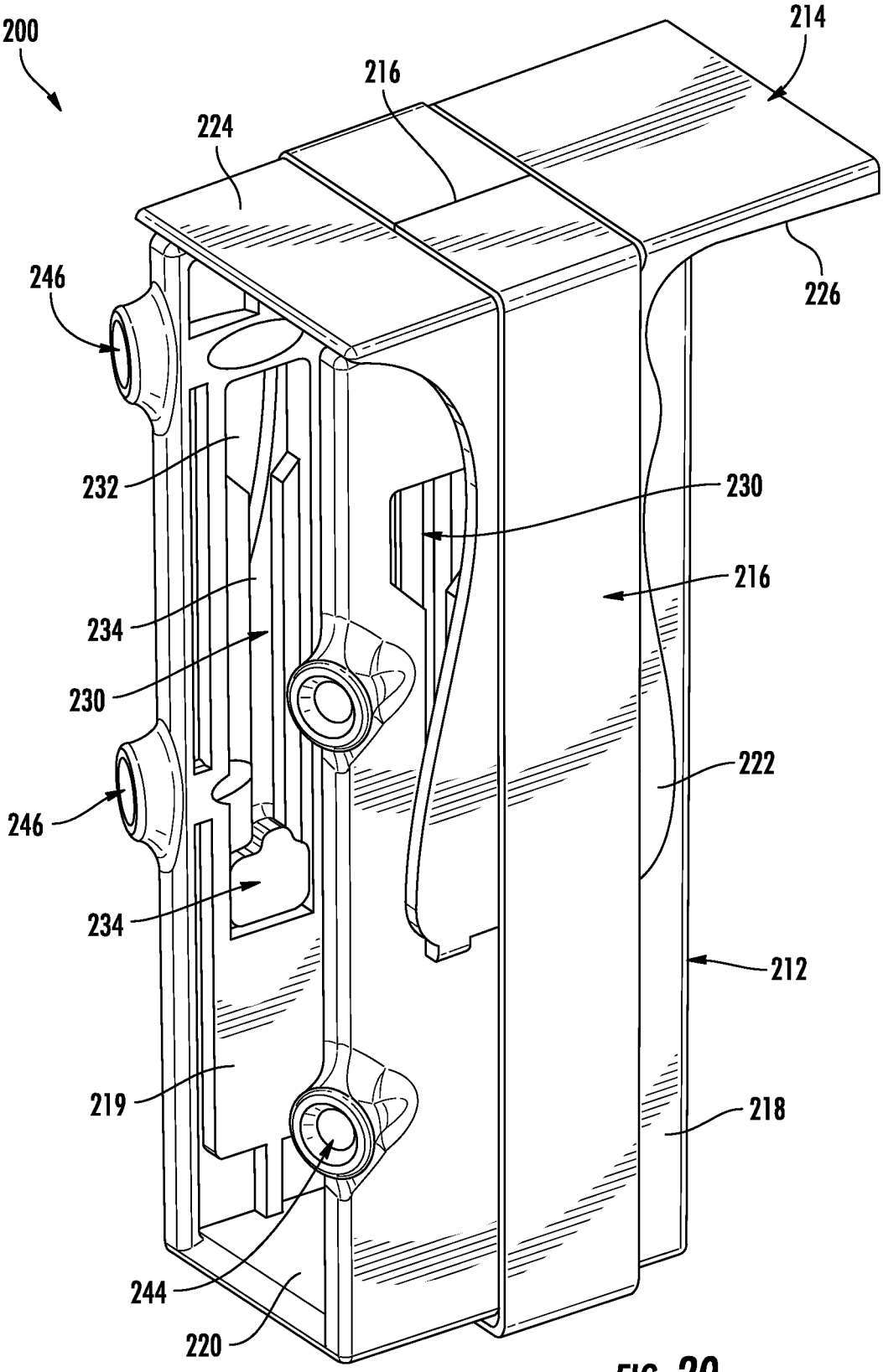
FIG. 20 is a front perspective view of another embodiment of an expandable hanger.
Figure 21:
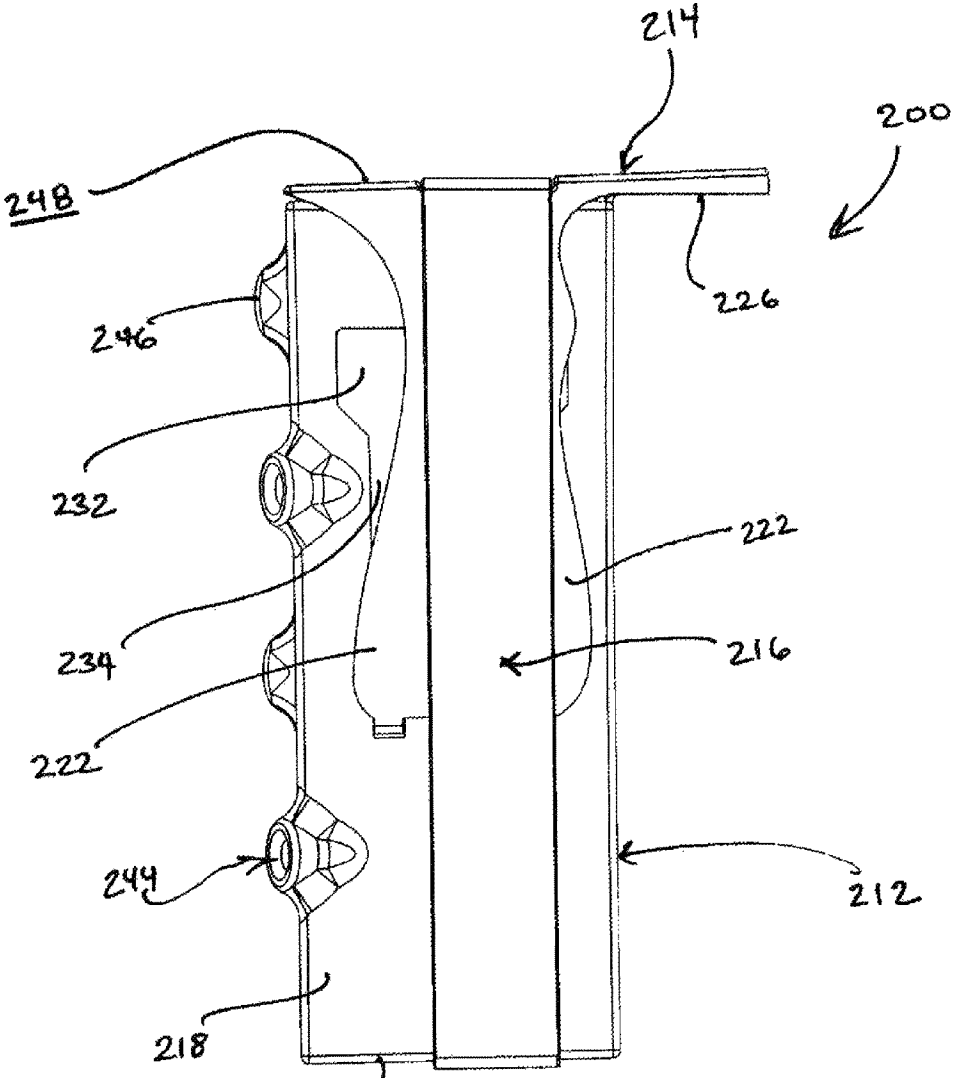
FIG. 21 is a side elevation view of the hanger of FIG. 20.
Figure 22:
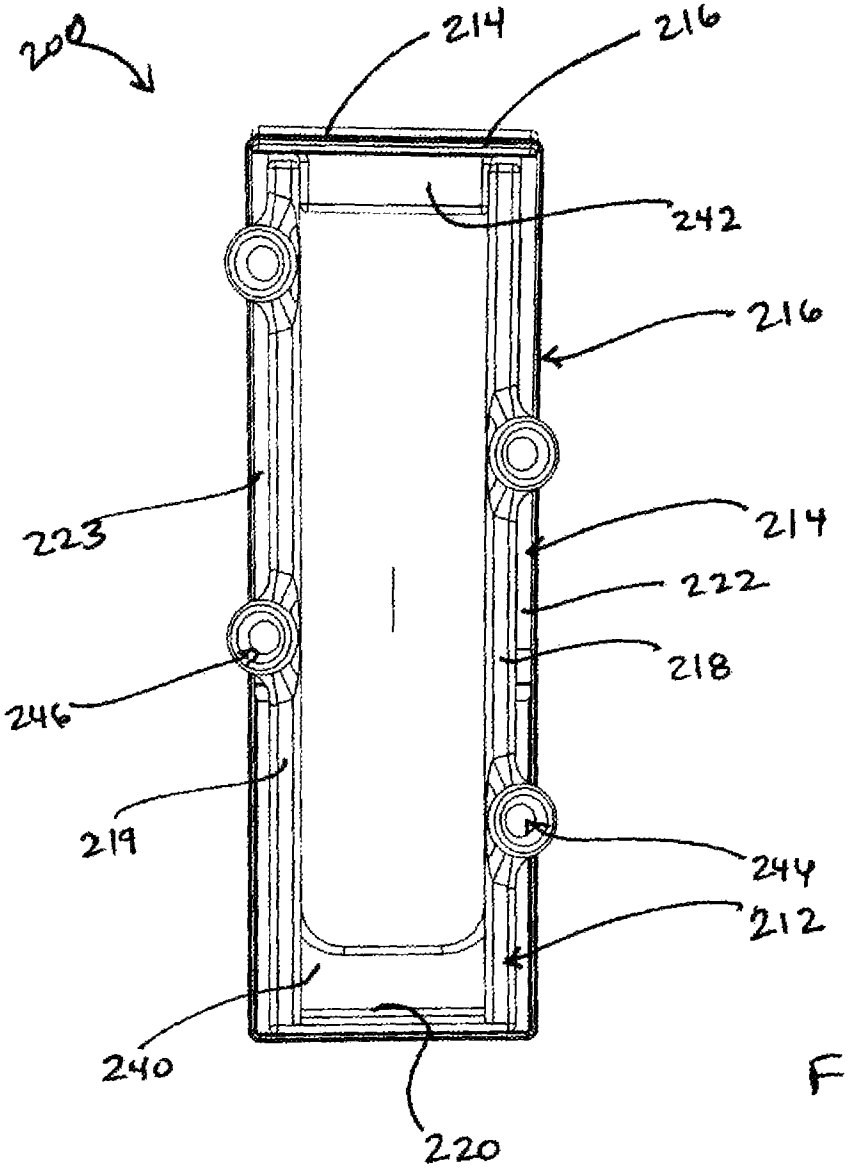
FIG. 22 is a front elevation view of the hanger of FIG. 20.
Figure 23:
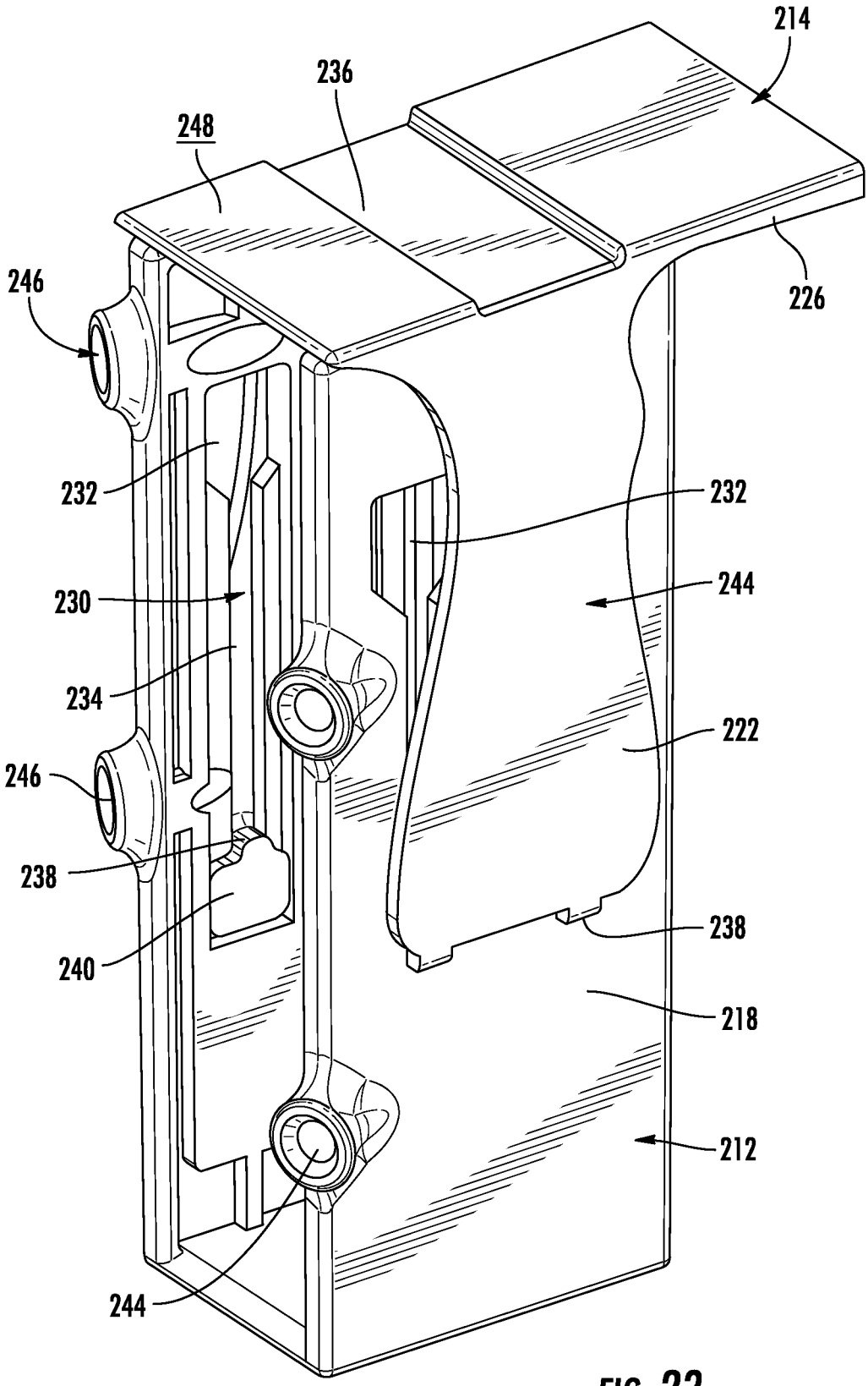
FIG. 23 shows the upper and lower module of the hanger with compression band removed.
Figure 24A:
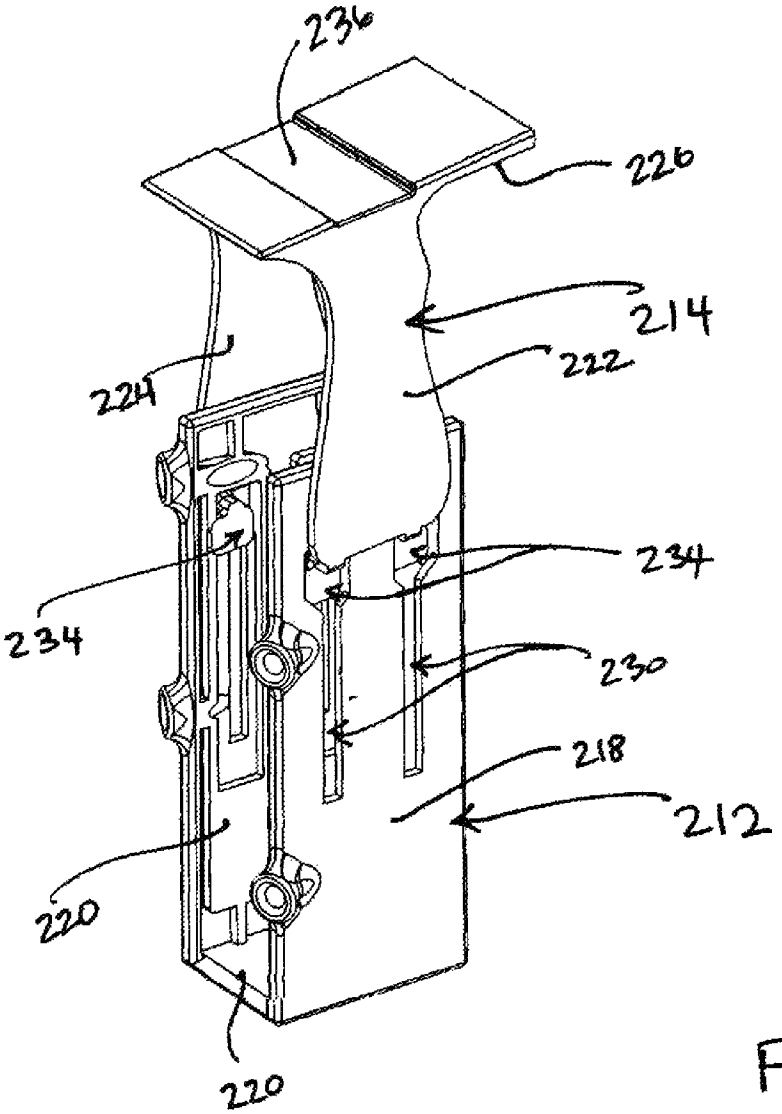
FIGS. 24A and 24B show a first step of an assembly of the hanger of FIG. 20.
Figure 24B:
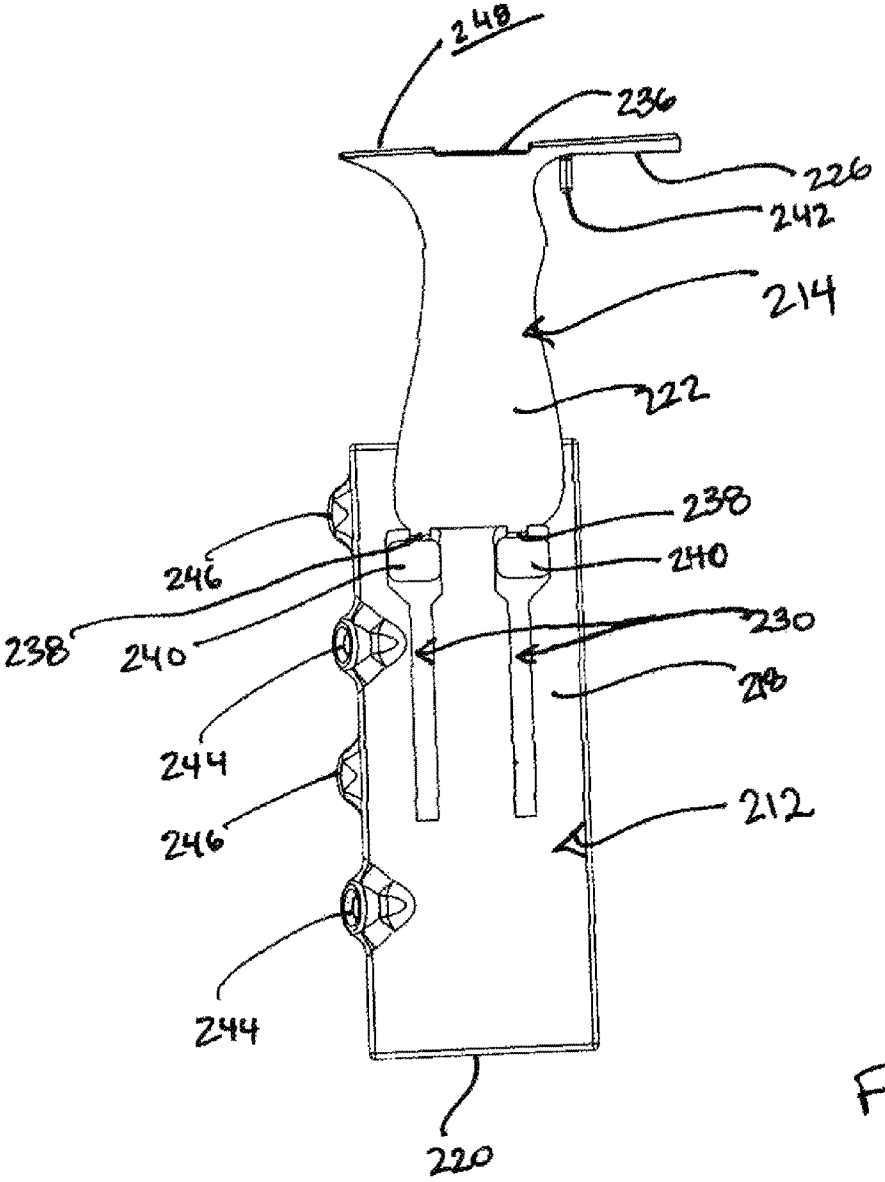
Figure 25:
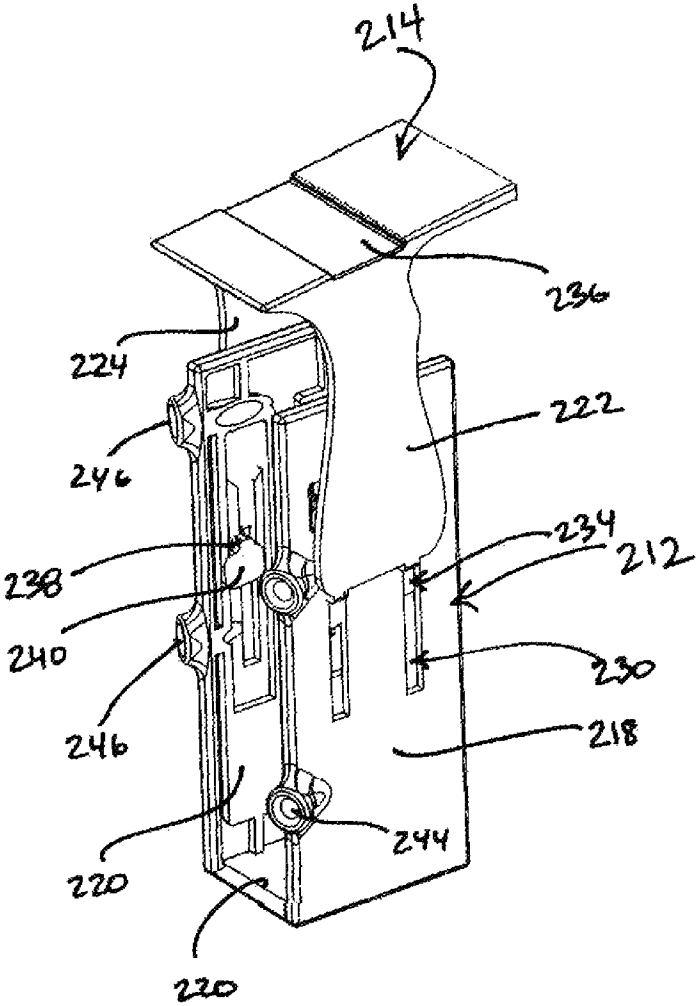
FIGS. 25-27 show the hanger in an intermediate height position.
Figure 26:
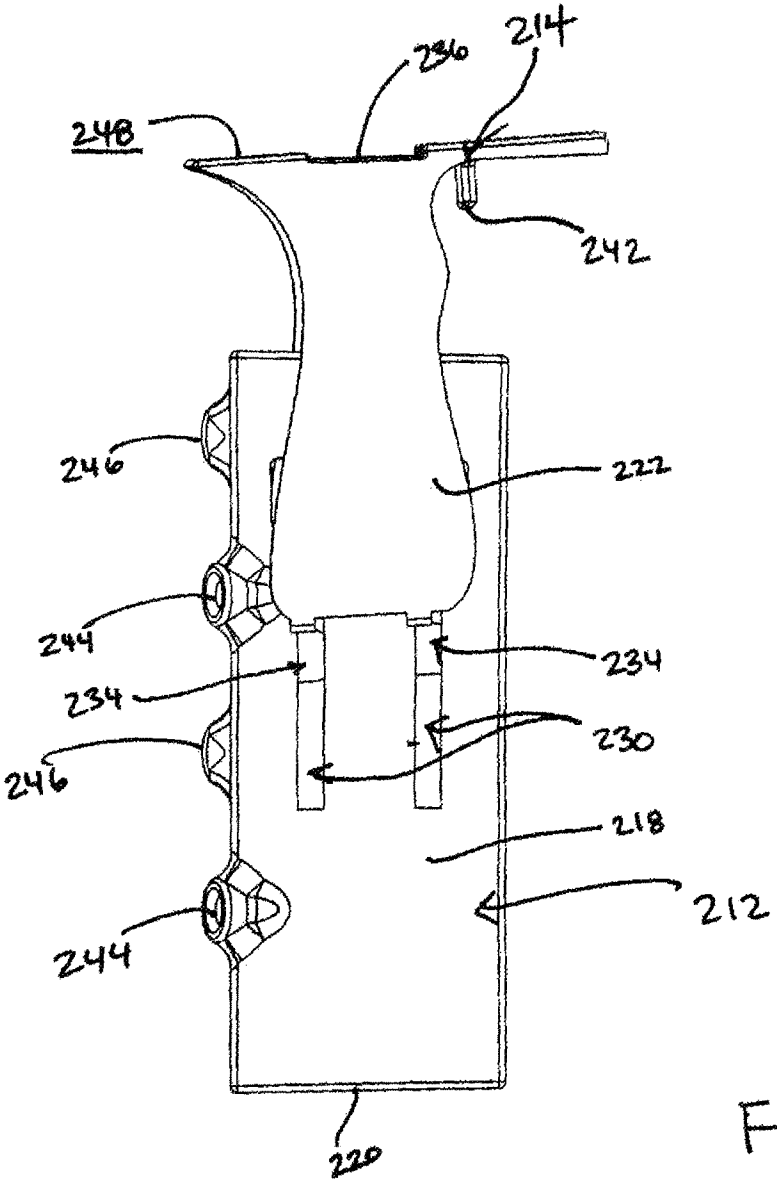

As shown in FIGS. 20-22, a band 216 may be wrapped around the outer sides of the modules 212/214 when assembled. In this embodiment, the top panel 224 includes a groove 236 sized and shaped for receipt of the band 216. One or more of the side panels and the bottom surface of the web 220 can include such a groove as well to aid alignment of the band 216 relative to the modules 212 and 214.

Figure 30:
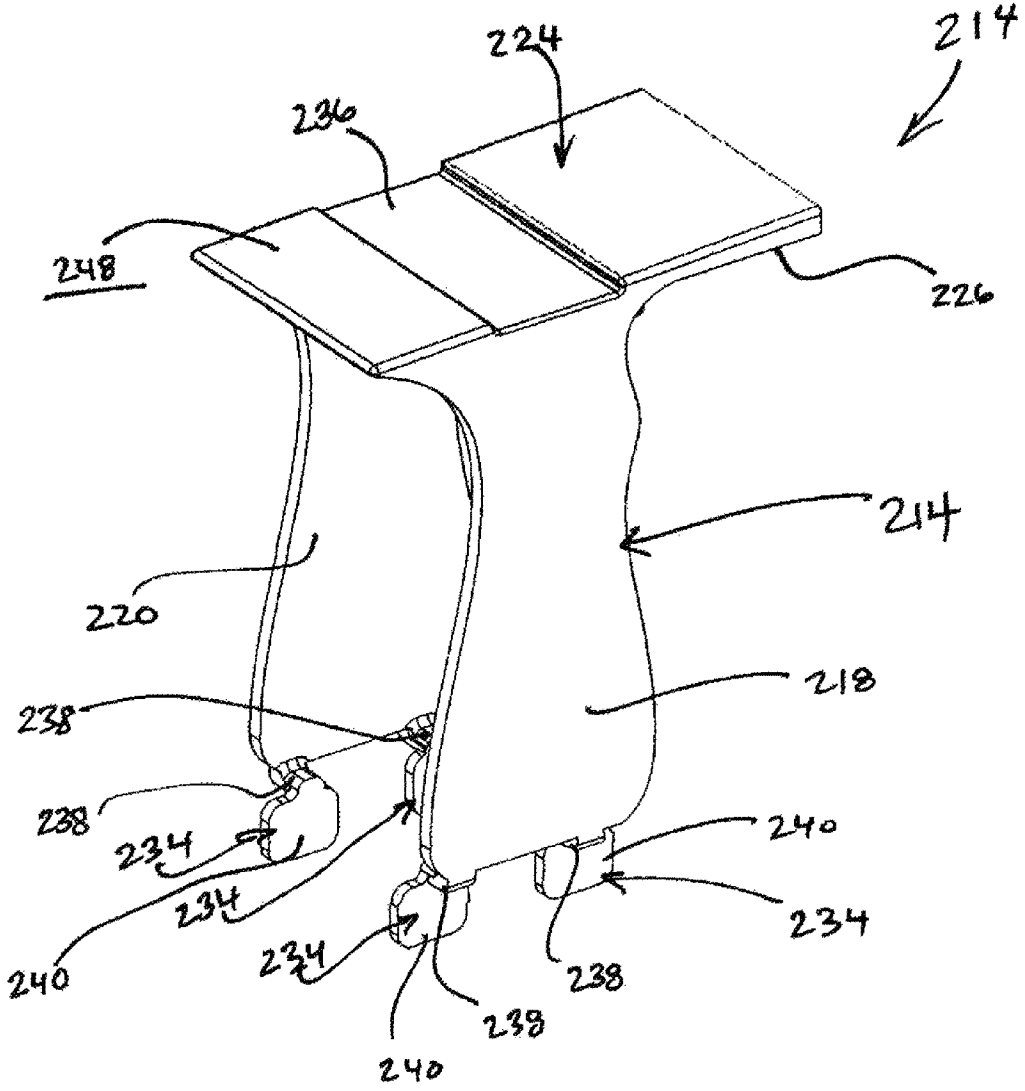
FIG. 30 shows the upper module of the hanger in isolation.
Figure 31:
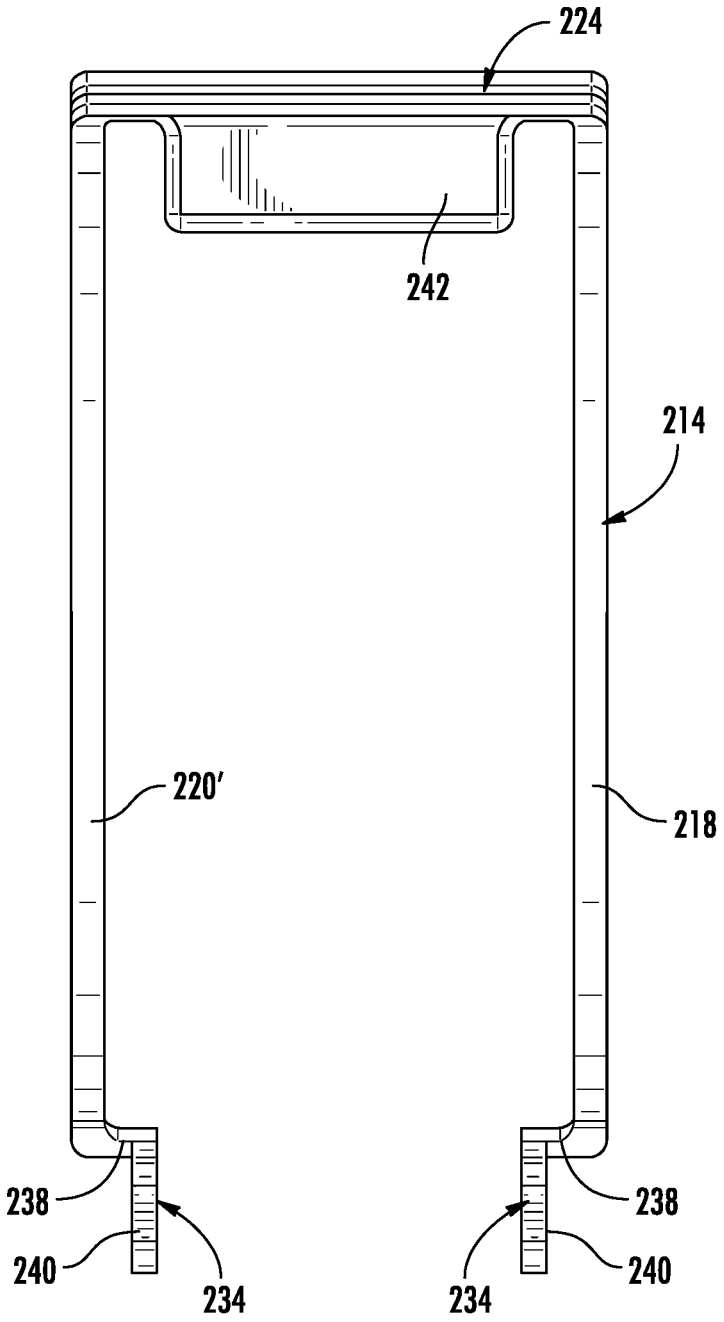
FIG. 31 shows the upper module from a front perspective.

With reference primarily to the isolated views of the upper module 214 of FIGS. 30 and 31, in this embodiment, the guides 234 are formed from two key portions: a relatively narrower lateral arm 238 and a relatively wider flat inner plate 240. When the hanger 200 is assembled, each of the lateral arms 238 extends through a slot in the lower module with the respective inner plate 240 abutting the inner surface of the lower side panels to trap the upper side panels to the lower side panels laterally and rear-to-front, while allowing them to slide vertically relative to one another. The inner surfaces of the lower module side panels may include grooved sections extending vertically to maintain the respective inner plates 240 of the guides 234. As shown in the Figures, the upper module 214 includes two left side guides 234 and two right side guides. Likewise, the inner module 212 defines two left side slots and two right side slots (one slot 230 for each guide 234). The exact number of guides and slots in the disclosed preferred embodiment of the hanger 200 is non-limiting.

As shown most clearly in FIGS. 22 and 31, the lower module 212 includes a rear panel 240 and the upper module includes a substantially parallel rear panel 242. The rear panels, 240 and 242, provide a backstop or abutment surface for the rear edge of the joist J to assist in proper alignment with the hanger 200 during installation. Additionally, the lower module 212 includes a plurality of right fastener guides 244 and left fastener guides 246. Each of the guides, 244 and 246, defines a passthrough opening for installation of a fastener into the rear end of the joist J and the ledger L to secure the joist. The guides are staggered vertically so that fasteners driven through them do not obstruct one another. Additionally, the guides are angled at preferred angles to drive fasteners and install a robust "toenail" connection between the joist J and ledger L, which complies with code requirements.

In a typical installation, the joist hanger 200 is first installed on the rear end of a joist J with the hanger 200 circumscribing the top, bottom, left and right edges of the joist and the joist rear edge abutting rear panels, 240 and 242. The hanger 200 remains securely in place on the joist via the inward bias of the strap 216 without requiring fasteners. The joist with hanger is then aligned with the ledger L with the support flange 226 of the hanger resting on the top edge of the ledger L and the rear panels, 240 and 242, flush against the front face of the ledger. Finally, the joist J is securely attached to the ledger L via driving fasteners into the guides, 244 and 246. In this embodiment, the top surface 248 of the upper module 214 is inclined moderately downward toward the front (toward the left side in FIG. 21) to angle a first decking plank away from the ledger and initiate runoff of rainwater away from the building structure. In a preferred embodiment, the top surface 248 is pitched at an approximate angle of 2°. In other embodiments, the top surface is angled as much as 5°.

Figure 27:
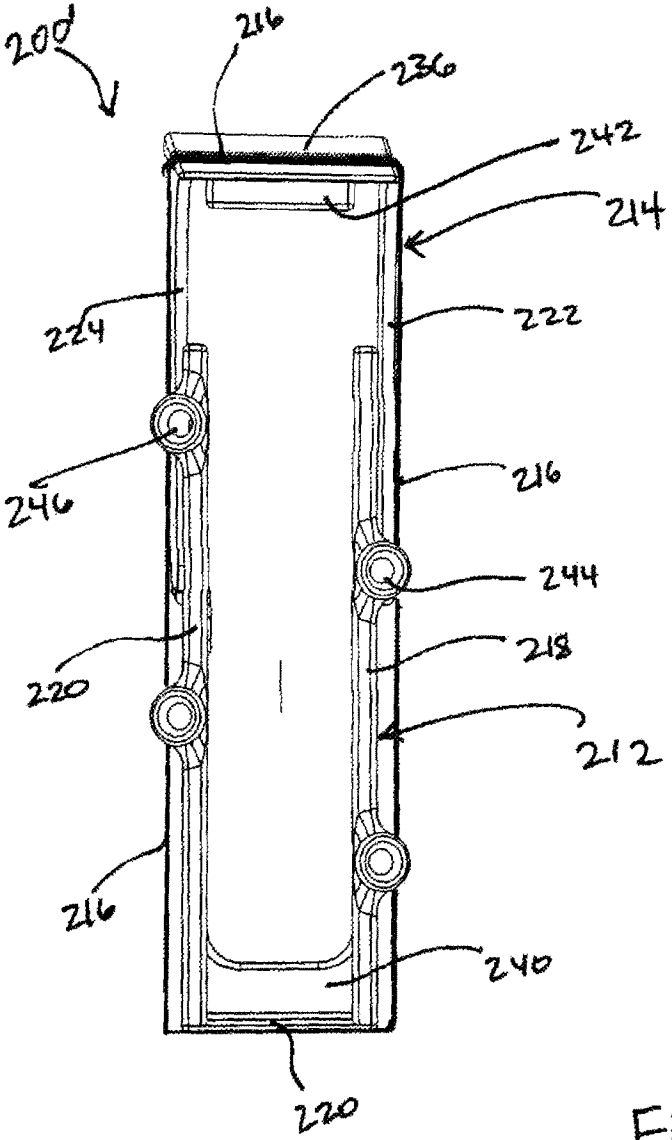
Figure 28:
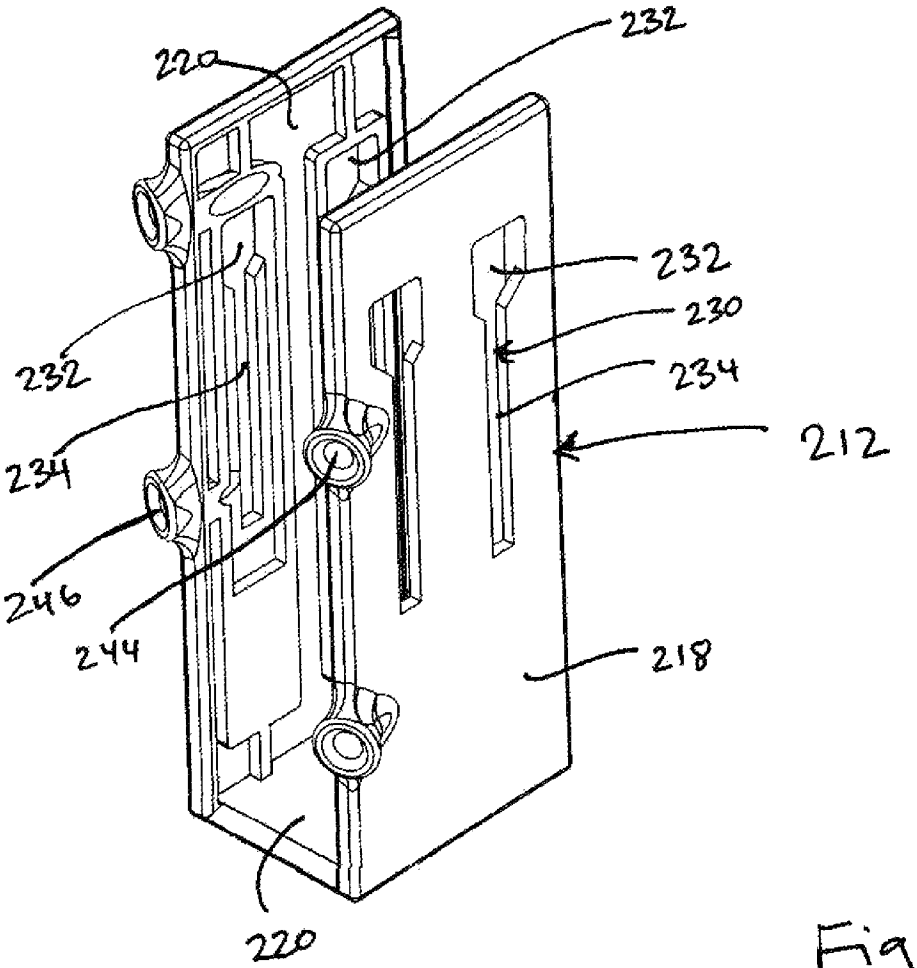
FIG. 28 shows the lower module of the hanger in isolation.
Figure 29:
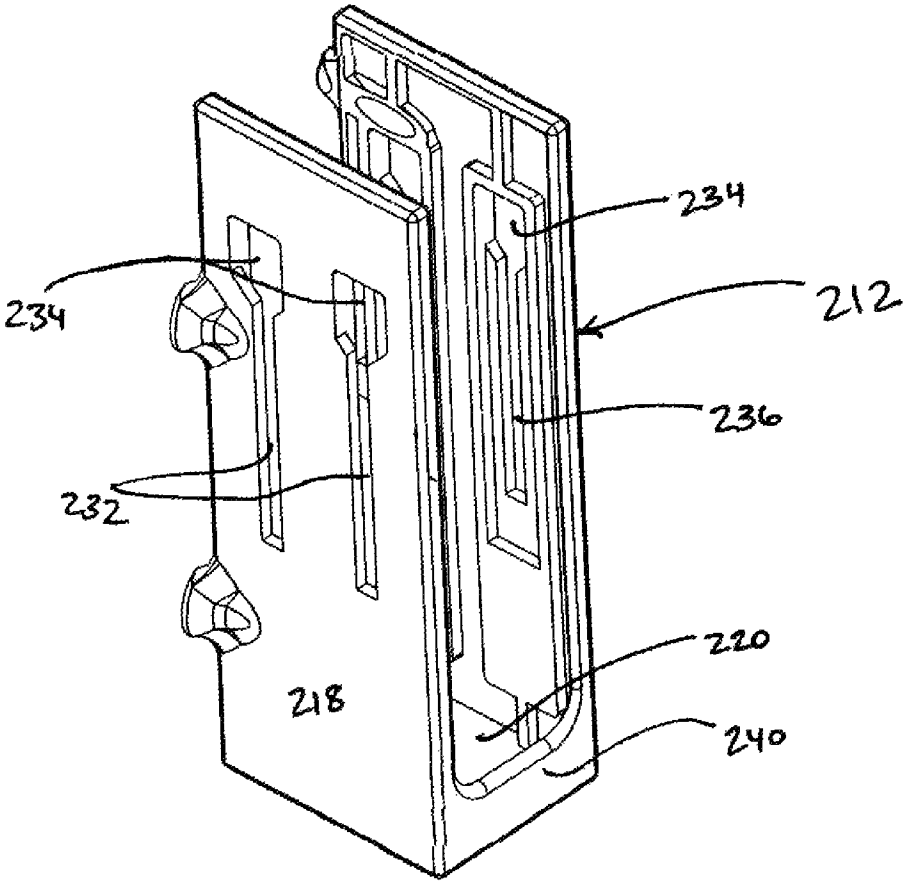
FIG. 29 shows the lower module of FIG. 28 from a rear perspective.

The joist hanger 200 can accommodate joists of a variety of heights via sliding the bottom module 212 from the top module 214 to vertically expand the hanger. FIGS. 20-22 generally show the hanger 200 in a collapsed position with minimum vertical clearance. FIG. 27 shows an example of the hanger 200' in an expanded position with the modules stretched vertically and configured to accommodate a larger joist. Notably, unlike many known joist hangers that may be vertically adjustable via projections in predefined vertically spaced slots, the disclosed joist hanger 200 can be adjusted to any height between its fully collapsed position (with guides 234 at the bottom of the tracks 230) and a fully expanded position (with the guides 234 near a top position of the tracks 230).

Figure 32A:
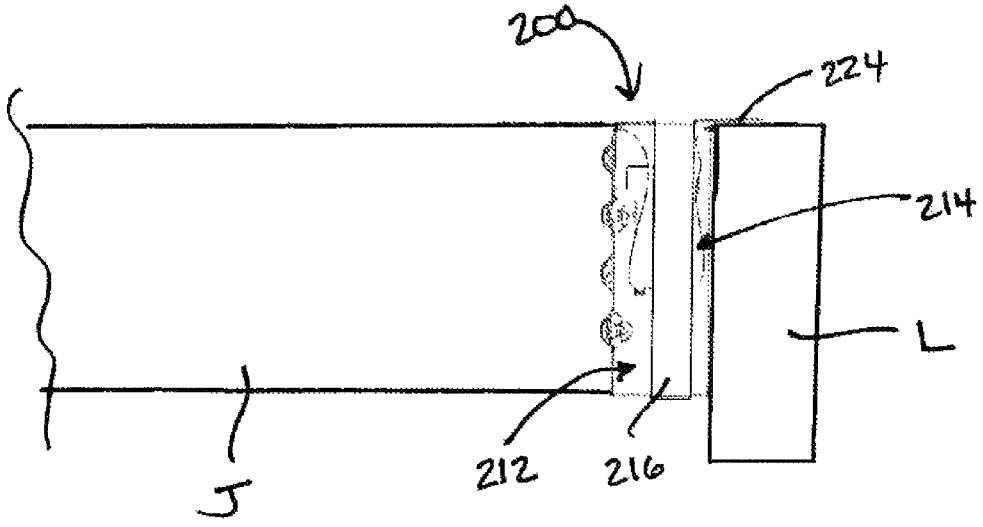
FIGS. 32A and 32B are side elevation views building support connections utilizing the hanger of FIG. 20 in a collapsed configuration and in an intermediate height configuration.
Figure 32B:
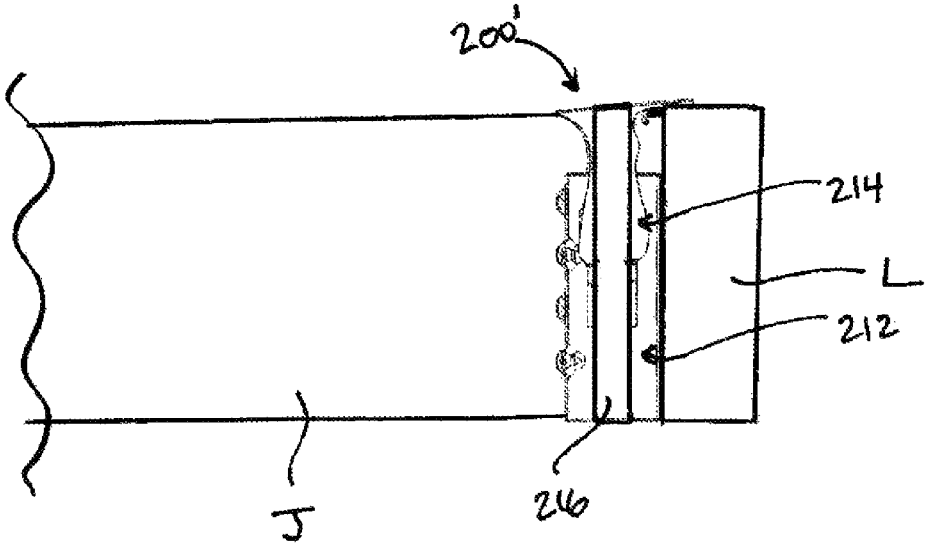

FIG. 32A depicts a first installation using the disclosed hanger 200 in the collapsed position to accommodate a joist J having a smaller height (measured top edge to bottom edge). FIG. 32B depicts an alternate installation of a larger joist with the hanger 200' in an intermediate expanded position.

In another related embodiment, a separate top module similar to the top module 214 of the hanger 200 can be held to an existing joist hanger that has an open top using a band like that shown as reference numeral 216. In this manner, the separate top module can assist in leveling the joist even without a lower module 212 that it specifically designed to mate with it.

Additional embodiments of the disclosed expandable joist hanger exist, including versions without an outer band. More specifically, an embodiment exists wherein the individual modules are engaged with adjacent modules in a telescopic relationship that allows expansion and contraction. The right base module telescopically engages the left base module and the left upper module optionally telescopically engages the right upper module to allow lateral sliding for expansion and contraction. Likewise, the right upper module telescopically engages the right base module while the left upper module telescopically engages the left base module to allow vertical sliding for expansion and contraction. Embodiments exist with integral locking mechanisms to "lock" the respective modules in place at various positions relative to one another. Thus, the joist hanger may be adjusted to accommodate a particular joist and locked in the adjusted position prior to or during installation. In another embodiment, a top module is engaged with a bottom module via a rachet assembly that is optionally lockable and unlockable, rather than being slidable smoothly.

Yet another embodiment of the inventive adjustable hanger 300 is depicted in FIGS. 33-43. The hanger 300 is similar in many ways to the hanger 200 in form and operation. For instance, the hanger 300 comprises a lower module 312 slidably engaged with an upper module 314. The lower module includes substantially parallel right and left panels, 318 and 319, with a lower panel or web section 320 extending therebetween that defines a flat upper (i.e., inner) surface. The upper module 314 includes a right leg 322 and parallel left leg 323 with an upper panel 324. When engaged with one another, the upper module 314 and lower module 312 define a cavity for receipt of a joist J that is adjustable in height to accommodate different sized joists. In the disclosed embodiment, the hanger 300 omits a band like that of the hanger 200. Rather, the upper module 314 and lower module 312 are generally freely slidable until secured to a joist, as will be discussed in detail below.

As shown, a vertical slot 330 is defined in each of the left and right panels, 318 and 319, at a location intermediate the front and rear edges. Each of the right and left panels also defines a vertical groove 331 at least on the inner surface sized and shaped to accommodate an inner segment of a leg of the upper module when engaged. This embodiment includes a groove 331 in both the inner and outer surface of the side panels, defining a substantially I-shaped profile with a web 333 between front and rear flanges, 335 and 337. Along the outer surface, a series of spaced apart ribs 350 wrap around a portion of the right panel 318, underneath the web 320 and a portion of the left panel 319. The ribs 350 serve to enhance strength, stability and structural integrity of the hanger 300. The portion of the ribs 350 around the web 320 takes a curved contour when viewed from the front, as can be seen most clearly in the front views of FIGS. 35 and 36. Each of the left and right panels, 318 and 319, includes one or more screw guides 345 that defines an obliquely extending hole 344 for accepting and guiding a screw to form a toenail connection. The lower module 312 also includes a rear panel edge 340 that acts as a stop surface for the rear edge of the joist.

Figure 44:
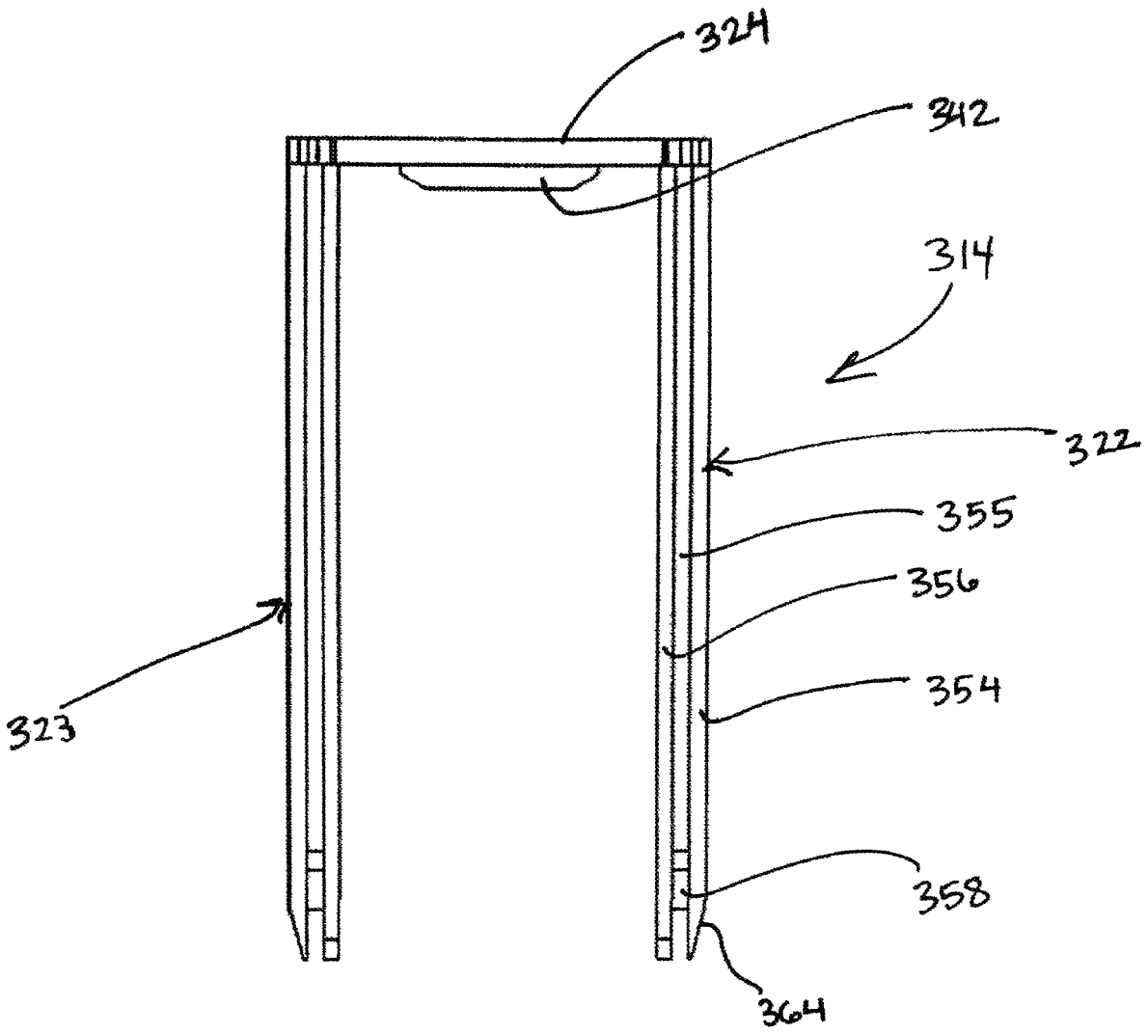
FIG. 44 is a front elevation view of the top module of the hanger of FIG. 33 in isolation.
Figure 45:
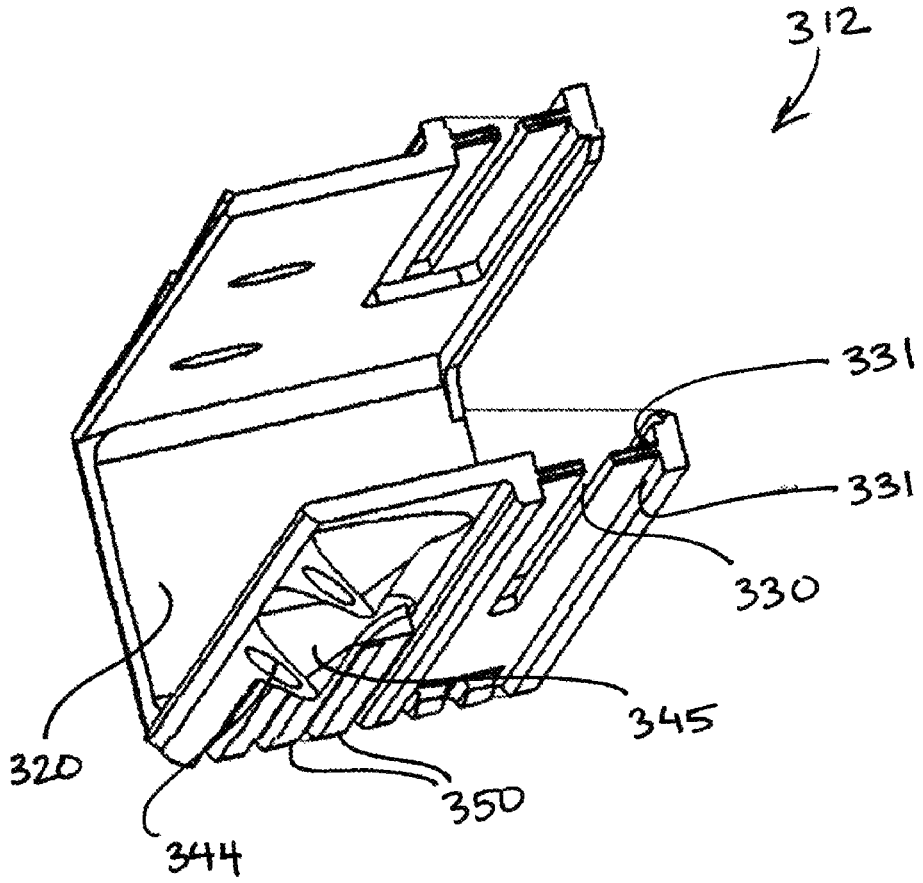
FIG. 45 is a top perspective view of the bottom module of the hanger of FIG. 33 in isolation.
Figure 46:
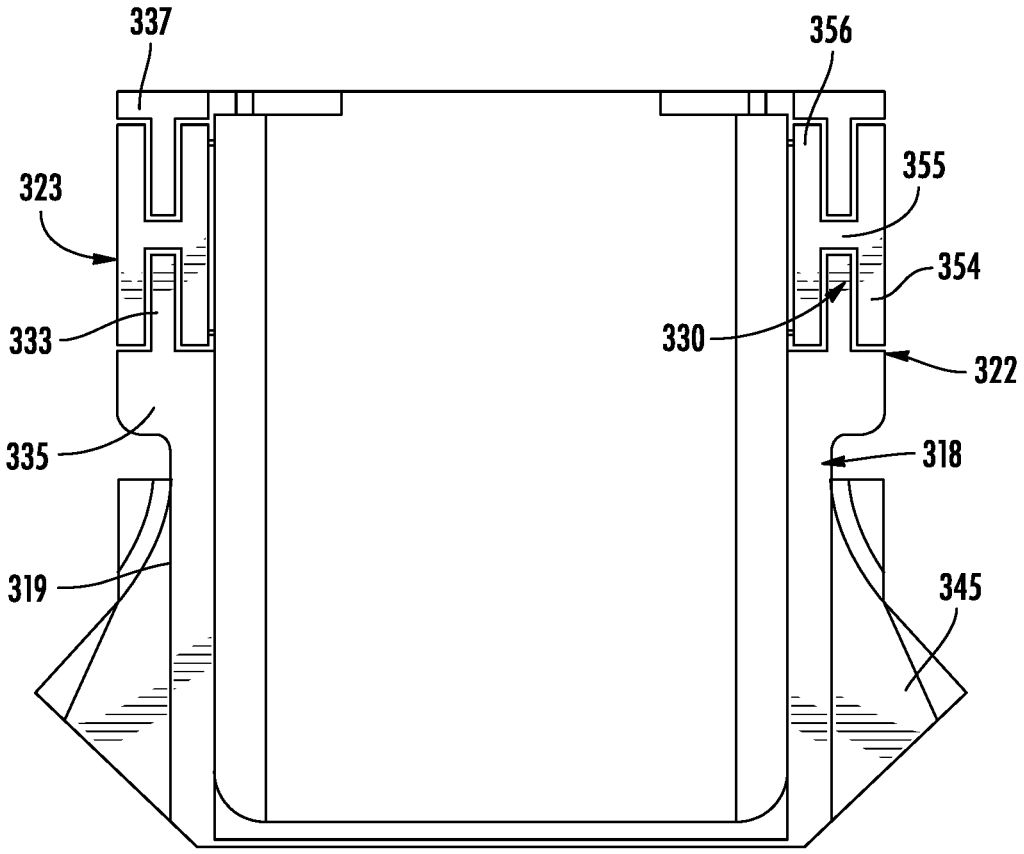
FIG. 46 is a horizontal cross-sectional view from the top of the hanger of FIG. 33 showing engagement between the upper and lower modules.

In the depicted preferred embodiment, each of the legs, 322 and 323, is formed from a pair of opposed spaced apart leg segments defining a slot. For ease of discussion, the legs will be described in detail with reference to the right leg 322, however, it is noted that the left leg 323 includes substantially the same features. With reference to the isolated view of the upper module of FIG. 44, the right leg 322 is formed from an inner leg segment 354 and outer leg segment 356 defining a central slot 355. A leg web 358 connects the inner and outer segments and is positioned toward the lower end. From the front, the inner segment 356/web 358/outer segment 354 connection forms substantially an I-shape that is rotationally offset from the I-shaped profile of the right and left panels by 90°. In another non-depicted embodiment, the leg web 358 may extend vertically between the respective segments. The leg web 358 is sized to be received within the vertical slot 330 with front and rear portions of the side panels extending into the spacing between the inner segment 354 and outer segment 356 when the upper module 314 is engaged with the lower module 312. The upper and lower modules are vertically slidable in this manner. This relationship between the legs, 322 and 323, and the side panels, 318 and 319, can be best appreciated with reference to the cross-sectional view of FIG. 46.

Figure 36:
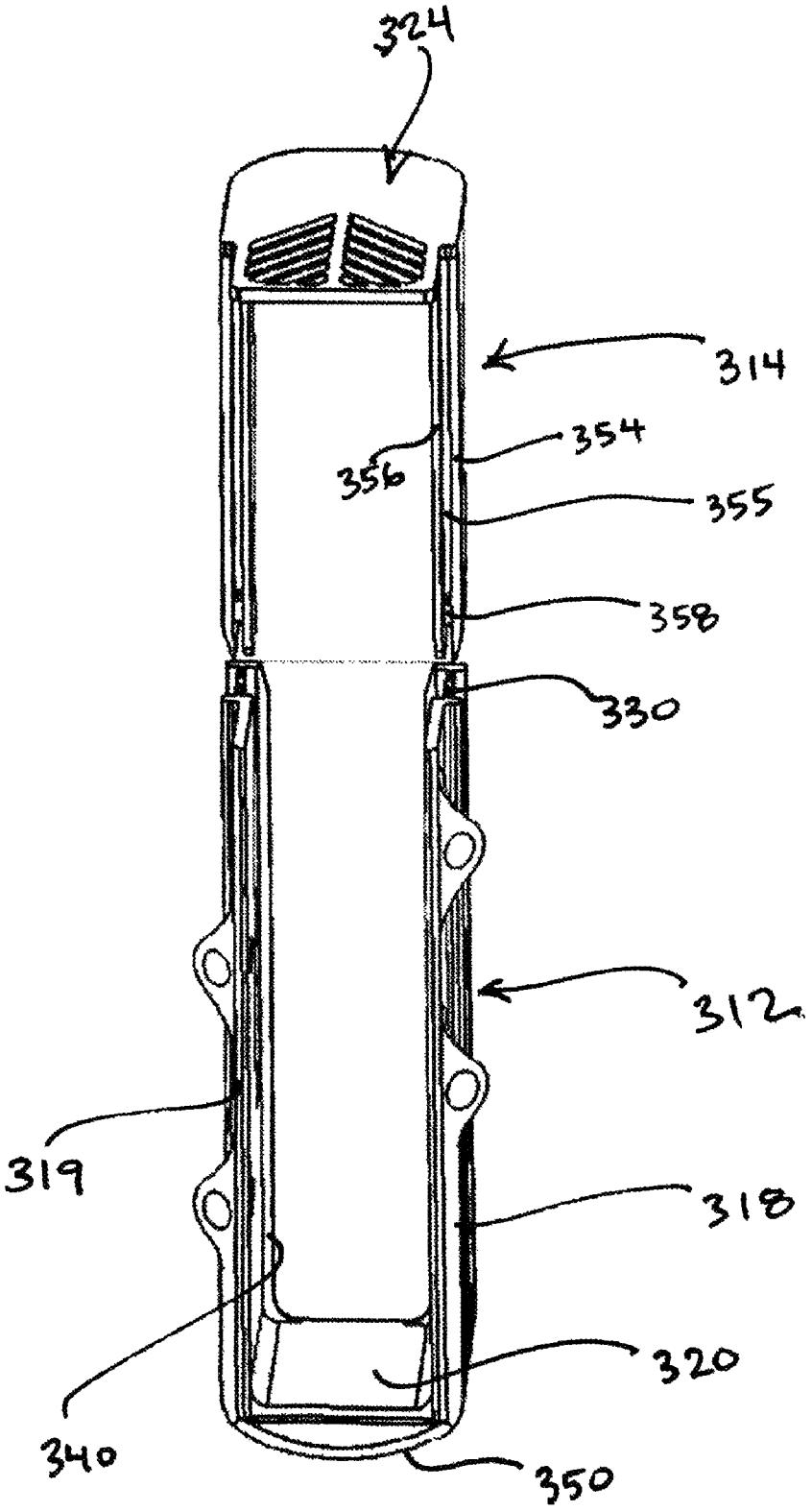
FIG. 36 is an exploded view of the hanger of FIG. 33 from the front
Figure 37:
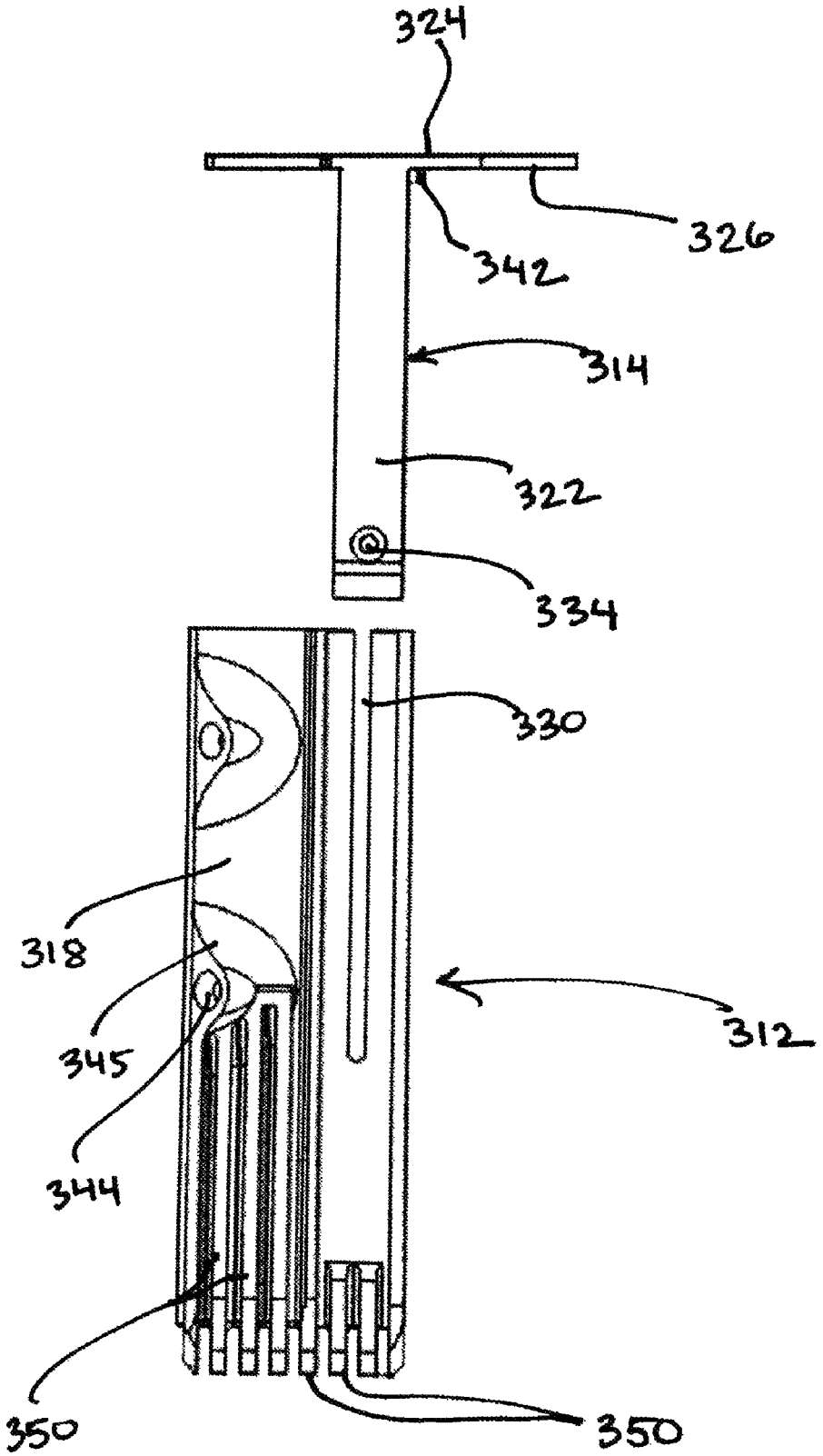
FIG. 37 is an exploded view of the hanger of FIG. 33 from the side.
Figure 38:
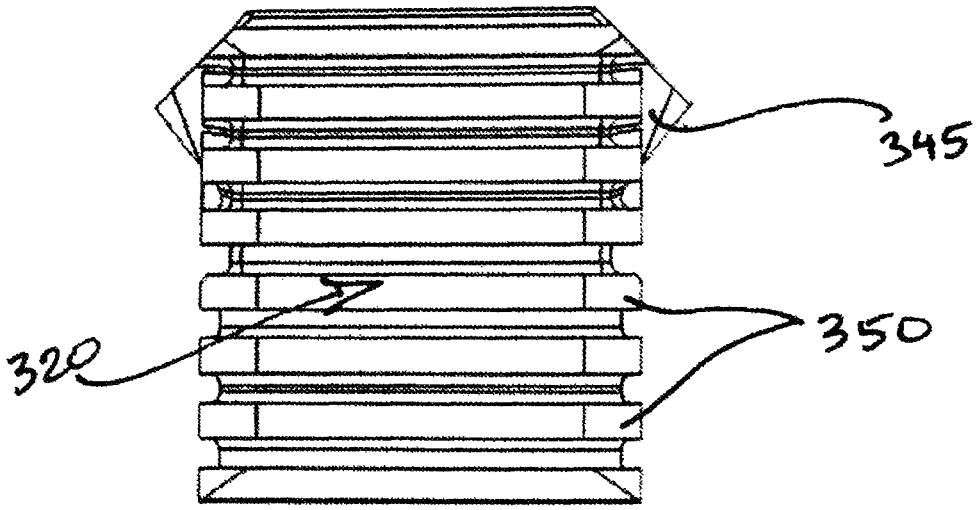
FIG. 38 is a bottom elevation view of the hanger of FIG. 33.
Figure 39:
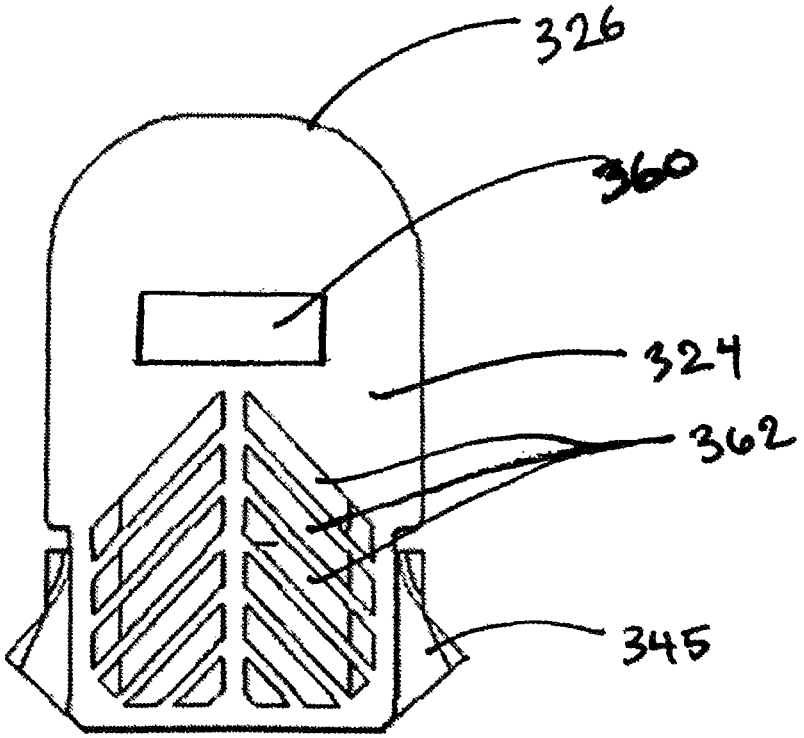
FIG. 39 is a top elevation view of the hanger of FIG. 33.

Each of the legs includes at least one hole 334 extending from the outer leg segment 356 through the inner leg segment 354. Each hole is configured to receive an elongate fastener to secure the joist hanger 300 to the joist once it has been adjusted to the preferred height. As shown in FIGS. 36 and 37, the upper and lower modules in this embodiment are fully disengagable via the slot 330 which extends through the top edge of the side panels 318 and 319. As shown most clearly in the view of FIG. 44, the terminal end of one or both of the leg segments may also have a chamfered surface 364.

Additionally, as in earlier embodiments, the top panel 324 of the upper portion includes a rearwardly extending support flange 326 for supporting the hanger 300 on a ledger L. With reference to the top view of FIG. 39, the top panel 324 may also define a viewing window 360 aligned to allow an installer to observe the rear edge of the joist and the interface between the joist and ledger during installation. The support flange 326 ensures that the joist is installed level with top edge aligned with the top edge of the ledger, while the window 360 assists the installer in ensuring that the joist is positioned in the desired location relative to the hanger and ledger. This embodiment also includes a plurality of slots 362 forward of the viewing window which allow additional observation of the joist by the installer. The upper module may also include a rear extension panel 342 that provides an abutment surface for the rear edge of the joist. Like in the joist hanger 200, the top surface of the upper panel may be angled slightly downward toward the front to promote runoff of rainwater and ice melt away from the building structure.

Figure 33:
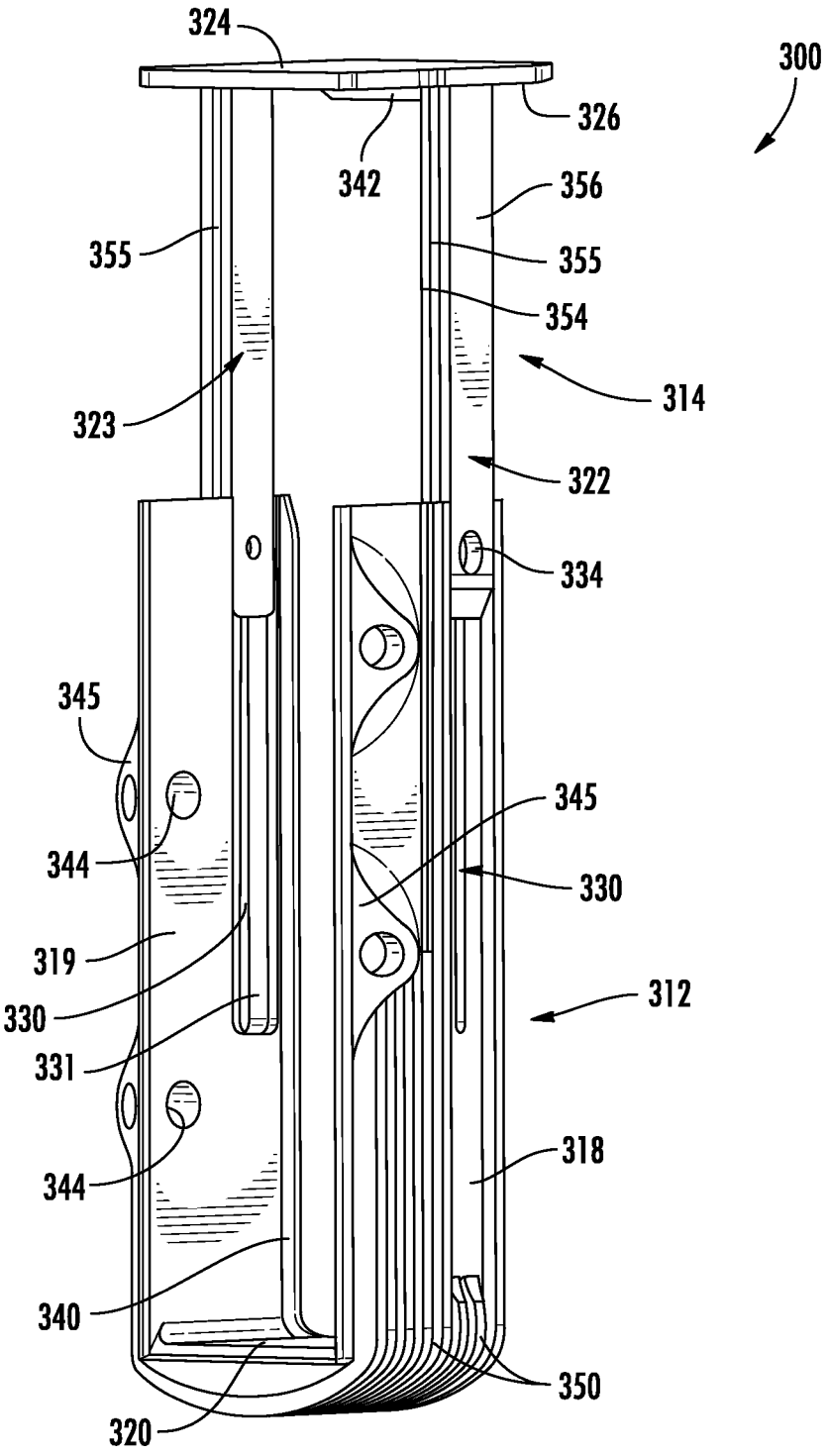
FIG. 33 is a perspective view of another embodiment of an expandable hanger in accordance with the disclosure in its expanded maximum height position.
Figure 40:
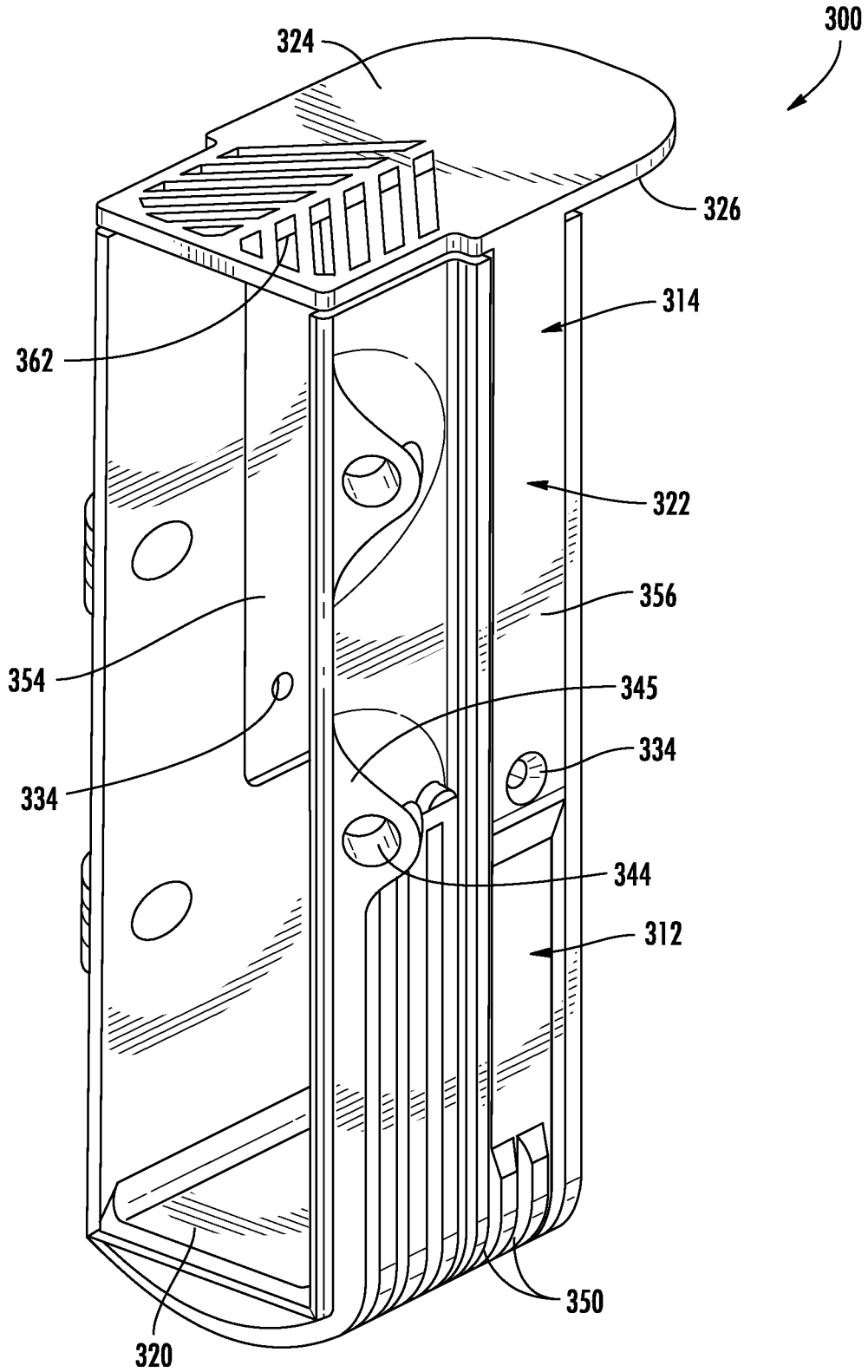
FIG. 40 is a perspective view of the hanger of FIG. 33 in a collapsed minimum height position.

As noted, the upper module 314 is vertically slidable relative to the lower module 312 such that the hanger 300 can be used with a variety of sizes of joists J. FIG. 40 shows the hanger 300 in its collapsed condition with minimum vertical clearance between the web 320 and upper panel 324. FIG. 33 depicts the hanger 300 in its fully expanded condition with maximum vertical clearance. Notably, the lower and upper modules can be reciprocated to any vertical height intermediate the fully expanded condition and collapsed condition, allowing substantial adjustability. With the disclosed hangers, beams can accommodate virtually any height of beam, including accounting for minor dimensional variations, while guaranteeing that the beams of any size are installed level and at a common height regardless size.

Figure 34:
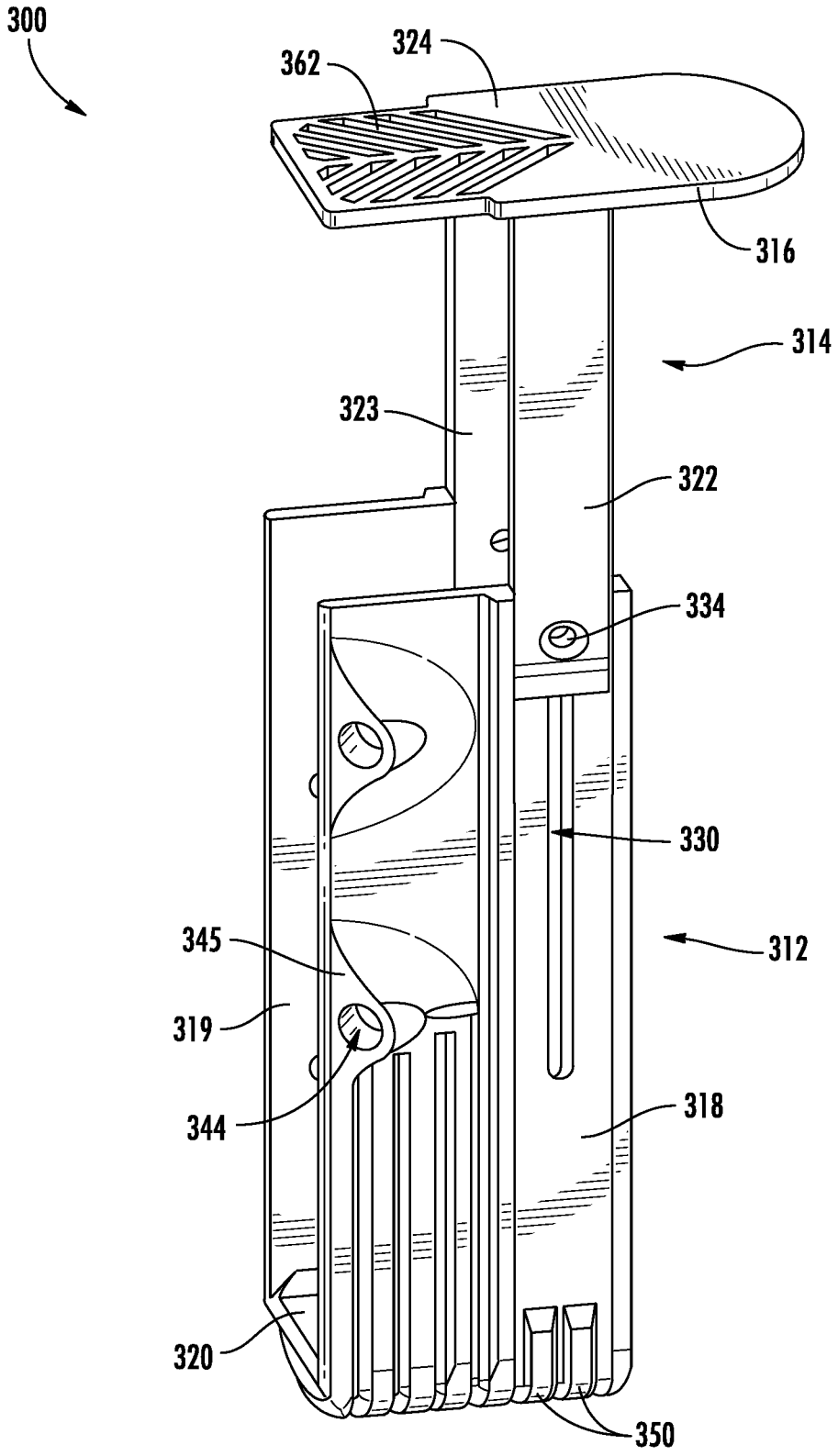
FIG. 34 is a different view of the hanger of FIG. 33.
Figure 35:
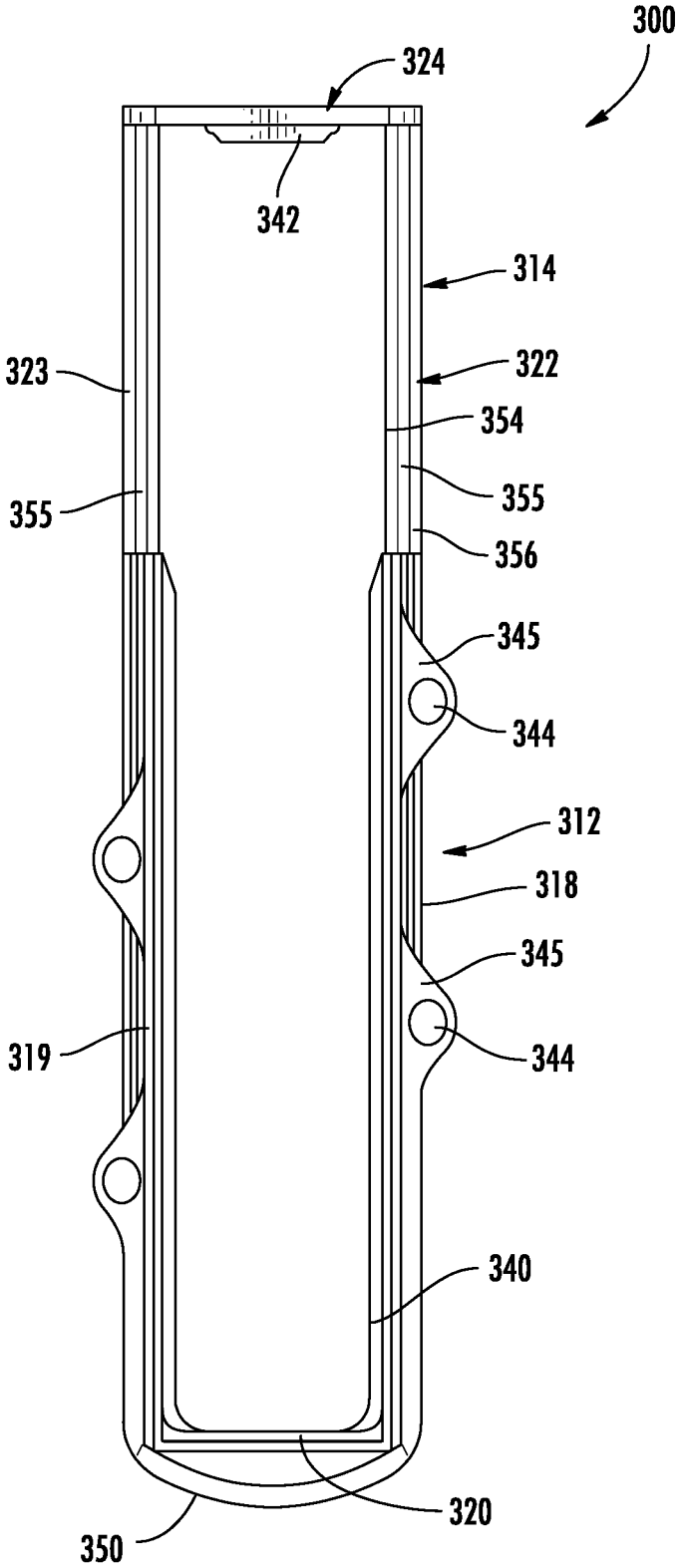
FIG. 35 is a front elevation view of the hanger of FIG. 33.
Figure 41:
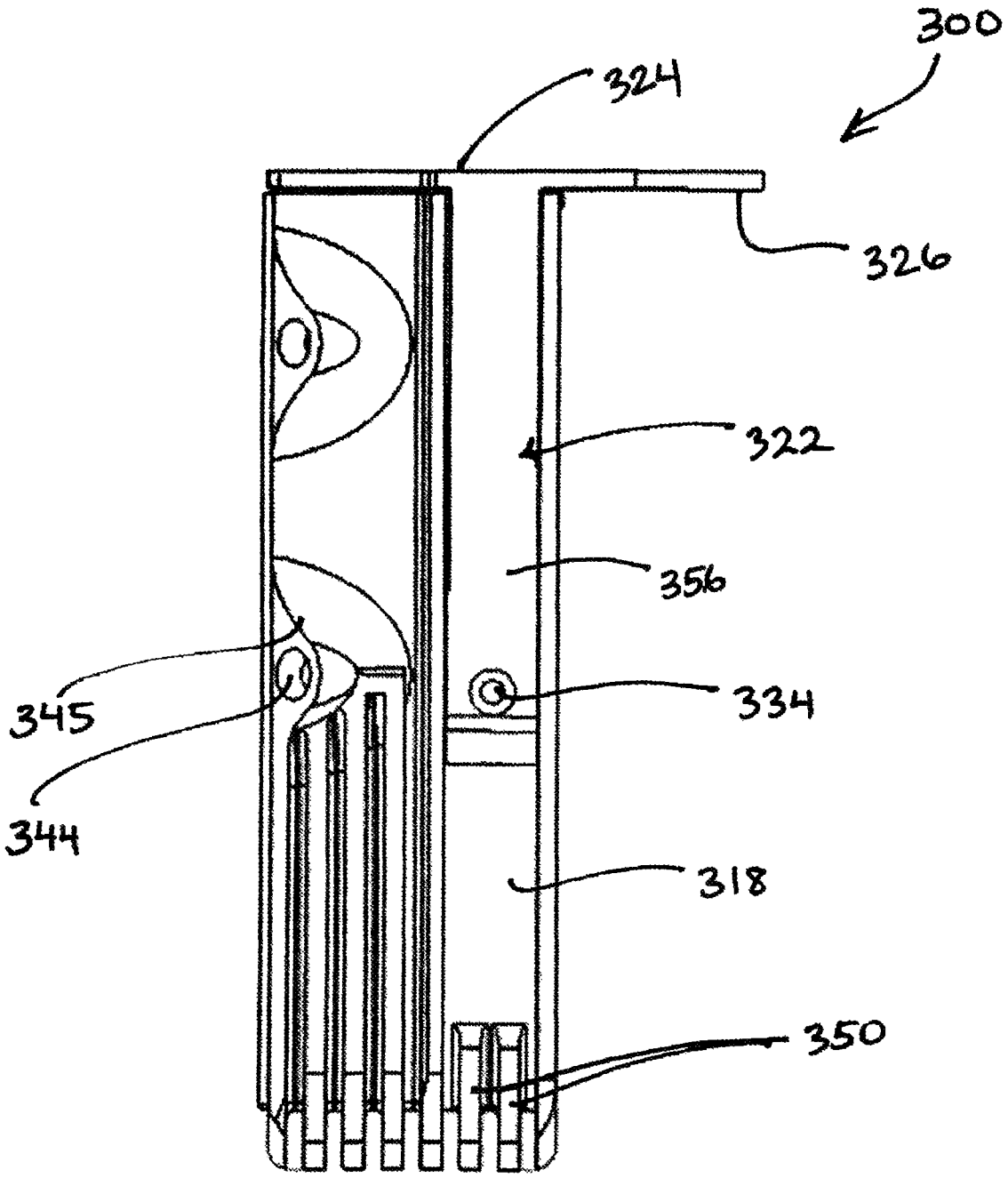
FIG. 41 is a side elevation view of the hanger of FIG. 33 in the collapsed position.
Figure 42:
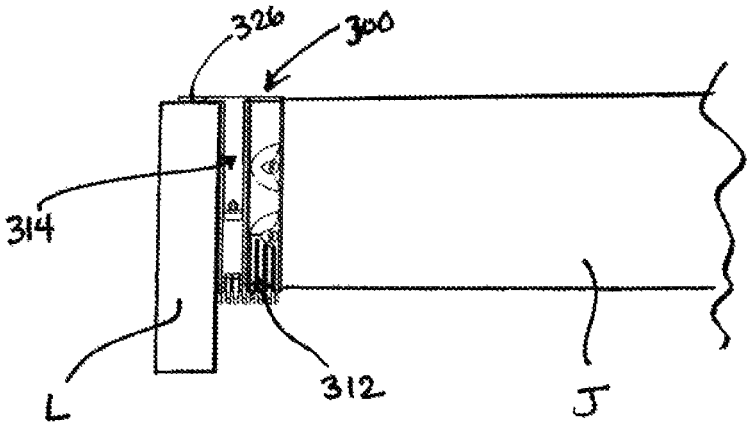
FIGS. 42 and 43 are side elevation views of building support connections utilizing the hanger of FIG. 33 in a collapsed configuration and in an intermediate height configuration.
Figure 43:
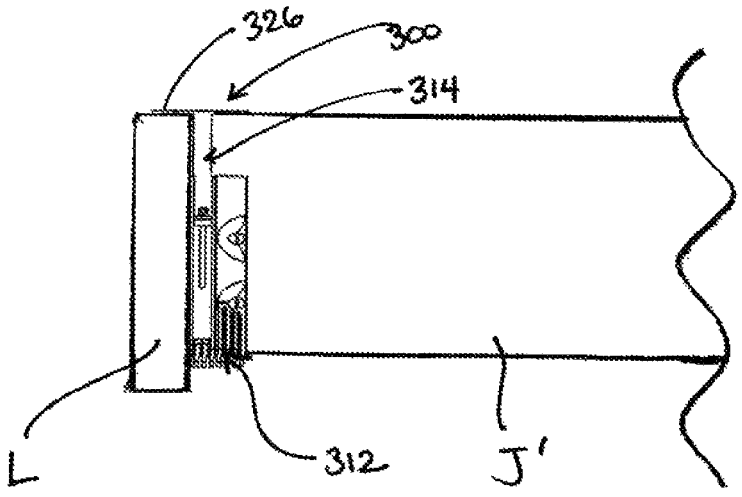

In use, much like the earlier disclosed embodiments, the joist hanger 300 is configured to optionally expand vertically to accommodate a joist having different height dimensions. An installation utilizing the joist hanger 300 can be understood most clearly with reference to FIGS. 42 and 43. FIG. 42 depicts a side elevation view of a first building structure assembly with a joist J having a height approximately equal to the distance between the lower web 320 and top panel 324 when the hanger is in the collapsed configuration having a minimum height (FIGS. 40 and 41, for example). FIG. 43 depicts a side elevation view of a second building structure assembly with joist J' having an intermediate height dimension that is between the vertical clearance of the hanger 300 in the collapsed configuration and the vertical clearance of the hanger in the fully expanded configuration (FIGS. 33 and 34, for example).

The sliding relationship between the upper module 314 and lower module 312 is such that the hanger 300 can be expanded vertically, followed by insertion of a joist J through the front, and then vertically collapsing the hanger by sliding the upper and lower modules toward each other until the top panel 324 abuts the upper edge of the joist and the web 320 abuts the lower edge of the joist. Alternatively, the upper module and lower module may originate separated from one another and be moved together to trap the joist between them. The hanger and joist are then positioned relative to each other with the joist rear edge against the rear panels 340 and 342. The hanger can be fixed in this position via driving fasteners through the laterally extending leg holes 334 and into the joist.

After securing the hanger 300 to the joist J, the hanger/joist sub-assembly is installed on a ledger L. The rear support flange 326 is configured to rest on the top surface of the ledger L with the rear edges of the hanger 300 against the front surface of the ledger ensuring a level installation. Like the earlier embodiments, the joist J is attached to the ledger L via driving fasteners through the obliquely extending holes 344 of the screw guides 345. As shown, the screw guides may include surfaces that project from the body of the right and left panels to provide an abutment surface for leveraging against the head of a fastener to form a more robust mechanical connection. Like the earlier embodiments, the screw guides are positioned vertically staggered relative to each other and configured to allow a "toenail" connection between the joist and ledger.

As noted above, FIG. 42 shows an assembly with the joist hanger 300 in its collapsed configuration with a relatively small joist J. FIG. 43 shows an assembly with the joist hanger 300 in an intermediate configuration with a relatively larger joist J'. Each of the building assemblies of FIGS. 42 and 43 is assembled via the general process discussed in the preceding paragraph. As noted above, the upper and lower modules are vertically movable relative to one another to any height between a fully contracted position (FIG. 40) and a fully expanded position (FIG. 33), providing substantial variability for building materials of differing dimensions.

Figure 61:
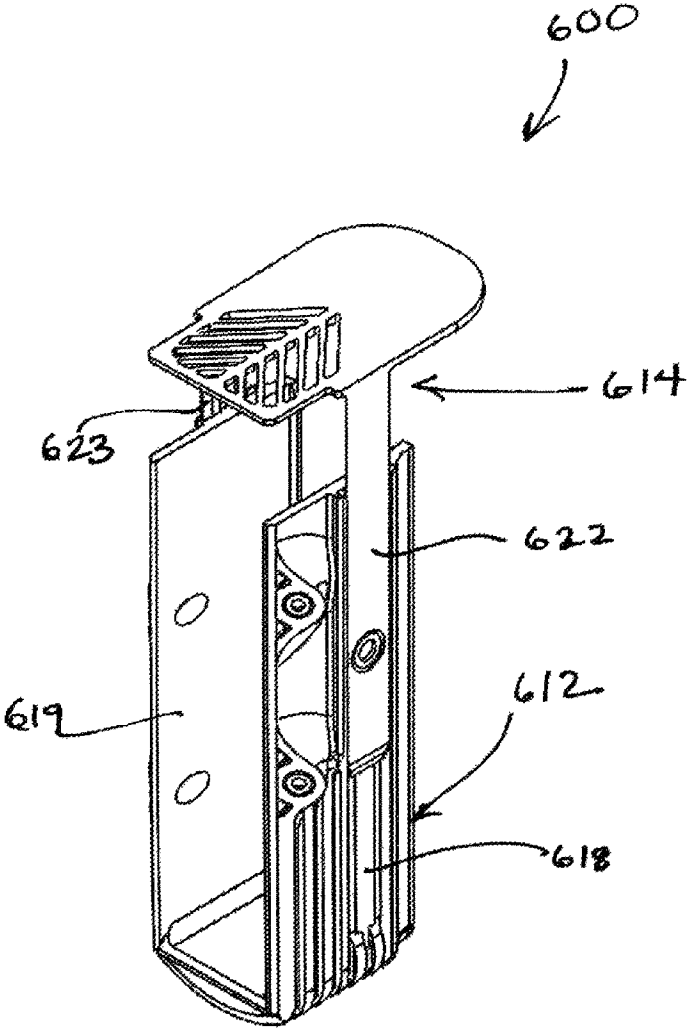
FIG. 61 shows the hanger of FIG. 60 in a collapsed position.
Figure 60:
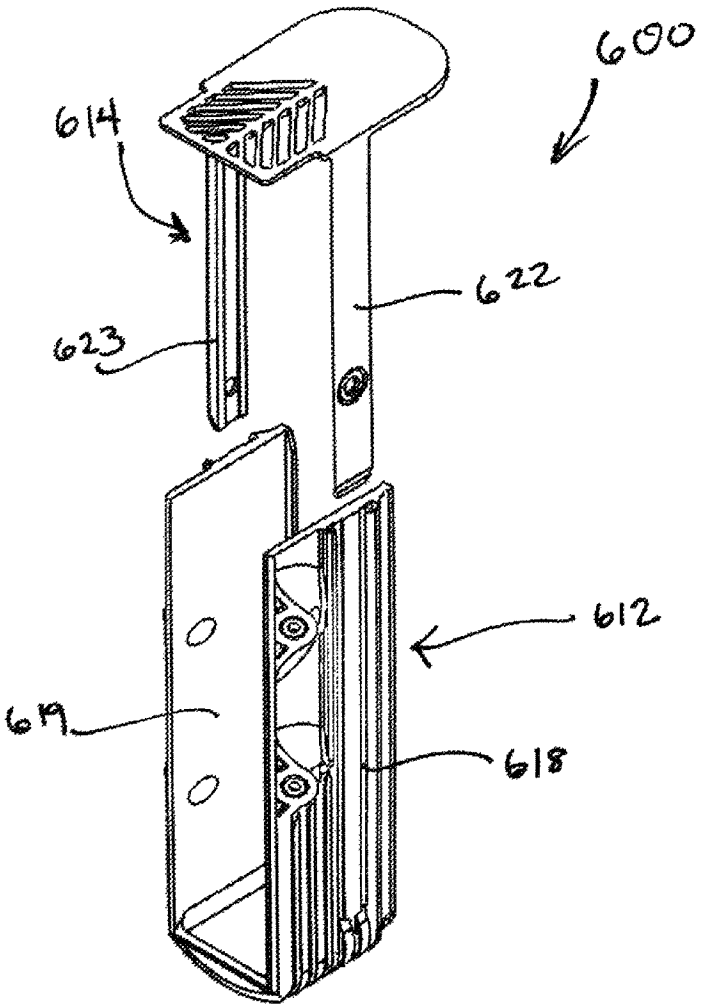
FIG. 60 is yet another embodiment of the disclosed adjustable hanger with top module disengaged from the bottom module.

Of course, alternate embodiments exist with legs and/or lower panels having different configurations from the preferred embodiment shown and described herein. For example, with reference to FIGS. 60-61, an embodiment of the hanger 600 exists with a pair of legs, 622 and 623, each of which is singular piece (i.e., separate leg segments are omitted) and generally flat or may include engagement grooves or surfaces that engages a lower side panel, 618 or 619, in a surface-to-surface relationship and slides relative thereto. Each of the lower side panels, 618 and 619, may include a vertical groove on the outside or inside surface of one of the lower panels at an intermediate position between front and rear of the hanger.

Figure 62:
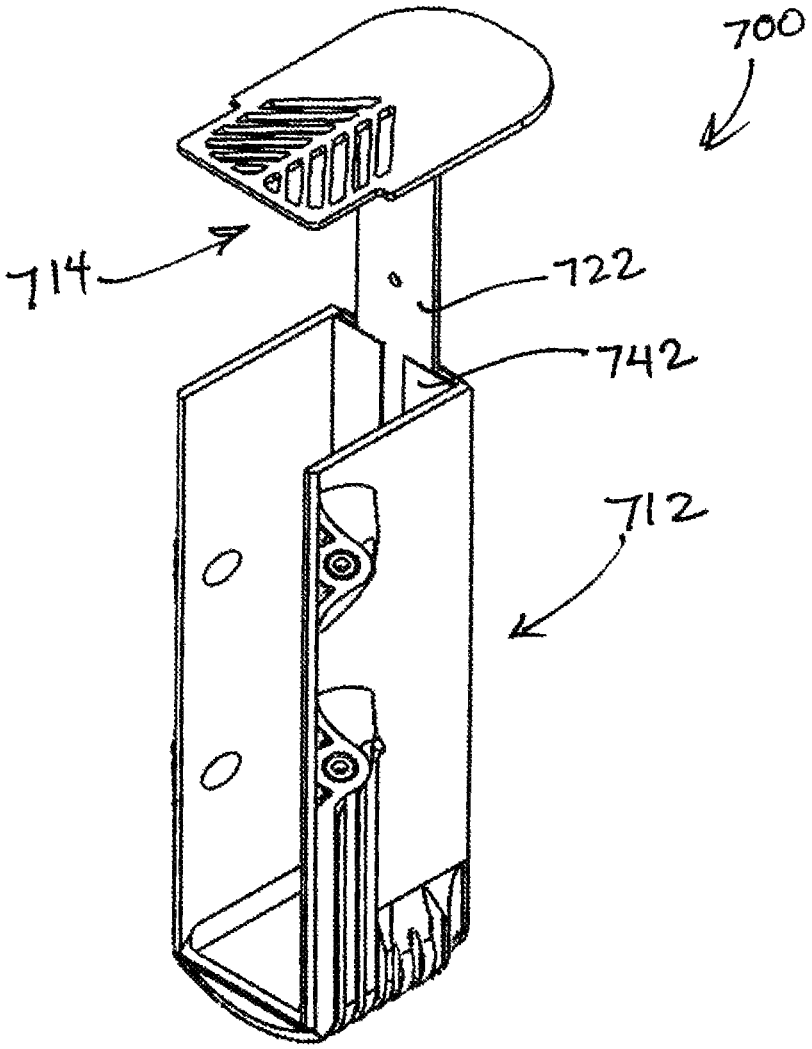
FIG. 62 shows yet another embodiment of the disclosed hanger.

Additionally, as shown in FIG. 62, an embodiment of the hanger 700 exists wherein the top module 714 slides relative to the bottom module 712 via engagement in the rear, as opposed to side panels. In such an embodiment, a flat rear panel 742 in the bottom module can include one or more tracks or slots configured for engagement with a guide 722 in the top module (or vice versa). The hanger 700 is operated and installed much like the hanger 300 in that the height clearance between the top panel and web are adjusted so that the top edge, bottom edge and sides of a beam are circumscribed by the hanger, and then attached to a support via driving fasteners through the hanger 700 and beam.

Further embodiments exist with integral locking mechanisms to "lock" the respective modules in place at various positions relative to one another. Thus, the joist hanger may be adjusted to accommodate a particular joist and locked in the adjusted position prior to or during installation. In such an embodiment of the hanger 800, for example, a top module 814 is engaged with a bottom module 812 via a rachet assembly that is optionally lockable and unlockable, rather than sliding smoothly. With reference to FIG. 63, each of the upper module legs, 822 and 823, have a series of spaced apart ratchet teeth, 858 and 859, that mate with cooperative teeth in the lower side panels, 818 and 819. The teeth or other locking mechanism may be releasable or permanently locking, similar to a zip tie.

Figure 47:
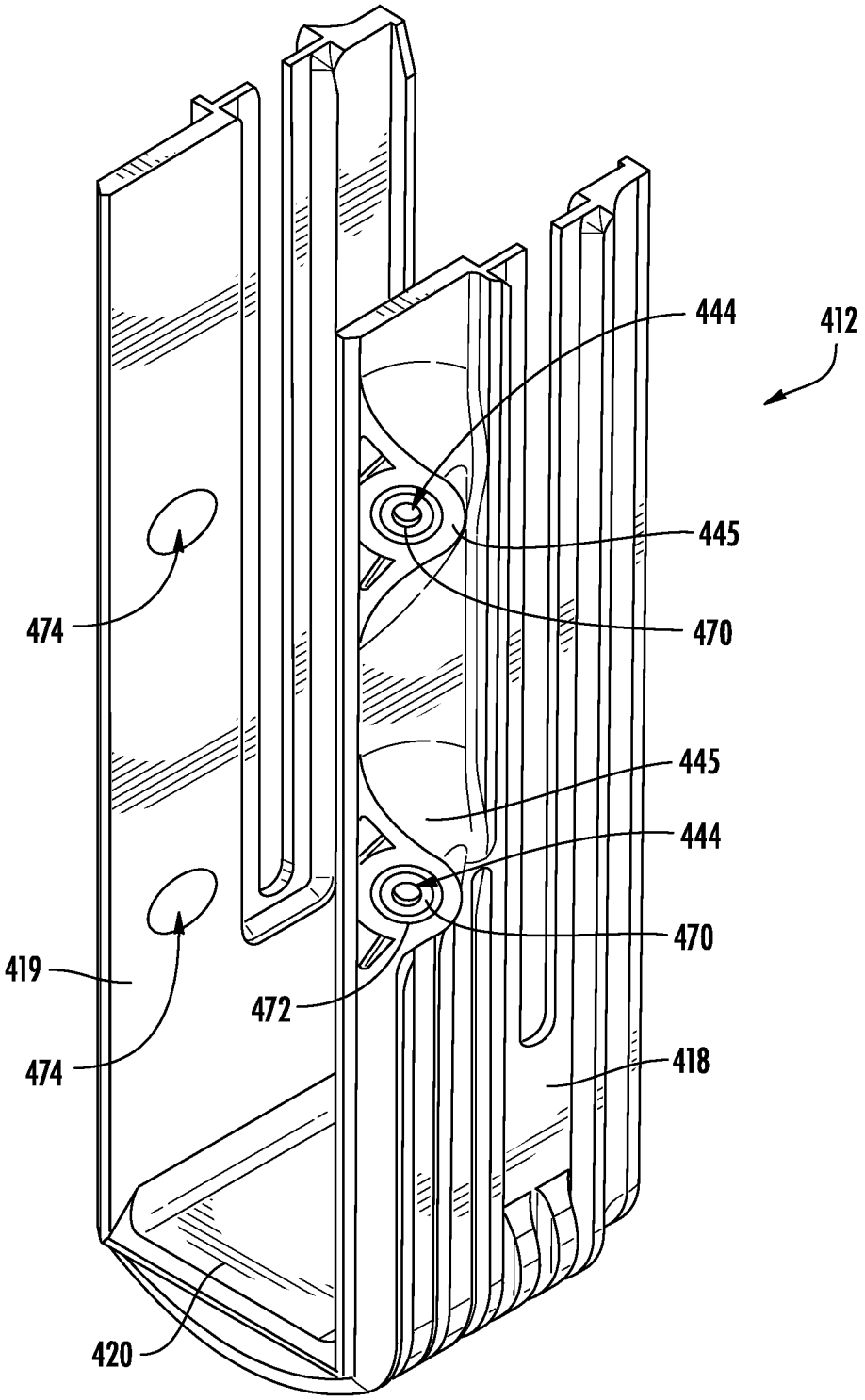
FIGS. 47-48 show views of an alternate embodiment of a lower module with enhanced breakaway screw guide.

FIG. 47 shows another embodiment of a lower module 412. This embodiment of the lower module includes improved toenail screw guides 445 with breakaway boss covers 470. With exception to the boss covers 470, the lower module 412 depicted herein is substantially identical to the lower module 312 of FIGS. 33-46. However, it is expressly noted herein that the configuration of guides 445 with boss covers 470 may be used in virtually any building construction hanger or bracket having screw holes, and especially those disclosed herein and others formed from a polymer or composite material.

Figure 48:
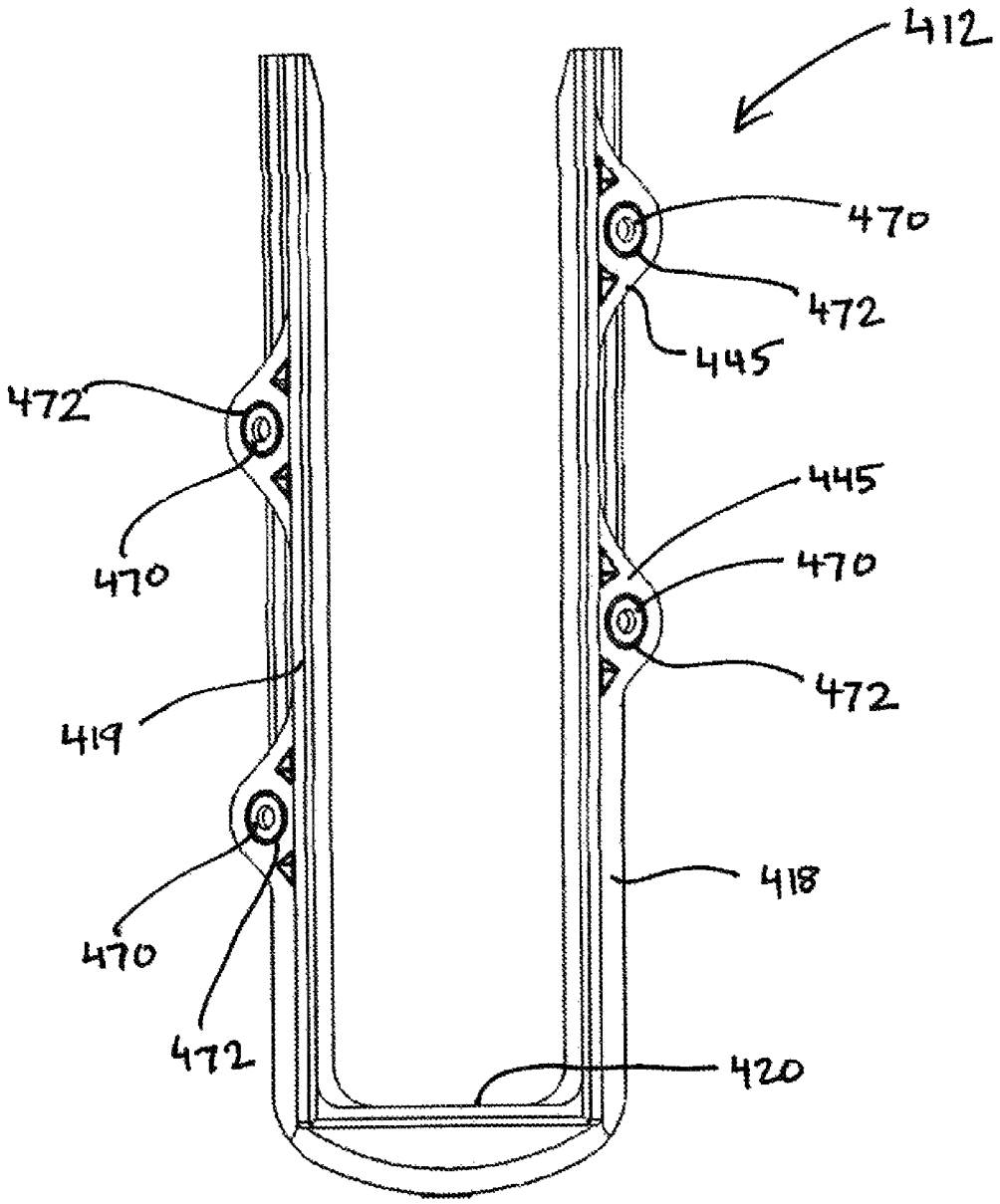
Figure 49:
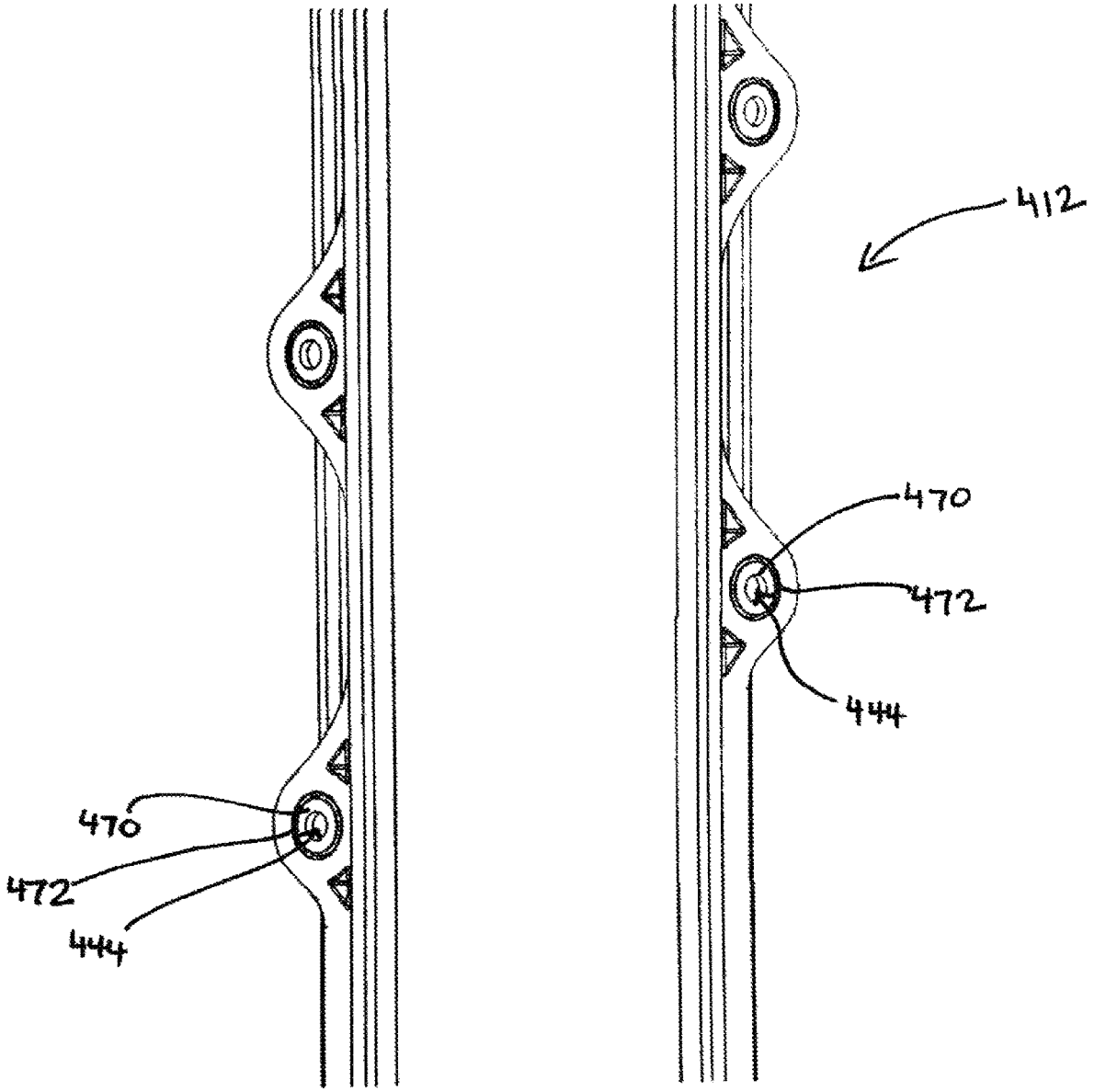
FIG. 49 is an enlarged front elevation view of a central portion of the lower module of FIG. 47.

Like with the earlier embodiments of the hanger, each of the front screw guides 445 defines a screw hole 444 for driving screws to attach a joist to a building support. In this embodiment, as can be seen in FIGS. 47-49, each guide 445 is fit with an annular boss cover element 470 proximate the inlet of the hole. The boss cover 470 is configured as an inner annular ring circumscribed by breakaway ring 472 having a reduced thickness. The boss cover 470 with breakaway ring 472 is configured to at break away from the main body of the hanger during the process of driving a screw through the hole. Used herein, "break away" includes a full break from the main body yielding a loose body ring as well as wherein the boss cover 470 only partially breaks from the main body, so as to yield a frangible unit.

Figure 50:
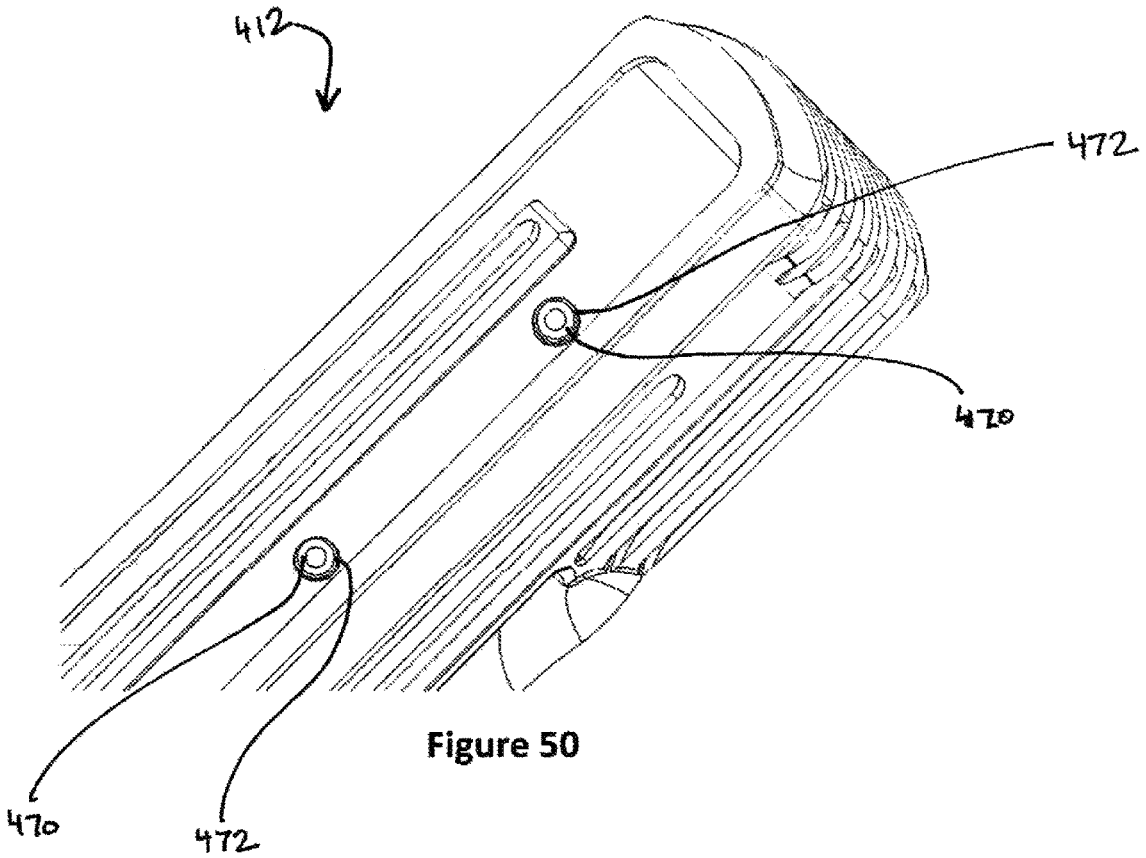
FIG. 50 is a perspective view from the inside of the lower module of FIG. 47.
Figure 51:
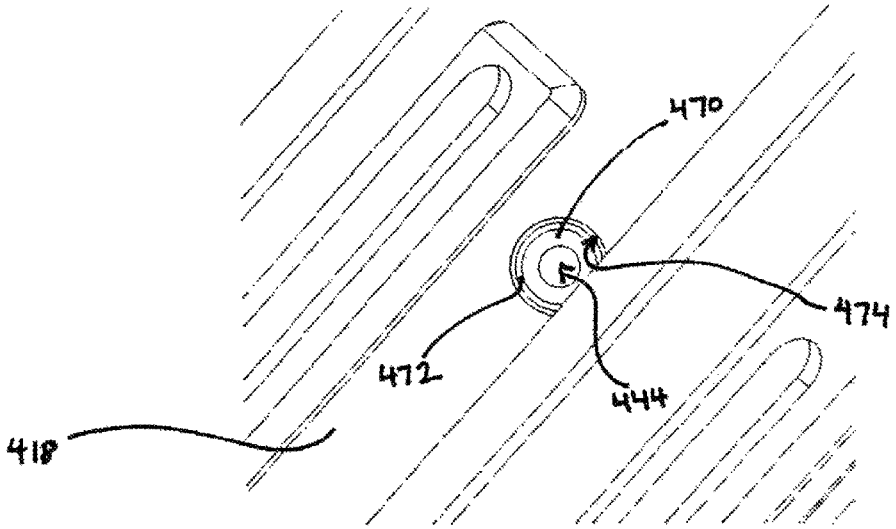
FIG. 51 is an enlarged view of the view of FIG. 50 focusing on the screw guide.
Figure 52:
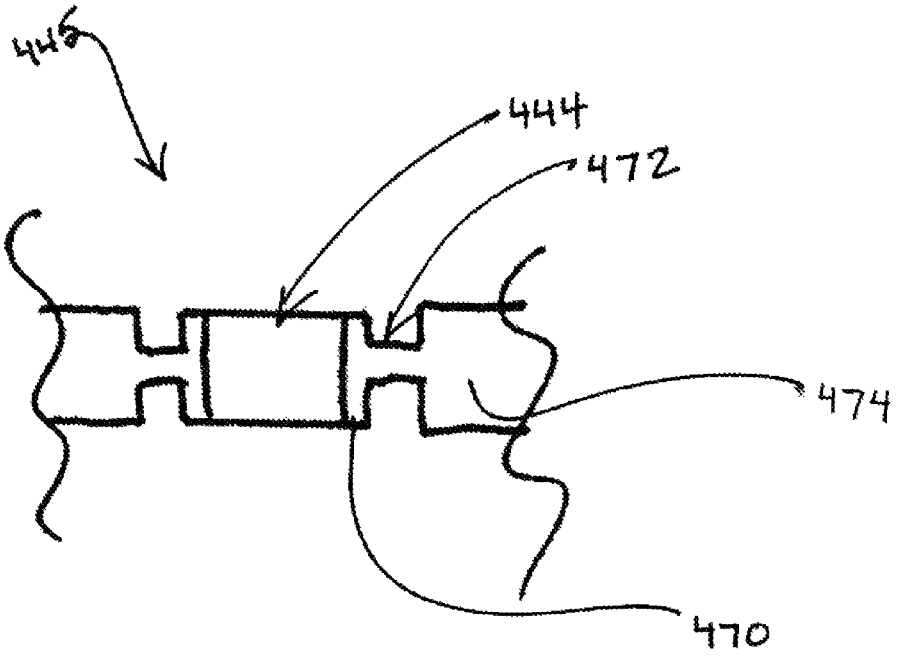
FIG. 52 is a cross sectional view of the screw guide of the lower module of FIG. 47.
Figure 53:
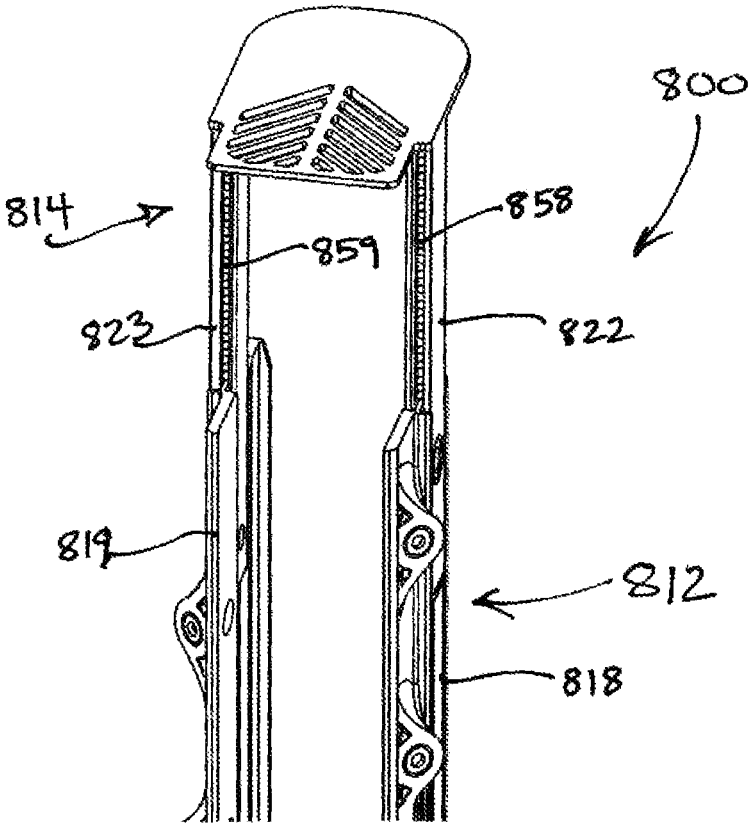
FIG. 53 shows another embodiment of the disclosed hanger with a locking mechanism.
Figure 55:
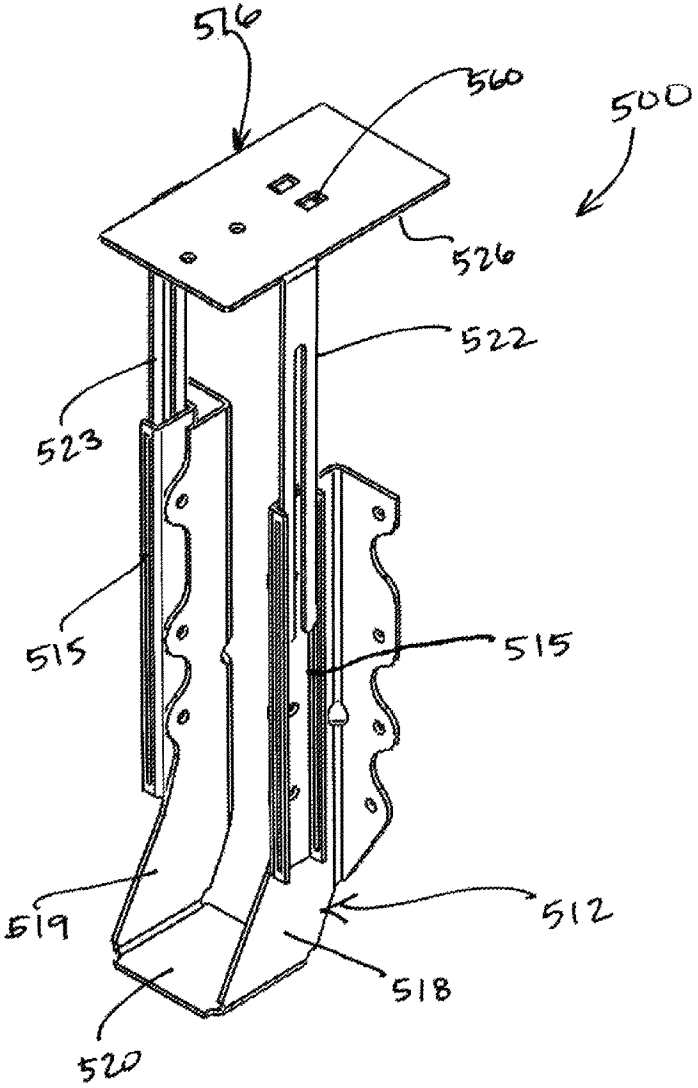
FIG. 55 shows an embodiment of an adjustable hanger formed with the upper module of FIG. 54.

FIGS. 50 and 51 show a view of the boss cover 470 and breakaway ring 472 from the inside surface of the side wall 418. Additionally, FIG. 52 is a cross sectional representation through the boss cover 470. As can be seen in these views, both the outer side (FIGS. 47-49) and inner side (FIGS. 50-51) include an annular groove circumscribing the boss cover to define the breakaway ring 472 with reduced thickness. Preferably, the boss cover 470 is positioned close to the outer inlet of the hole with an interior hollow bore 474.

In operation, the boss cover 470 provides a relatively smaller opening 444 sizes such that it engages or "grips" threads of a screw driven through the hole. The hole guides the screw at a more precise angle than a full hole opening, which has a greater diametric clearance and is thus more susceptible to angular variances. The boss cover 470 is configured so that it breaks away from the main body of the hanger at some point as a screw is driven further through the hole and eventually into the joist and ledger, yielding an abutment between the head of the screw and the outside surface of the hanger. In this manner, the screws are driven in a repeatably precise angle and position.

As noted above, the inventive concepts related to the boss cover 470 in FIGS. 47-52 can be incorporated into any of the disclosed embodiments of expandable hangers, but are not limited to use within only them. Any variety of building bracket or hanger can be fit with such breakaway boss covers to provide a more precise screw or fastener driving angle.

Figure 54:
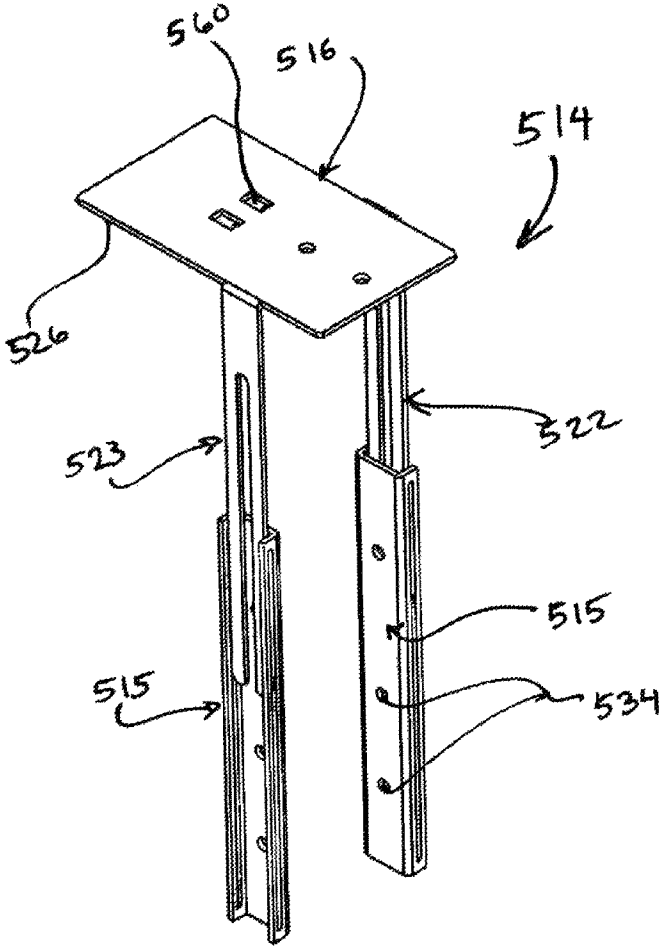
FIG. 54 shows an alternate embodiment of an upper module configured to be used with a variety of lower hanger modules as may be commercially available.
Figure 57:
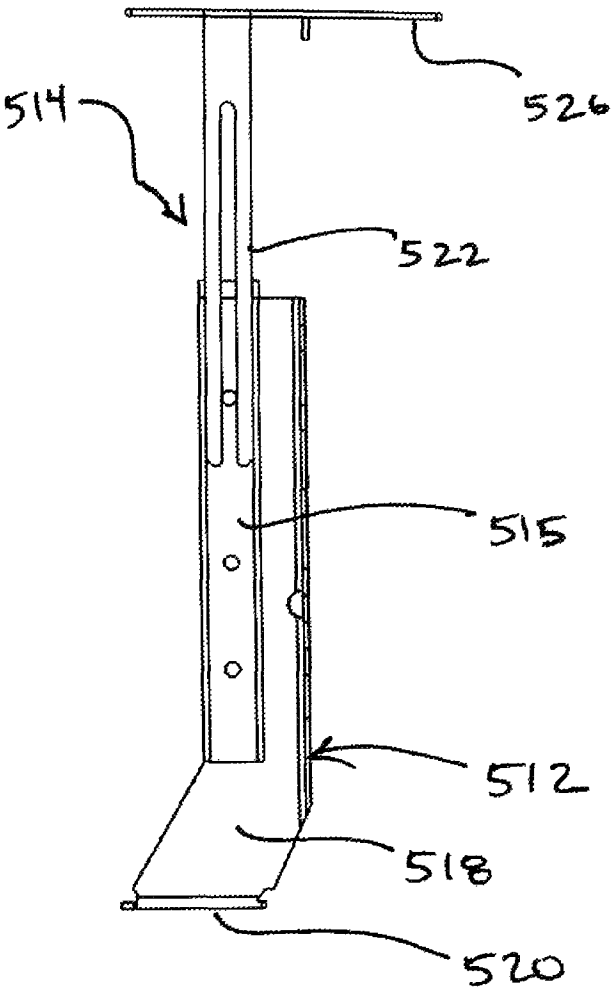
FIG. 57 is a side elevation view of the hanger of FIG. 55.
Figure 56:
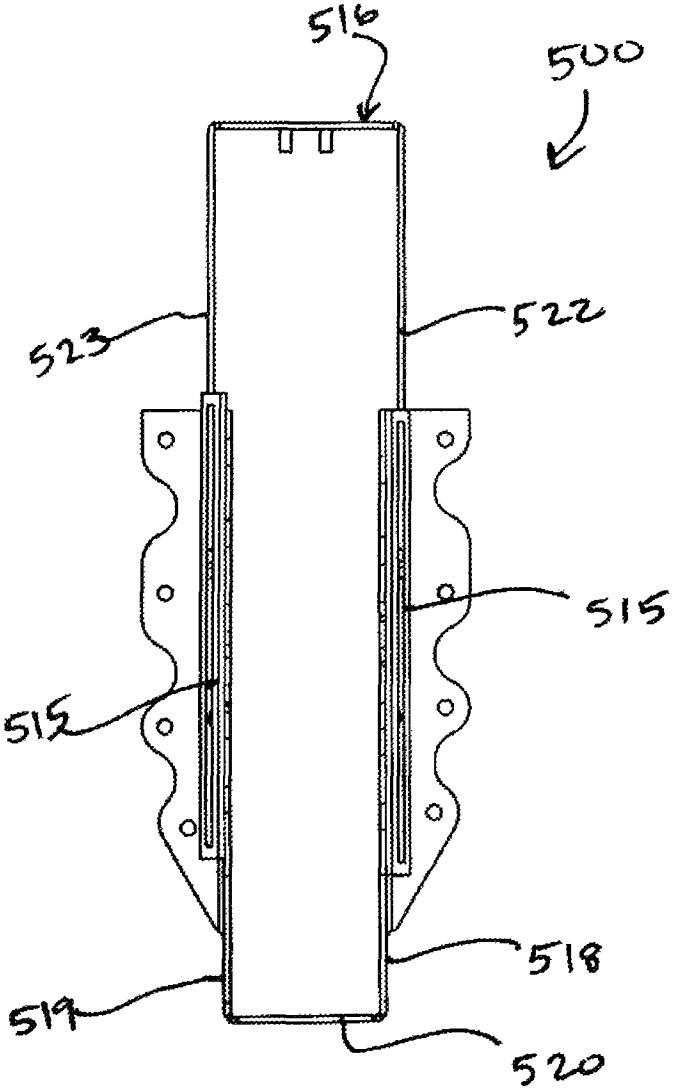
FIG. 56 is a front elevation view of the hanger of FIG. 55.

FIGS. 54-57 depict another embodiment of the adjustable hanger assembly 500 formed from a standalone off-the-shelf hanger that forms a lower module 512 and an add-on upper module 514 with sliders 515, each of which slidingly receives a side leg, 522 and 523. The upper module 514 is attachable to the lower module 512 via rigid independent attachment of the sliders 515 to the lower module 512 to form the hanger 500, for example secured to the side panels, 518 and 519, with screws through holes 534. In this manner, the clearance between the support web 520 and upper panel 516 is adjustable via sliding reciprocation of the legs, 522 and 523, within the sliders 515. Like the earlier embodiments, the upper panel 516 includes a rear support flange 526 configured to rest atop a building support member, such as a ledger, to ensure a level installation of a beam trapped between the web 520 and upper panel 516. The upper panel may include viewing windows 560. FIG. 54 depicts the add-on upper module 514 in isolation that is generally configured to attach to many different types of commercially available hangers that generally include a web between two side panels.

Figure 58:
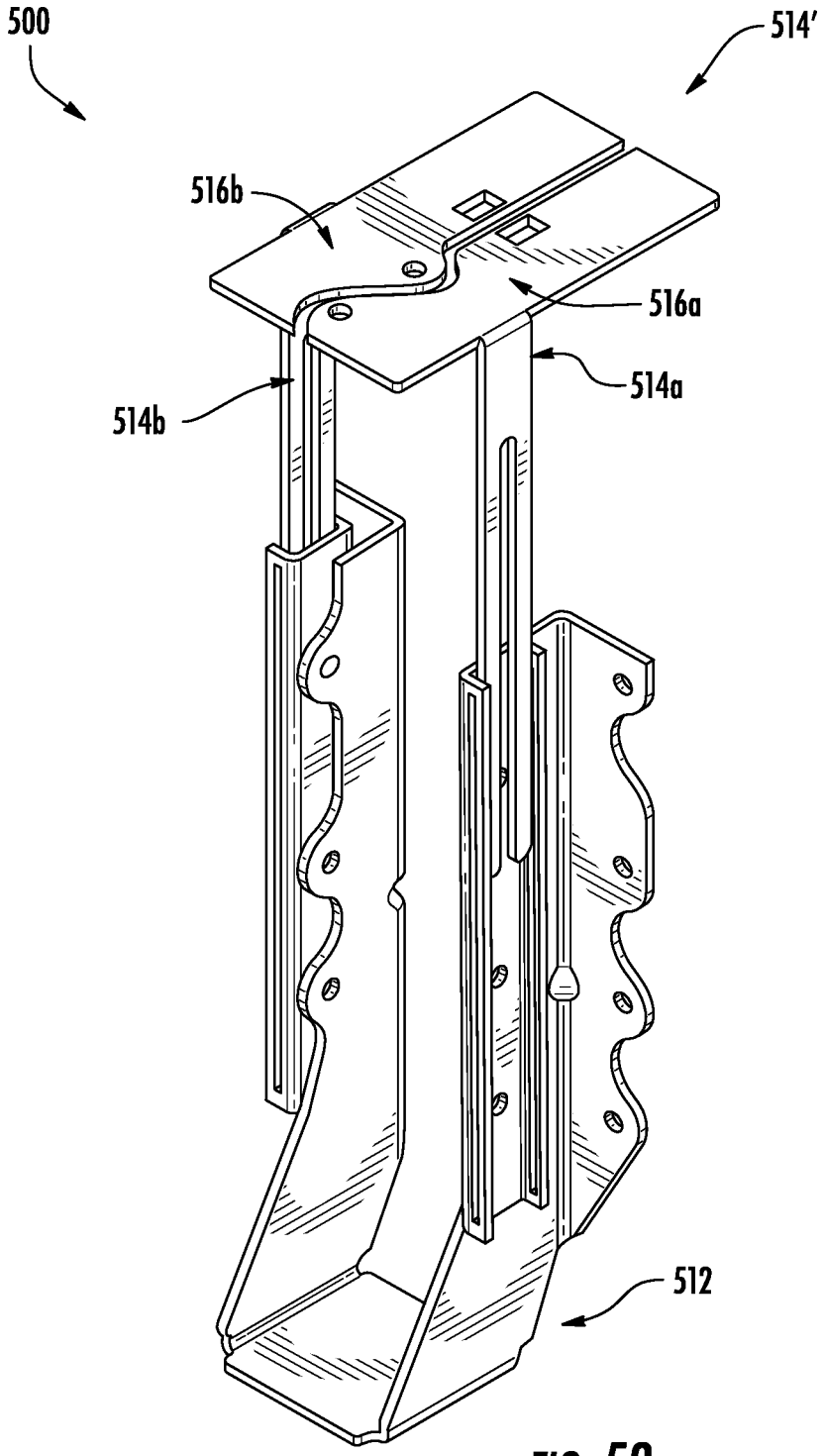
FIG. 58 is a perspective view of another embodiment of the adjustable hanger that utilizes separate upper sub-modules.
Figure 59:
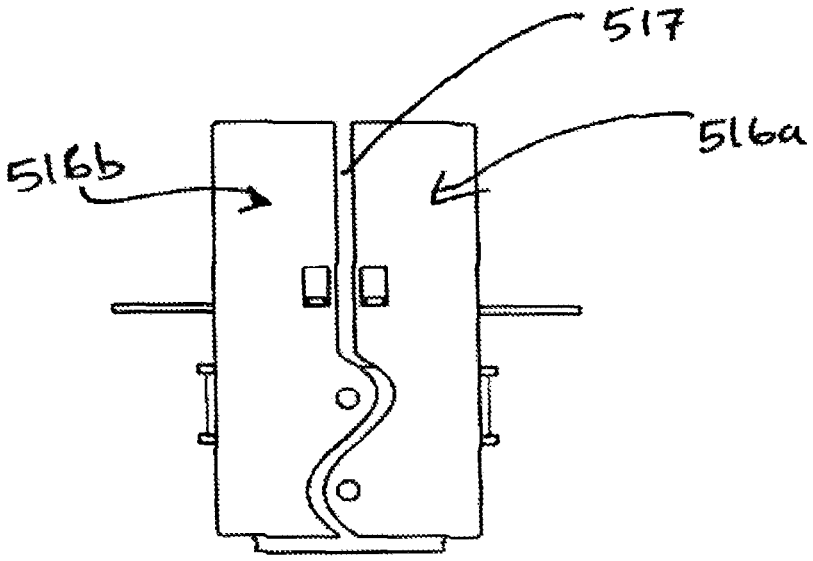
FIG. 59 is a top elevation view of the hanger of FIG. 58.

FIGS. 58 and 59 depict an alternate embodiment of an upper module 514' formed from two separate sub-modules, **514*a* and 514*b*. As shown, the sub-modules align at an interface 517 between upper panel sections, 516*a* and 516*b*. The upper module 514' is otherwise substantially similar to the unitary upper module 514 shown in FIGS. 54-57. In this manner, the sub-modules, 514*a* and 514*b*, are separately attachable to the hanger/lower module 512 to form the hanger 500'**.

Additionally, while several distinct embodiments of an adjustable joist hanger have been described herein, none of them are strictly limited to the exact depicted versions. Embodiments exist with a combination of features or sub-features of one embodiment with features or sub-features of another embodiment. For example, embodiments exist that employ a band like that shown as reference numeral 216 and also include a set of ribs like those shown as reference numeral 350. Embodiments exist that employ a band and side screw holes like those depicted as reference numeral 334. Additionally, versions of each of the hangers may include a viewing window in the top panel of the upper module like that shown as reference numeral 360. The disclosed embodiments provide substantial variability in the dimensions of beams that they can accommodate and secure to a building support members in a repeatably level and vertically aligned position.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An adjustable hanger for use in attaching an elongate beam to a building support structure, comprising:

an upper module with a top support structure engagement unit and opposite upper side units; and a lower module engaged with the upper module, the lower module having a lower web for supporting an edge of the support beam and two opposite lower side units extending upwardly from the web, wherein each of the upper side units is slidably engaged with one of the lower side units to vertically move the upper and lower modules relative to each other to thereby adjust a positioning of the lower web relative to the top support structure engagement unit.

2. The modular hanger of claim 1, wherein each of the lower side units defines a groove for receipt of a portion of one of the upper side units.

3. The modular hanger of claim 2, wherein each groove is sized and shaped to maintain the respective portion of the respective upper side unit and inhibit relative movement between the upper module and lower module in a front-to-rear direction.

4. The modular hanger of claim 2, comprising a slot within each groove, wherein each upper side unit includes a central segment received within a respective slot in a slidable engagement.

5. The modular hanger of claim 4, wherein each upper side unit includes an outer segment that rests within a portion of the respective groove with the respective central segment extending into the respective slot.

6. The modular hanger of claim 2, wherein each of the upper side units has an I-shaped cross section with an inner segment positioned on an inner portion of the respective lower side unit, a central segment extending through a slot in the respective lower side unit, and an outer segment positioned on an outer portion of the respective lower side unit.

7. The modular hanger of claim 1, wherein the upper module comprises a top panel that is substantially parallel to the bottom web when the upper module and lower module are engaged, the top panel configured to sandwich an elongate beam with the bottom web.

8. An adjustable hanger for use in attaching an elongate beam to a building support structure, comprising:

an upper module having a top panel extending in a forward direction and a rear flange extending in a rearward direction, and at least one upper engagement leg extending downward;

a lower module having a bottom web extending in a forward direction and at least one lower engagement unit, wherein the top panel is movable relative to the bottom web from a fully collapsed position to a fully expanded position via sliding engagement between the at least one upper engagement leg and at least one lower engagement unit to trap an elongate beam between the top panel and bottom web, the rear flange is configured to rest on a top edge of a building support structure, and the bottom web is substantially parallel to the rear flange such that a beam trapped between the top panel and bottom web is maintained substantially parallel with the top edge of the building support structure when the rear flange is resting on the top edge.

9. An adjustable hanger for use in attaching an elongate beam to a building support structure, comprising:

an upper module comprising a top panel with a substantially flat bottom surface;

a lower module comprising a bottom web with a web having a substantially flat top surface, wherein the upper module and lower module are attached to one another with the bottom surface of the top panel opposing the top surface of the bottom web substantially parallel to one another with spacing therebetween, when attached, the upper module and lower module are slidable relative to each other to expand and contract the spacing, an elongate beam is receivable in the spacing with the upper module and lower module in a relatively expanded position, and the upper module and lower module can be contracted from the relatively expanded position to trap the top edge and bottom edge of the beam with the beam extending forward.

10. The hanger of claim 9, wherein the lower module has a portion with an outer surface comprising a plurality of spaced apart ribs.

11. The hanger of claim 9, wherein one or both of the upper module and lower module defines a plurality of attachment holes, each attachment hole being configured to receive an elongate fastener driven into a portion of the beam and into the rear support to attach the hanger and beam.

12. The hanger of claim 9, wherein the upper module and lower module are engaged to one another via a ratchet mechanism.

13. The hanger of claim 9, wherein the upper module and lower module are engaged with one another in a position toward a rear of the beam when the beam is received between the top panel and bottom web.

14. The hanger of claim 9, wherein the upper module comprises at least one leg slidabably received in a slider track, and the slider track is fixable to the lower module to allow relative sliding between the upper module and lower module.

15. The hanger of claim 9, wherein the top panel is split between a right portion and a left portion with a slot therebetween.

16. The hanger of claim 15, wherein the slot has at least a portion that is not linear.

17. The hanger of claim 9, wherein the top panel defines at least one window opening through which a rear portion of the beam is viewable when received between the top panel and bottom web.

18. The modular hanger of claim 9, wherein the upper module and lower module are optionally vertically lockable relative to one another.

19. The modular hanger of claim 9, wherein one or both of the upper module and the lower module comprises at least one toenail guide, each toenail guide defining an obliquely extending hole through the respective side unit.

20. The modular hanger of claim 19, and having a boss cover configured to at least partially break away from the respective side unit when a fastener is driven through the hole.

* * * * *